US008282169B2

(12) United States Patent
Schmitz et al.

(10) Patent No.: US 8,282,169 B2
(45) Date of Patent: Oct. 9, 2012

(54) LOAD SUPPORT STRUCTURE

(75) Inventors: Johann Burkhard Schmitz, Berlin (DE); Claudia Plikat, Berlin (DE); Carola Eva Marianne Zwick, Berlin (DE); Roland Rolf Otto Zwick, Berlin (DE); Andrew Keith Hector, Grandville, MI (US); John Fredric Aldrich, Grandville, MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 13/075,940

(22) Filed: Mar. 30, 2011

(65) Prior Publication Data

US 2011/0175423 A1 Jul. 21, 2011

Related U.S. Application Data

(63) Continuation of application No. 12/284,159, filed on Sep. 18, 2008, now Pat. No. 7,926,879.

(60) Provisional application No. 60/994,737, filed on Sep. 20, 2007.

(51) Int. Cl.
*A47C 7/54* (2006.01)

(52) U.S. Cl. ..... 297/411.25; 297/411.29

(58) Field of Classification Search ..... 297/452.18, 297/452.19, 452.55, 452.56, 452.65, 340, 297/452.13, 452.3, 452.33, 411.29, 411.4, 297/411.25

See application file for complete search history.

(56) References Cited

U.S. PATENT DOCUMENTS 693,197 A * 2/1902 White ..... 297/271.6
946,225 A 1/1910 Irwin
2,771,122 A 11/1956 Straub
3,041,109 A * 6/1962 Eames et al. ..... 297/451.4
3,120,407 A 2/1964 Propst
3,208,794 A * 9/1965 Gunn ..... 297/440.11
3,230,011 A 1/1966 Propst
3,300,251 A 1/1967 Helms
3,565,482 A 2/1971 Blodee
3,586,370 A 6/1971 Barecki et al.
3,640,576 A 2/1972 Morrison et al.

(Continued)

FOREIGN PATENT DOCUMENTS

AU 6563380 A1 1/1983

(Continued)

OTHER PUBLICATIONS

Written Opinion of the International Searching Authority in International Application No. PCT/IB07/00745, 3 pages.

(Continued)

*Primary Examiner* — Sarah B McPartlin
(74) *Attorney, Agent, or Firm* — Brinks Hofer Gilson & Lione

(57) ABSTRACT

A load support member includes spaced apart beam members, a linking member and a stop member. In another aspect, the beam includes a support surface defining first and second landing regions, which are in contact with and support a membrane. In another aspect, a brace member is secured between laterally spaced beams, with the brace member having a greater height than width at the end thereof and a greater width than height at the middle thereof. In another aspect, a pair of armrests are joined to a cross member and a pair of spaced apart beams in a releasable engagement. In yet another aspect, a pair of beam members are fixedly joined with a cross member, which is pivotally connected to a link pivotally connected to the beams. A method of assembling a load support structure is also provided.

3 Claims, 60 Drawing Sheets

U.S. PATENT DOCUMENTS

| | | | | |
|---|---|---|---|---|
| 3,669,496 | A | 6/1972 | Chisholm | |
| 3,844,612 | A | 10/1974 | Borggren | |
| 3,877,750 | A | 4/1975 | Scholpp | |
| D235,298 | S | 6/1975 | Schuyler | |
| 4,036,527 | A | 7/1977 | Faul | |
| 4,062,590 | A | 12/1977 | Polsky et al. | |
| 4,230,365 | A | 10/1980 | Messinger | |
| 4,522,444 | A | 6/1985 | Pollock | |
| 4,529,247 | A | 7/1985 | Stumpf et al. | |
| 4,585,272 | A | 4/1986 | Ballarini | |
| 4,592,126 | A | 6/1986 | Bottemiller | |
| 4,889,385 | A | 12/1989 | Chadwick et al. | |
| 4,913,493 | A | 4/1990 | Heidmann | |
| 5,015,038 | A | 5/1991 | Mrotz, III | |
| 5,029,942 | A | 7/1991 | Rink | |
| D320,034 | S | 9/1991 | Brooks et al. | |
| 5,102,196 | A | 4/1992 | Kaneda et al. | |
| 5,114,210 | A | 5/1992 | Naess | |
| 5,240,308 | A | 8/1993 | Goldstein | |
| 5,320,410 | A | 6/1994 | Faiks et al. | |
| 5,328,245 | A | 7/1994 | Marks | |
| 5,352,022 | A | 10/1994 | Knoblock | |
| 5,518,294 | A | 5/1996 | Ligon, Sr. et al. | |
| D377,431 | S | 1/1997 | Stumpf et al. | |
| 5,649,743 | A | 7/1997 | Skalka | |
| 5,660,439 | A | 8/1997 | Unwalla | |
| 5,664,835 | A | 9/1997 | Desanta | |
| D386,023 | S | 11/1997 | Stumpf et al. | |
| D390,026 | S | 2/1998 | Biecher | |
| 5,842,264 | A | 12/1998 | Roossien et al. | |
| 5,918,935 | A | 7/1999 | Stulik et al. | |
| 5,954,399 | A | 9/1999 | Hong | |
| 5,975,634 | A | 11/1999 | Knoblock et al. | |
| 6,015,187 | A | 1/2000 | Roslund, Jr. et al. | |
| 6,059,368 | A | 5/2000 | Stumpf | |
| D436,259 | S | 1/2001 | Nagamitsu | |
| D436,260 | S | 1/2001 | Nagamitsu | |
| D437,132 | S | 2/2001 | Nagamitsu | |
| 6,193,318 | B1 | 2/2001 | Becker et al. | |
| D441,977 | S | 5/2001 | Vaaler | |
| D442,383 | S | 5/2001 | Bell | |
| 6,234,573 | B1 | 5/2001 | Röder et al. | |
| D444,309 | S | 7/2001 | Nagamitsu | |
| 6,257,665 | B1 | 7/2001 | Nagamitsu et al. | |
| D465,347 | S | 11/2002 | Bell | |
| 6,505,890 | B2 | 1/2003 | Riley et al. | |
| D469,618 | S | 2/2003 | Nagamitsu | |
| D469,970 | S | 2/2003 | Molteni | |
| 6,513,874 | B1 | 2/2003 | Sander et al. | |
| 6,572,190 | B2 | 6/2003 | Koepke et al. | |
| D476,493 | S | 7/2003 | Nagamitsu | |
| D476,820 | S | 7/2003 | Nagamitsu | |
| 6,609,754 | B2 | 8/2003 | Rajasingham | |
| D481,560 | S | 11/2003 | Vidmar et al. | |
| D482,542 | S | 11/2003 | Pluer | |
| 6,644,752 | B2 * | 11/2003 | Takata | 297/452.56 |
| D487,359 | S | 3/2004 | Giugiaro | |
| D489,542 | S | 5/2004 | Giugiaro | |
| 6,749,261 | B2 | 6/2004 | Knoblock et al. | |
| 6,820,933 | B2 | 11/2004 | Fereira Da Silva | |
| 6,896,328 | B2 | 5/2005 | Goodworth | |
| D509,969 | S | 9/2005 | Loew et al. | |
| D511,629 | S | 11/2005 | Caldwell | |
| D512,578 | S | 12/2005 | Igarashi | |
| D512,579 | S | 12/2005 | Igarashi | |
| D513,910 | S | 1/2006 | Gehry | |
| 6,986,549 | B2 | 1/2006 | Kniese | |
| 6,991,291 | B2 | 1/2006 | Knoblock et al. | |
| D514,345 | S | 2/2006 | Igarashi | |
| D514,838 | S | 2/2006 | Igarashi | |
| 7,055,911 | B2 * | 6/2006 | Simpson et al. | 297/440.11 |
| D526,495 | S | 8/2006 | Albin | |
| 7,097,249 | B2 | 8/2006 | Igarashi et al. | |
| D527,920 | S | 9/2006 | Giugiaro | |
| D528,810 | S | 9/2006 | Giugiaro | |
| D528,811 | S | 9/2006 | Giugiaro | |
| D528,812 | S | 9/2006 | Giugiaro | |
| D540,557 | S | 4/2007 | Doughty | |
| D542,549 | S | 5/2007 | Hara | |
| D542,580 | S | 5/2007 | Loew et al. | |
| D543,039 | S | 5/2007 | Hara | |
| D543,040 | S | 5/2007 | Hara | |
| D543,041 | S | 5/2007 | Hara | |
| D543,042 | S | 5/2007 | Hara | |
| D543,369 | S | 5/2007 | Hara | |
| D543,371 | S | 5/2007 | Wang | |
| D543,385 | S | 5/2007 | Loew et al. | |
| D543,397 | S | 5/2007 | Loew et al. | |
| D543,736 | S | 6/2007 | Shields | |
| 7,226,127 | B1 | 6/2007 | Yevko et al. | |
| 7,243,993 | B2 | 7/2007 | Igarashi et al. | |
| 7,252,336 | B2 | 8/2007 | Frisina | |
| D550,471 | S | 9/2007 | Igarashi | |
| D550,977 | S | 9/2007 | Igarashi | |
| D552,368 | S | 10/2007 | Scheper et al. | |
| D552,882 | S | 10/2007 | Saotome | |
| D554,384 | S | 11/2007 | Scheper et al. | |
| D555,924 | S | 11/2007 | Igarashi | |
| D557,921 | S | 12/2007 | Kane | |
| D559,000 | S | 1/2008 | Vanderminden, Sr. | |
| 7,320,503 | B2 | 1/2008 | Eysing | |
| D572,915 | S | 7/2008 | Doughty | |
| D573,816 | S | 7/2008 | Muller | |
| 7,455,365 | B2 | 11/2008 | Caruso et al. | |
| 7,517,024 | B2 * | 4/2009 | Cvek | 297/452.13 |
| 7,648,201 | B2 | 1/2010 | Eysing | |
| 7,731,295 | B2 * | 6/2010 | Lin | 297/452.56 |
| 2003/0189367 | A1 | 10/2003 | Erker | |
| 2004/0032156 | A1 | 2/2004 | Stipek | |
| 2006/0181126 | A1 | 8/2006 | Eysing | |
| 2006/0238009 | A1 | 10/2006 | Igarashi et al. | |
| 2006/0244295 | A1 | 11/2006 | Igarashi et al. | |
| 2008/0122284 | A1 * | 5/2008 | Yang | 297/452.56 |
| 2008/0264425 | A1 | 10/2008 | Mundell | |
| 2009/0042014 | A1 | 2/2009 | Synnestvedt et al. | |
| 2010/0117419 | A1 | 5/2010 | Schmitz et al. | |
| 2010/0289308 | A1 | 11/2010 | Schmitz et al. | |

FOREIGN PATENT DOCUMENTS

| | | | |
|---|---|---|---|
| DE | 4433663 | A1 | 9/1996 |
| DE | 19916411 | A1 | 11/2000 |
| EP | 049310 | B1 | 3/1985 |
| EP | 00250109 | A1 | 12/1987 |
| EP | 860355 | A1 | 8/1998 |
| EP | 1040999 | A2 | 10/2000 |
| EP | 1316651 | A2 | 6/2003 |
| FR | 2715124 | A1 | 7/1995 |
| JP | D1284784 | | 10/2006 |
| LU | 88528 | A1 | 3/1996 |
| WO | WO 2007/110737 | A2 | 10/2007 |
| WO | WO 2009/039231 | A2 | 3/2009 |

OTHER PUBLICATIONS

Office Action from co-pending U.S. Appl. No. 12/225,335, dated Sep. 21, 2010, 7 pages.

Eysing, Voker W., "Der Natur entlehnt—Derived from Nature," md Magazine of Design, Oct. 2005, 5 pages.

Extended European Search Report for European Application No. 08832398.5, dated Jul. 28, 2011, 8 pages.

International Search Report in International Application No. PCT/IB07/00721, dated Sep. 5, 2008, 3 pages.

Written Opinion of the International Searching Authority in International Application No. PCT/IB07/00721, dated Sep. 5, 2008, 6 pages.

United States Utility Patent Application U.S. Appl. No. 12/225,334, filed Sep. 18, 2008, Schmitz et al. as filed, 67 pages.

United States Design Patent Application U.S. Appl. No. 29/291,968, filed Sep. 21, 2007, Schmitz et al. as filed, 50 pages.

Faraday, "Exploring Biomimetrics for Products & Packaging," Sep. 27, 2007, 3 pages.

Herman Miller for Business, "Eames Aluminum Group & Soft Pad Chairs," [online][retrieved from internet: URL http://www.hermanmillercom/CDA/SSA/Product/1,1592,a10-c440-p39,00.html], [retrieved—date unknown], 2 pages.

United States Patent and Trademark Office, Trademark, Principal Register, Reg. No. 3,105,591, registered Jun. 20, 2006, 1 page.

Okamura Corporation, "Baron Ergonomic Mesh Chair," copyright 2005, [online][retrieved from internet: URL: http://www.okamura.co.jp/english/product/office/baron/index.html], [retrieved on Mar. 31, 2008], 1 page.

International Search Report in International Application No. PCT/US08/76768, dated Mar. 10, 2009, 4 pages.

Written Opinion of the International Searching Authority in International Application No. PCT/US08/76768, dated Mar. 10, 2009, 7 pages.

International Search Report in International Application No. PCT/IB07/00745, dated Jul. 17, 2008, 2 pages.

International Preliminary Report on Patentability in International Application No. PCT/US2008/076768, dated Mar. 24, 2010, 9 pages.

* cited by examiner

LOAD SUPPORT STRUCTURE

This application is a continuation of U.S. application Ser. No. 12/284,159, filed Sep. 18, 2008 now U.S. Pat. No. 7,926,879, which claims the benefit of U.S. Provisional Application No. 60/994,737, filed Sep. 20, 2007, both entitled "Load Support Structure," the entire disclosures of which are hereby incorporated herein by reference.

FIELD OF THE INVENTION

The invention relates to a load support structures, for example and without limitation load support structures used in seating structures.

BACKGROUND

DE 42 35 691 C2 describes a seat in which the seat is to be automatically adapted to the body weight of the particular user. A drawback of seats of this type is the enormous constructional complexity which leads to high costs and to the seat being heavy.

U.S. Pat. No. 6,986,549 B2 discloses a chair with a backrest which reacts to a force acting on it by changing its shape. This backrest is formed by two surfaces which are referred to as skins and have a multiplicity of articulations, mutually opposite articulations of the two skins being connected in each case by individual ribs. On account of its specific design, this backrest tries to adapt itself to every contour and only at its tip has a reaction force which counteracts deformation or movement. Without the ribs connecting them, the so-called skins, which form the surface of the backrest, rather than having any inherent stability, behave like a link chain comprising plates which are each connected by articulations. A chair backrest which is designed in such a way encourages a rounded-back posture and thus definitely does not result in a healthy posture.

SUMMARY

In one aspect of the invention, a seat has been developed, in which, in order to provide basic compensation for different body weights of the individuals using the seat, the use of a rocking device in the sense of a complex mechanism, in which movements are used to automatically change spring forces or spring characteristics, is to be omitted.

The seat has a front seat part, a rear seat part, a lower backrest part and an upper backrest part, which comprise at least one supporting arm, the supporting arm being composed of at least one upper support and at least one lower support, the upper support being guided in a region A of the front seat part by at least one guide element, the upper support and the lower support being connected to each other in a region D of the upper backrest part, the upper support and the lower support having an arcuate profile in the region B of the rear seat part and in the region C of the lower backrest part, the upper support and the lower support being positioned with respect to each other in the region B of the rear seat part or in the region C of the lower backrest part by at least one connecting link, and the front seat part being able to be pulled back by the upper support with a pulling-back movement directed towards the backrest parts C, D if, when the backrest part is loaded by an individual leaning against it, the seat element is displaced from a basic position I into a resting position II. By this means, a movement by means of which the seat part is actively pulled back can be produced by the seat element. The active displacement or deformation of the seat element makes it possible to influence the position of an individual sitting on the seat relative to the underframe of the seat and, by this means, to counteract the loss of potential energy when the individual leans back into the resting position II. This compensation takes place in order to keep the restoring force, which has to be applied by the backrest part to comfortably move the individual from the resting position II into the basic position I, low or to make it entirely superfluous. The core of the invention is a seat with at least one supporting arm by means of which an active movement of the front seat part can be produced by a largely defined change in shape.

Furthermore, one aspect of the invention makes provision, by means of the pulling-back movement, to bring about a movement of the front seat part or of the upper support with a horizontal component or a vertical, upwardly directed component. By means of the movement of the front seat part upwards and in the direction of the backrest part, it is possible, as an individual sitting on the seat leans back, to raise his lower body gently from the basic position I into the resting position II or into any intermediate position by means of the front seat part. By this means, a loss of potential energy due to the lowering of the upper body of the individual can be compensated for by the backrest part. The opposed movements of the seat part and of the backrest part permit a seesaw movement or rocking movement, similar to a seesaw or a beam-balance, of the individual on the seat, which movement can take place very substantially independently of the individual's body weight. A presetting of a spring that is dependent on the body weight of the individual using the seat can therefore be basically or very substantially omitted, since the deformation of the seat element brings about a compensation which is independent of the body weight. That is to say, each individual using the seat forms a counterweight as a function of the body weight with a proportion of the body weight itself and thereby brings about intrinsic compensation.

According to one aspect of the invention, elastic deformability of the supporting arm or of the upper support and/or of the lower support is provided at least in the region B of the rear seat part and in the region C of the lower backrest part. This makes it possible to change a radius of curvature of the supports and therefore also a relative movement between the two supports, by means of which the front seat part can then also be moved.

According to one aspect of the invention, the guide element, which guides the upper support in the region of the front seat part on the lower support or on the underframe, is essentially designed as a lever arm which is fastened rotatably to the upper support and rotatably to the lower support or to the underframe. This makes it possible, using simple means, to define a movement on a circular path, which movement has a horizontally directed component and a component directed vertically upwards during a movement from the basic position I into the resting position II.

Alternatively, in one aspect, the invention makes provision to design the guide element as a slotted-guide mechanism in which the upper support is movable in the region of the front seat part relative to the lower support or to the underframe. In the case of a slotted-guide mechanism, a curve on which the front seat part or the upper support moves can be very substantially freely selected. By this means, a complicated coupling mechanism for defining a curve for the movement of the upper support can be omitted.

According to a first variant embodiment, as the connecting link or mechanical connecting link between the upper support and the lower support, the invention provides a lever which is connected rotatably in each case to the upper support and the lower support. This makes it possible to define the profile of a relative movement executed by the two supports during the transition from the basic position I into the resting position II, with the supports being pulled towards each other or pushed apart from each other during their opposed displacement depending on the positioning of the bearing points of the lever. Instead of a lever which is mounted by means of bolts, use of clasps or clips is also provided.

According to a second variant embodiment, the connecting link is formed between the upper support and the lower support by at least one slotted-guide mechanism. It is possible to define, by means of a connecting link of this type, any desired curves on which the supports move during corresponding loading.

According to a third variant embodiment, the connecting link is formed between the upper support and the lower support by an elastic bearing. This makes it possible to reduce the elastic deformation of the upper and/or lower support, since the bearing element used as the bearing can also be deformed and therefore can store energy. In particular, a rubber block which is adhesively bonded to the supports is provided as the bearing.

Various aspects of the invention provide an energy store which, in particular, is adjustable. By this means, for example, particular seat loads caused, for example, by the body build of individuals using the seat can be compensated for.

Various aspects of the invention provide, as energy store, for example, a spring element counter to which the upper support can be pulled back in the direction of the backrest part. A spring element of this type can be realized with little outlay and requires little construction space.

Various aspects of the invention also provide a guided rocking movement of the seat element on the underframe, with there being approximately an equilibrium of forces between the seat part and the backrest part in every seat position between the basic position I and the resting position II. By this means, the function of the seat is largely independent of the body weight of an individual using the seat.

Furthermore, various aspects of the invention make provision to fasten the lower support of the supporting arm to the underframe. By this means, the upper support of the supporting arm obtains the required degrees of freedom in order, despite the guide element, despite the at least one connecting link and despite the connection to the lower support in the region of the upper backrest part, to compensate for the shifting of the weight of an individual using the seat.

Various embodiments of the invention also provide an L-shaped profile of the supporting arm or of the supports of the supporting arm in the side view of the seat. This makes it possible to use the supporting arm as a supporting component of the seat element and to use it both to control the sequence of movement of the seat element and to form the seat part itself. In principle, every supporting arm is designed as an arcuate clamp which has two legs running next to each other and at a distance from each other, the legs forming the supports. Between a clamp head, in which the two legs are connected to each other or merge one into the other, and free ends of the legs, the legs are connected by at least one connecting link. The free end of the upper leg of the clamp, which end forms the seat surface or bears the latter, is guided on the lower leg or on the underframe by a guide element.

According to one aspect of the invention, in the basic position I and in the resting position II, an upper pivotal point of the guide element is located higher than a lower pivotal point of the guide element, the upper pivotal point being at a greater distance from the backrest part than the lower pivotal point. This defines a movement clearance of the front seat part, in which the front seat part rises continuously from the basic position I into the resting position II and moves continuously in the direction of the backrest.

According to one aspect of the invention, during a loading of the seat element by a person leaning back against the backrest part, the connecting link is rotatable by the supports and is displaceable with the latter. The connecting link therefore constitutes a connection between the supports, which connection permits the supports or the supporting arm to have a delimited movement.

A variant embodiment of the invention provides a seat in which the supporting arm is formed by a left, upper support and a right, upper support and a lower support situated between them, the lower support being connected to the left, upper support by at least one mechanical connecting link, and the lower support being connected to the right, upper support by at least one mechanical connecting link. By this means, with just one supporting arm, a seat or a seat element can be brought about, in which a supporting arm suffices in order to carry a covering which serves as the seat surface and backrest.

Furthermore, in the case of a supporting arm with two upper supports, the invention provides an upwardly directed limb of the lower support, which limb is divided into two struts and merges by means of the latter into upwardly directed limbs of the upper supports. Such a transition of the lower support into the upper supports increases a torsional rigidity of the seat element and is suitable for a single-piece design of the supporting arm.

Various aspects of the invention also make provision, in the case of a supporting arm with two upper supports, to guide the upper supports on the lower support or on the underframe by means of a respective guide element. The use of two guide elements enables the divided upper support also to be guided along a desired curve.

According to various aspects of the invention, the front seat part can be raised by deformation of the supporting arm, which is necessitated by an individual leaning back against the backrest part, along a path in the direction of the backrest part, with the supporting arm deformed in such a manner resuming its original shape by load alleviation of the backrest part, and with the front seat part being lowered again along the path mentioned during the re-forming. The lowering of the front seat part makes it easier for the individual to return into an upright sitting position.

Various aspects of the invention make provision to connect the upper support and the lower support of the supporting arm in the region of the lower backrest part by at least one connecting link and to connect them in the region of the rear seat part by at least one connecting link. By this means, buckling of the supports during the deformation between the basic position I and the resting position II can be effectively prevented.

In particular, it is also provided to connect a central section of the upper support of the supporting arm and a central section of the lower support of the supporting arm to each other by at least three connecting links. By this means, the forces occurring during the deformation of the supporting arm between the basic position I and the resting position II can be distributed particularly uniformly to the supports. This distribution of the load leads to an increase of the service life of the supporting arm.

In another aspect of the invention, a load support structure includes a beam having first and second spaced apart beam members forming a gap therebetween. At least one linking member bridges the gap and has first and second end portions coupled to the first and second beam members. The first beam member is moveable relative to the second beam member from a first position to a second position. A stop member extends from the at least one linking member intermediate the first and second end portions. The stop member includes an end portion, which is spaced from the first beam member when the first and second beam members are in the first position, and which is engaged with the first beam member when the first and second beam members are in the second position. The stop member functions as a brake or stop, which prevents the beam from collapsing.

In another aspect, a load support structure includes a beam having a support surface defining a first landing region having a first width and a second landing region having a second width, wherein the second width is greater than the first width. A membrane is coupled to the beam. The membrane is in contact with and supported by at least the first and second landing regions. In this way, the effective width or unsupported region of the membrane is reduced adjacent the second width, thereby providing more support in that region without the need to alter the contour of the beam.

In another aspect, a method of assembling a load support structure includes providing a pair of laterally spaced apart beams defining a gap therebetween, wherein the beams are substantially parallel and each have at least one end portion, securing a membrane in tension between the beams across the gap and inserting a substantially rigid brace member between the beams at a brace location spaced from the at least one end portion of each of the beams. The method further includes bending the beams such that a first distance between the at least one end portions of the beams is less than a second distance between the brace locations of the beams. In different embodiments, the beams can be bent by way of the securing the membrane in tension or by inserting the brace between the beams. In this way, in one embodiment, a rectangular membrane blank can be used, which avoids the need for difficult cuts and unnecessary waste material. At the same time, the weave pattern is maintained in alignment with the beams, thereby providing an improved aesthetic appearance.

In another aspect of the invention, a load support structure includes a pair of laterally spaced apart beams defining a gap therebetween and a membrane secured in tension between the beams across the gap. A substantially rigid brace member bridges the gap and has opposite end portions coupled to the beams. The brace member has a greater first height than first width at each of the end portions thereof, and a greater second width than second height at a middle portion thereof. This geometry provides the requisite rigidity to maintain tension in a membrane stretched between the beams, for example, while also allowing the upper portions of the beams to independently bend, with the back capable of torsionally flex.

In another aspect of the invention, a seating structure includes a pair of laterally spaced support members defining a pair of upwardly extending uprights and a pair of forwardly extending seat supports. Each of the support members includes first and second spaced apart beam members forming a gap therebetween. The second beam members are coupled with a cross member. At least one linking member bridges the gap of each of the support members, with first and second end portions of the linking member coupled to the first and second beam members. A first link extends between a forward portion of the first beam members. The first link has opposite end portions pivotally connected to the first beam members and a middle portion pivotally connected to the cross member. In one embodiment, the cross member and first link act as spreaders to maintain tension of a membrane stretched between the seat supports. At the same time, the first link acts as one link of a kinematic mechanism, for example a four-bar linkage.

In yet another aspect, a seating structure includes a pair of upwardly extending and laterally spaced uprights. Each of the uprights includes a cavity having a first mouth opening laterally inwardly and a second mouth opening laterally outwardly. A cross member extends between the uprights and includes opposite end portions received in the first mouth of each of the uprights. Each of a pair of armrests has an insert portion received in one of the second mouths of the uprights. The insert portion is releasably secured to one of the end portions of the cross member. In this way, the seating structure can be easily configured with armrests, or reconfigured with different armrests or without armrests altogether. At the same time, the armrests blend with the cross-member, making the overall assembly appear to be one-piece as the parts mate interiorly in the uprights.

Further details of the invention are described in the drawing with reference to schematically illustrated exemplary embodiments.

DETAILED DESCRIPTION OF THE PRESENTLY PREFERRED EMBODIMENTS

Figure 1B:
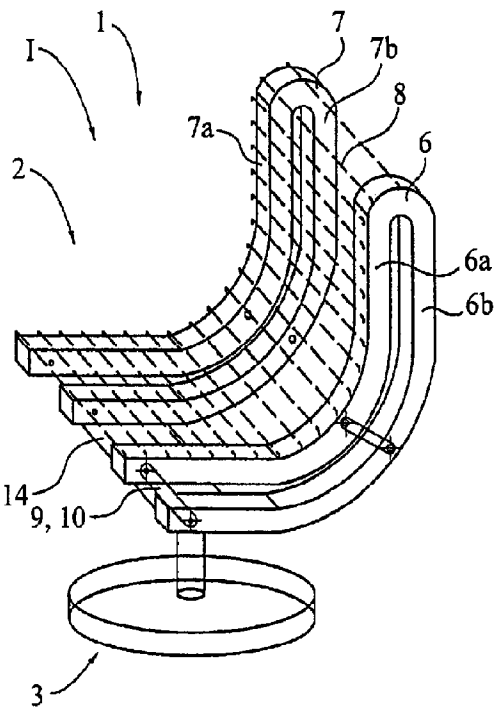
FIG. 1*b* shows: a perspective schematic diagram of the seat shown in FIG. 1*a;*
Figure 1A:
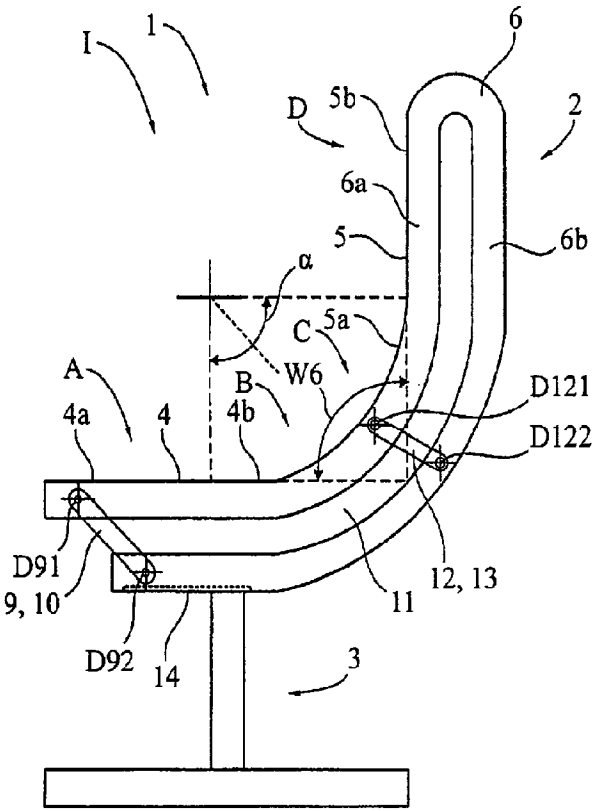
FIG. 1*a* shows: a simplified side view of a first variant embodiment of a seat according to the invention in a basic position I.

FIG. 1*a* illustrates a seat 1 in side view. The seat 1 includes a seat element 2 and an underframe 3. The seat element 2 has a seat part 4 which is divided into a front seat part 4*a* and a rear seat part 4*b*. Furthermore, the seat element 2 has a backrest part 5 which is divided into a lower backrest part 5*a* and an upper backrest part 5*b*. The seat element 2 includes two supporting arms 6, 7, otherwise referred to as beams or carrier members, which are each formed by an upper support 6*a* or 7*a*, or first beam member, and a lower support 6*b*, 7*b*, or second beam member (also see FIG. 1*b*). A fabric 8, which is only visible in FIG. 1*b*, is stretched between the two supporting arms 6, 7 and the upper supports 6*a*, 7*a* thereof. Other body support components, such as a shell or membrane, alone or in combination with the fabric, can also bridge between the two supporting arms.

FIG. 1*b* shows a simplified perspective view of the seat 1 illustrated in FIG. 1. For simplification, the seat 1 is described in more detail below only in the region of the first supporting arm 6. The upper support 6*a* is connected in a region A of the front seat part 4*a* to the lower support 6*b* by a guide element 9. The guide element 9 is designed as a lever 10 which is connected rotatably at pivotal points D91 and D92 to the upper support 6*a* and the lower support 6*b*. The second supporting arm 7 is in each case of corresponding design. The supports 6*a*, 6*b*, or beam members, of the supporting arm 6, or beam, merge into each other as a single part in a region D of the upper backrest part 5*b* and, according to a variant embodiment (not illustrated), are screwed or riveted to each other. The supports 6*a*, 6*b* can also be integrally formed. From the region D, the supports 6*a*, 6*b* have an intermediate space 11, or gap, with respect to each other over their entire extent. In particular in a region B of the rear seat part 4*b* and in a region C of the lower backrest part 5*a*, the supports 6*a*, 6*b* run in an arcuately curved manner and approximately at the same distance from each other. In this curved region B or C, the two supports 6*a*, 6*b* are connected to each other by a connecting link 12, or linking member. The connecting link 12 is designed as a lever 13 which is fastened rotatably to the supports 6*a* and 6*b* at pivotal points D121 and D122. The underframe 3 has a transverse support 14 to which the right and the left supporting arms 6, 7 of the seat element 2, and in particular the lower seat support are fastened. In particular, the lower seat support is fixedly connected to the support 14. FIGS. 1*a* and 1*b* both show the seat 1 in a basic position I in which the seat 1 is upright, if it is unloaded or if an individual is sitting on the seat 1 and is not leaning or is only slightly leaning against the backrest part 5.

In one embodiment, the upper support 6*a* has a cross sectional area of 1 $inch^2$ and a moment of inertia of 0.005000 $inch^4$ in the sections B and C. In various exemplary and suitable embodiments, the cross sectional area can be from 0.3 $inch^2$ to 4 $inch^2$ and the moment of inertia can be from 0.000172 $inch^4$ to 0.011442 $inch^4$. Preferably, the cross-sectional area is at least 0.3 $inch^2$ and the moment of inertia is at least 0.000172 $inch^4$. In one embodiment, the connecting links are spaced apart about 3 inch. In various exemplary embodiments, the connecting links are spaced at least 0.5 inch, but preferably no more than 8 inch. In the section A the moment of inertia of the first upper support 6*a* increases in direction to front seat part 4*a* in comparison with the moment of inertia in the sections B and C. In the section D the moment of inertia of the upper support 6*a* is comparable with the moment of inertia of the upper support 6*a* in the sections B and C. In all sections A, B, C and D the lower support 6*b* is dimensioned comparably to the corresponding section of the upper support 6*a*. In various exemplary embodiments, the values for the moment of inertia and cross sectional areas differ from the values of the upper support 6*a* by a factor from 0.5 to 1.5. Preferably the upper and lower support 6*a*, 6*b*, have a cross sectional area of the same shape. According to one embodiment, the cross sectional area has the shape of a rectangle. In various exemplary and suitable embodiments, the cross sectional area of the supports 6*a*, 6*b*, has the shape of a circle or an oval or a polygon.

The supports can be made, for example and without limitation, of glass filled Nylon, unfilled Nylon, glass filled polypropylene, unfilled polypropylene, polycarbonate, polycarbonate/ABS blend, acetal, or combinations thereof. The connecting links and/or the levers can be made of the same materials, or of various elastomeric materials, including without limitation, Hytrel, Nylon blended with elastomers, thermoplastic urethane or combinations thereof. The connecting links and/or the levers can also be made of rigid materials, including various rigid plastics or metal.

Figure 2:
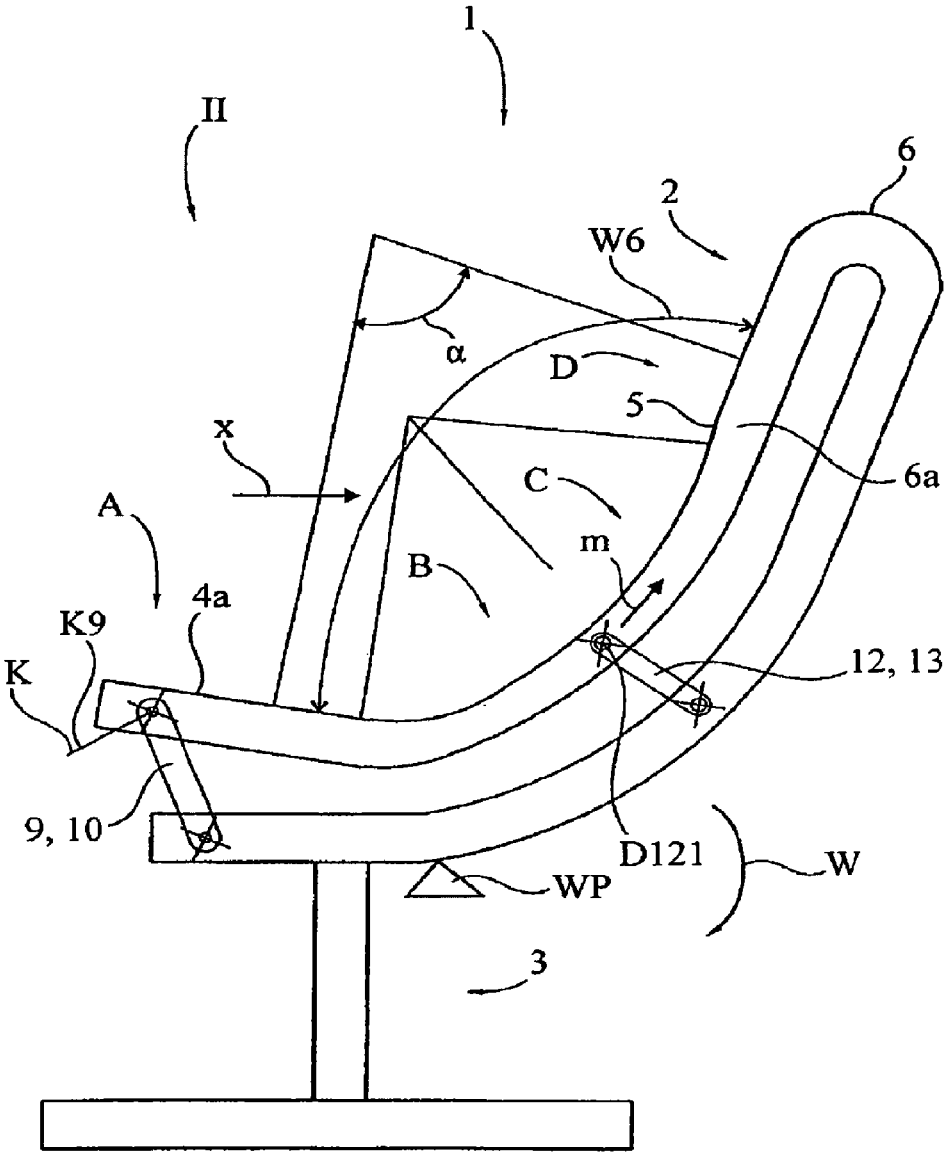
FIG. 2 shows: the seat shown in FIG. 1*a* in a resting position II.

FIG. 2 illustrates the seat 1 known from FIGS. 1*a* and 1*b* in a resting position II. The seat 1 or the seat element 2 takes up a resting position II of this type if an individual sitting on the seat 1 leans back in an arrow direction x against the backrest part 5. The action of leaning back changes an inner opening angle $\alpha$ of the seat element 2 between the seat part 4 and the backrest part 5 from $\alpha$=90° (see FIG. 1*a*) to $\alpha$=80° (see FIG. 2). This change in the inner opening angle $\alpha$ is produced by the supporting arm 6 being bent, which takes place essentially in the regions B and C and at the transition of the region B into the region A, and by the front seat part 4*a* being raised or inclined. An opening angle W6 relevant to the sitting comfort therefore increases from the basic position I into the resting position II by 10° from W6=90° to W6=100°. By the supporting arm 6 being bent, the upper support 6*a* thereof is pulled, in particular in the region A, in the arrow direction x. This leads, because of the guide element 9, to the front seat part 4*a* being raised or inclined. Said seat part can only move out of the basic position I, shown in FIG. 1*a*, on an arcuate path K9 which is predefined by the guide element 9 and is designed as a circular path K. In other words, the seat element 2 tips or sways or rocks about a rocking point WP in a manner similar to the beam of a beam-balance, with the two supporting arms 6 of the seat element 2 being deformed in the process as a function of their particular position. In the resting position II, not only has an orientation of the guide element 9, which is designed as a lever 10, but also an orientation of the mechanical connecting link 12, which is designed as a lever 13, then changed. When the supporting arm 6 is bent up, the upper support 6*a* thereof is forced to describe a relatively large radius. However, this is only possible if the upper support 6*a* with the pivotal point D121 for the lever 13 moves approximately in a direction m. The movement of the pivotal point D121 is predefined by the coupling of the upper support 6*a* to the lower support 6*b* by the mechanical connecting link 12 in order to prevent buckling or to obtain a defined movement. By means of the described active movement or deformation of the seat element 2 or of the front seat part 4*a*, an individual sitting on the seat 1 is slightly raised in the region of his thighs as he leans back. This facilitates reaching the basic position I from the resting position II without energy having to be stored to a considerable extent in a spring element. The points of application of the weight of an individual sitting on the seat are therefore changed between the basic position I and the resting position II in order to obtain, as a function of the position of the seat element 2, a position which is oriented to an equilibrium. This makes it largely superfluous, during the leaning-back action, to store potential energy of the upper body in a force store, such as, for example, a spring, since the potential energy of the upper body of an individual is supplied by the kinematics of the seat element to the lower body of the individual as potential energy. For this reason, with the seat according to the invention similar sitting comfort is basically possible even for individuals of very different body weight without a spring having to be adjusted to the weight of the particular individual.

Figure 3:
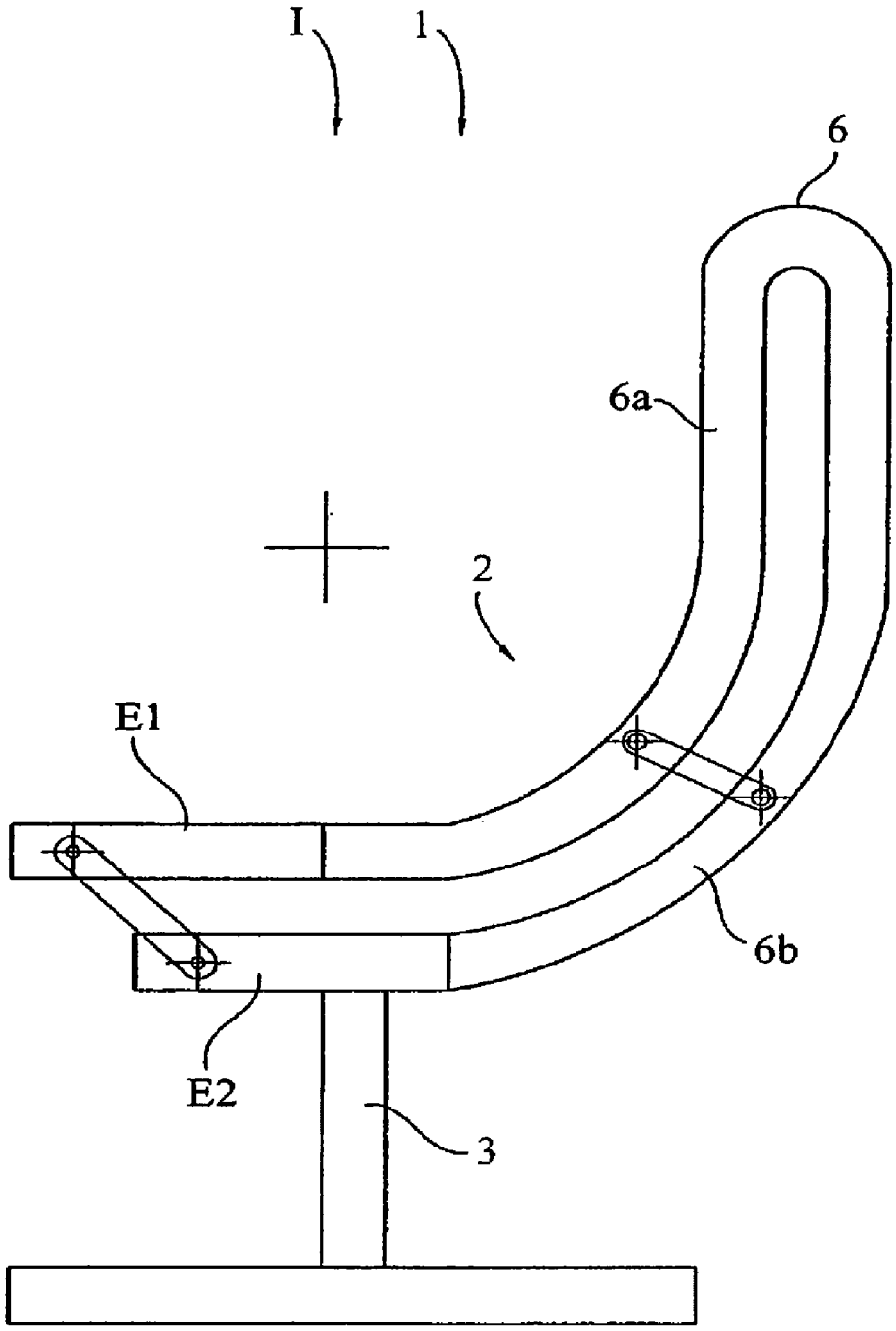
FIG. 3 shows: a second variant embodiment of a seat according to the invention in a basic position.
Figure 4:
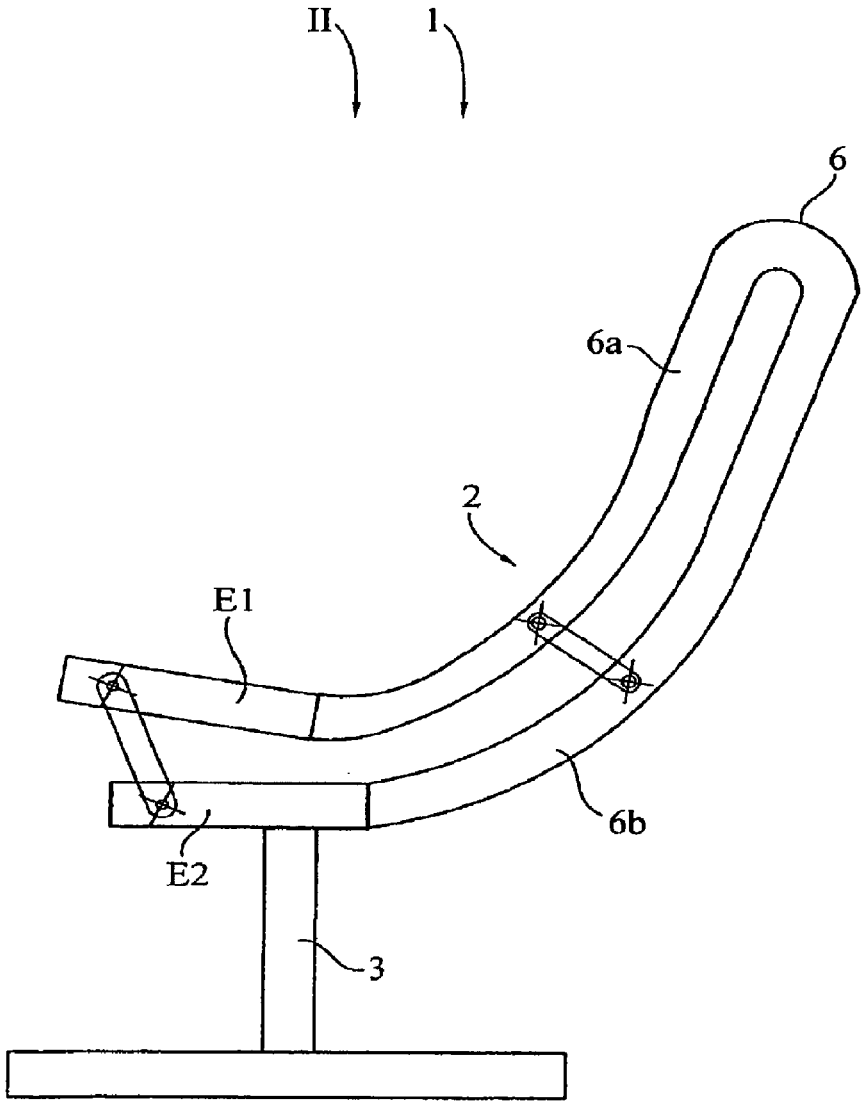
FIG. 4 shows: the seat shown in FIG. 3 in a resting position II.

FIGS. 3 and 4 show a second variant embodiment of a seat 1 according to the invention in a basic position I and in a basic position II. Like the first variant embodiment, the second variant embodiment of the seat 1 has two supporting arms 6, the second supporting arm being concealed in the side view. In contrast to the first variant embodiment, in the second variant embodiment a right supporting arm 6 and a left supporting arm are of rigid design at free ends E1, E2 of their supports 6*a*, 6*b*. The free end E2 of the lower support 6*b* therefore behaves, in principle, as an underframe 3, and an elastic region of the lower support 6*b* is of shortened design in comparison to the first variant embodiment (see FIGS. 1*a* to 2).

Figure 5:
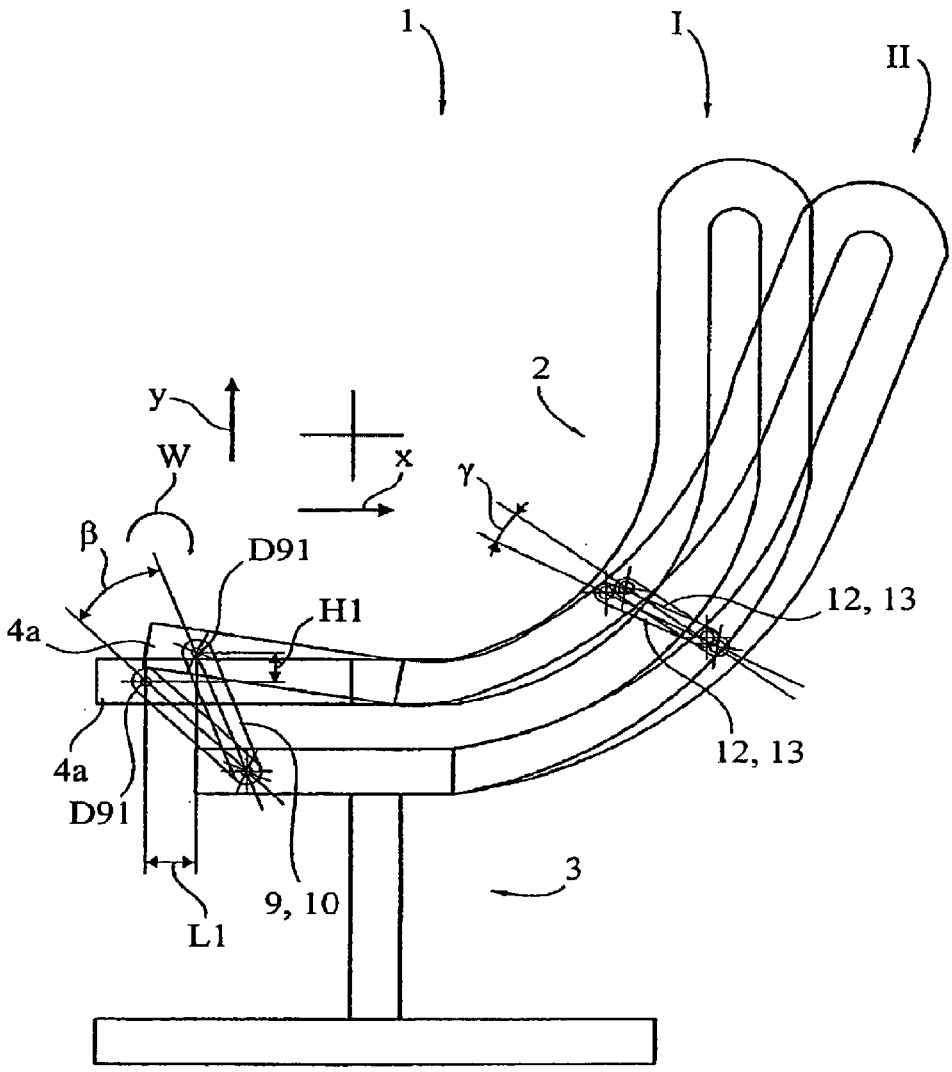
FIG. 5 shows: a superimposed illustration of the illustrations shown in FIGS. 3 and 4.

In FIG. 5, the illustrations of FIGS. 3 and 4 are shown superimposed. This illustration reveals how a guide element 9, which is designed as a lever 10, rotates by an angle $\beta$=25° in an arrow direction w between the basic position I and the resting position II. By this means, a front seat part 4*a* is raised at its pivotal point D91 by a height H1 in an arrow direction y and is pushed rearwards by a distance L1 in an arrow direction x. A connecting link 12, which is designed as a lever 13, also rotates in the direction of rotation w, changes its angle by $\gamma$=10° and drops slightly.

Figure 6:
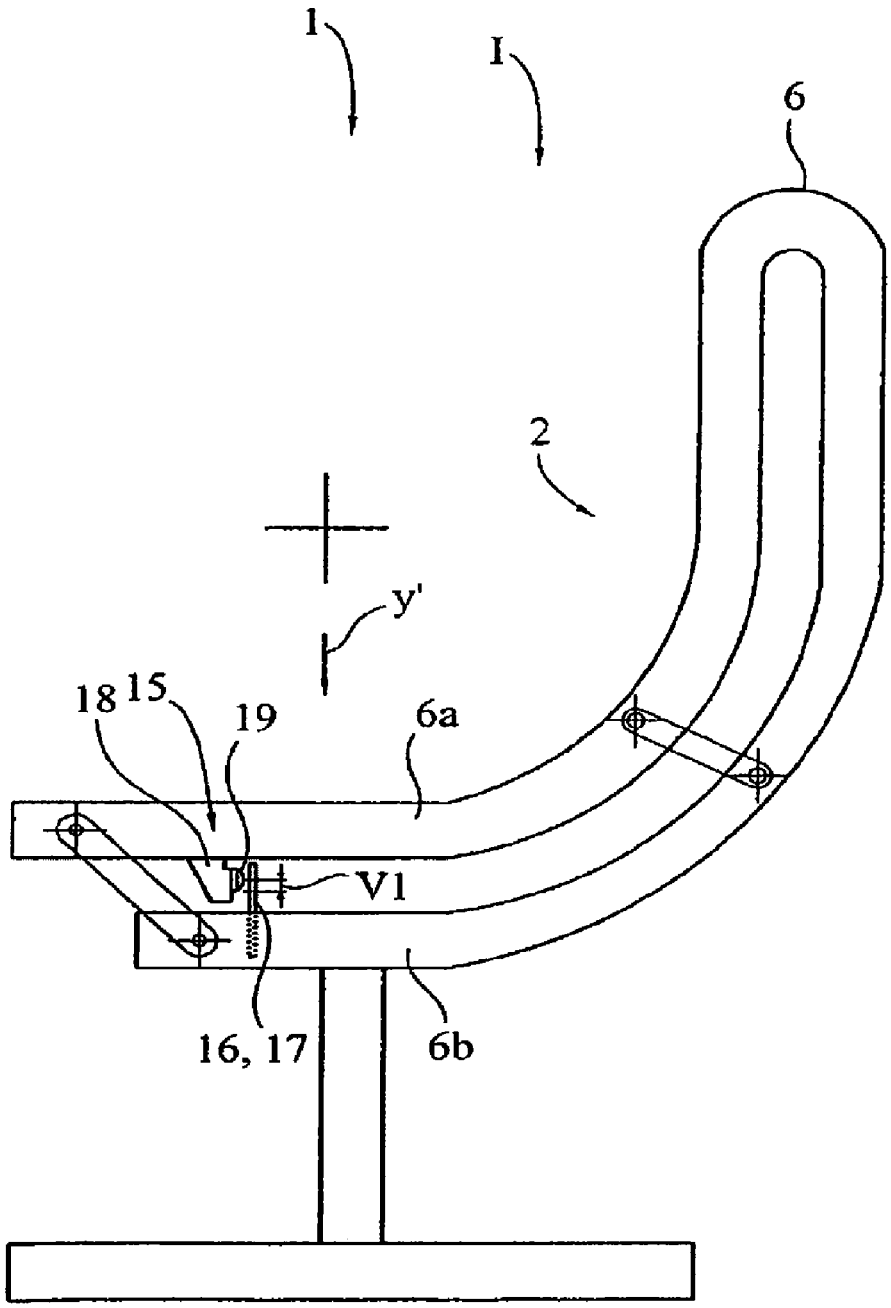
FIG. 6 shows: a third variant embodiment of a seat according to the invention in a basic position.

FIG. 6 illustrates, as an analogy with FIG. 1*a*, a third variant embodiment of a seat 1 according to the invention with a seat element 2 in a basic position I. The description for FIGS. 1*a* to 2 basically applies to this seat 1. In addition, the seat 1 of FIG. 6 has an energy store or force store 15 which comprises a leaf spring 17 as the spring element 16. The leaf spring 17 is fastened in a lower support 6*b* of a first supporting arm 6 and stands in the way of a stop 18 belonging to the energy store 15. The stop 18 is fastened to an upper support 6*a* of the supporting arm 6. As soon as the seat element 2 moves from the illustrated basic position I into a resting position (not illustrated here) according to FIG. 2, the stop 18 presses against the leaf spring 17. By this means, the energy store 15 damps the movement of the support 6*a* and assists a return movement into the basic position I. By displacement of a contact body 19 of the stop 18 in an arrow direction y' by, for example, a displacement distance V1, a resetting force produced by the energy store 15 can be adjusted. The embodiment of a corresponding energy store is provided on a left supporting arm of the seat 1, which supporting arm is not visible in the illustration of FIG. 6.

Figure 7:
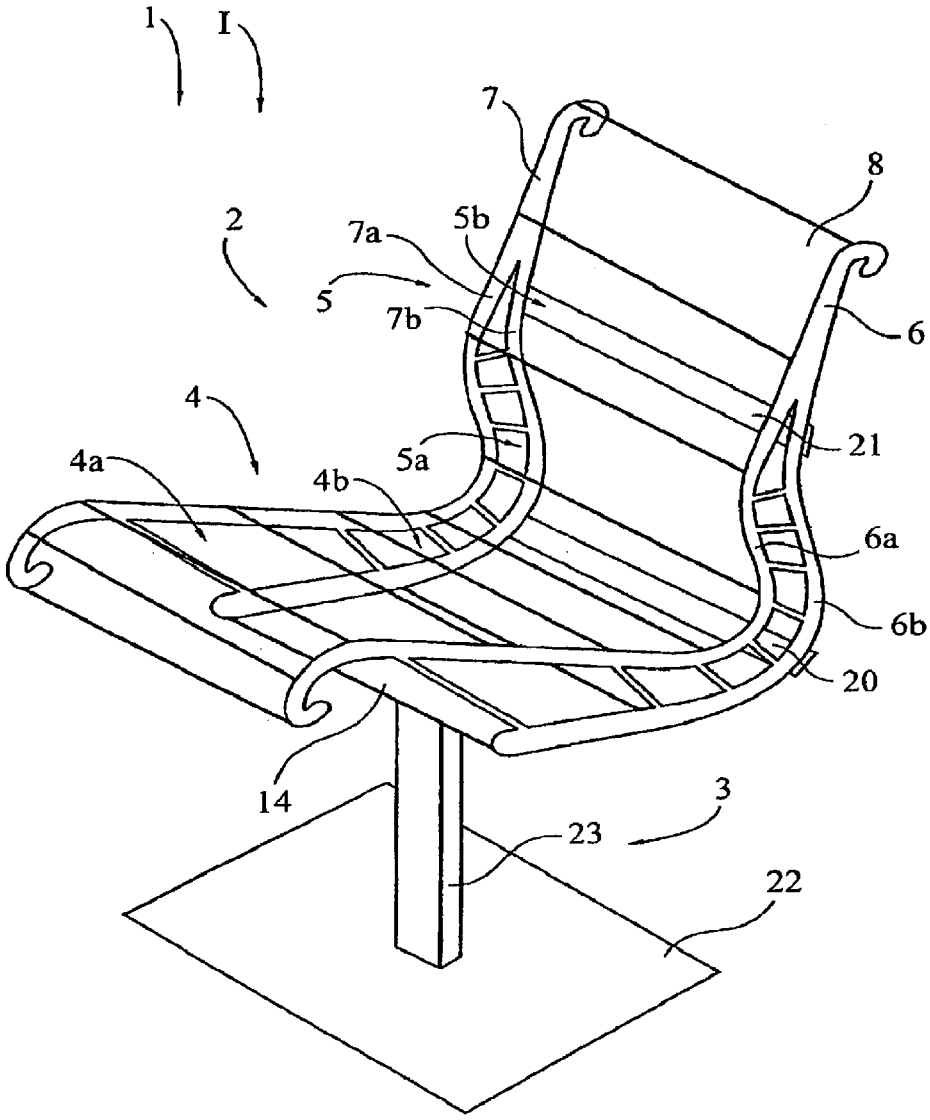
FIG. 7 shows: a simplified perspective illustration of a fourth variant embodiment of a seat according to the invention.

FIG. 7 illustrates a fourth variant embodiment of a seat 1 in a simplified perspective view. The seat 1 includes a seat element 2 and an underframe 3. The seat element 2 has a seat part 4 which is divided into a front seat part 4*a* and a rear seat part 4*b*. Furthermore, the seat element 2 has a backrest part 5 which is divided into a lower backrest part 5*a* and an upper backrest part 5*b*. The seat element 2 comprises two supporting arms 6, 7 which are each formed by an upper support 6*a* or 7*a* and a lower support 6*b*, 7*b*. A fabric 8, or other body support structure, is stretched between the two supporting arms 6, 7 or the upper supports 6*a*, 7*a* thereof. The seat element 2 is fastened on a transverse support 14 of the underframe 3 by the lower supports 6*b*, 7*b*. The supporting elements 6, 7 or the lower supports 6*b*, 7*b* thereof are furthermore connected to each other via two transverse struts 20, 21 in order to couple the supporting elements 6 and 7 to each other so that the latter can mutually support each other if the seat 1 is loaded on one side. In addition to the transverse support 14, the underframe 3 also comprises a footplate 22 which is connected to the transverse support 14 via a strut 23. The seat 1 is in a basic position I.

Figure 8:
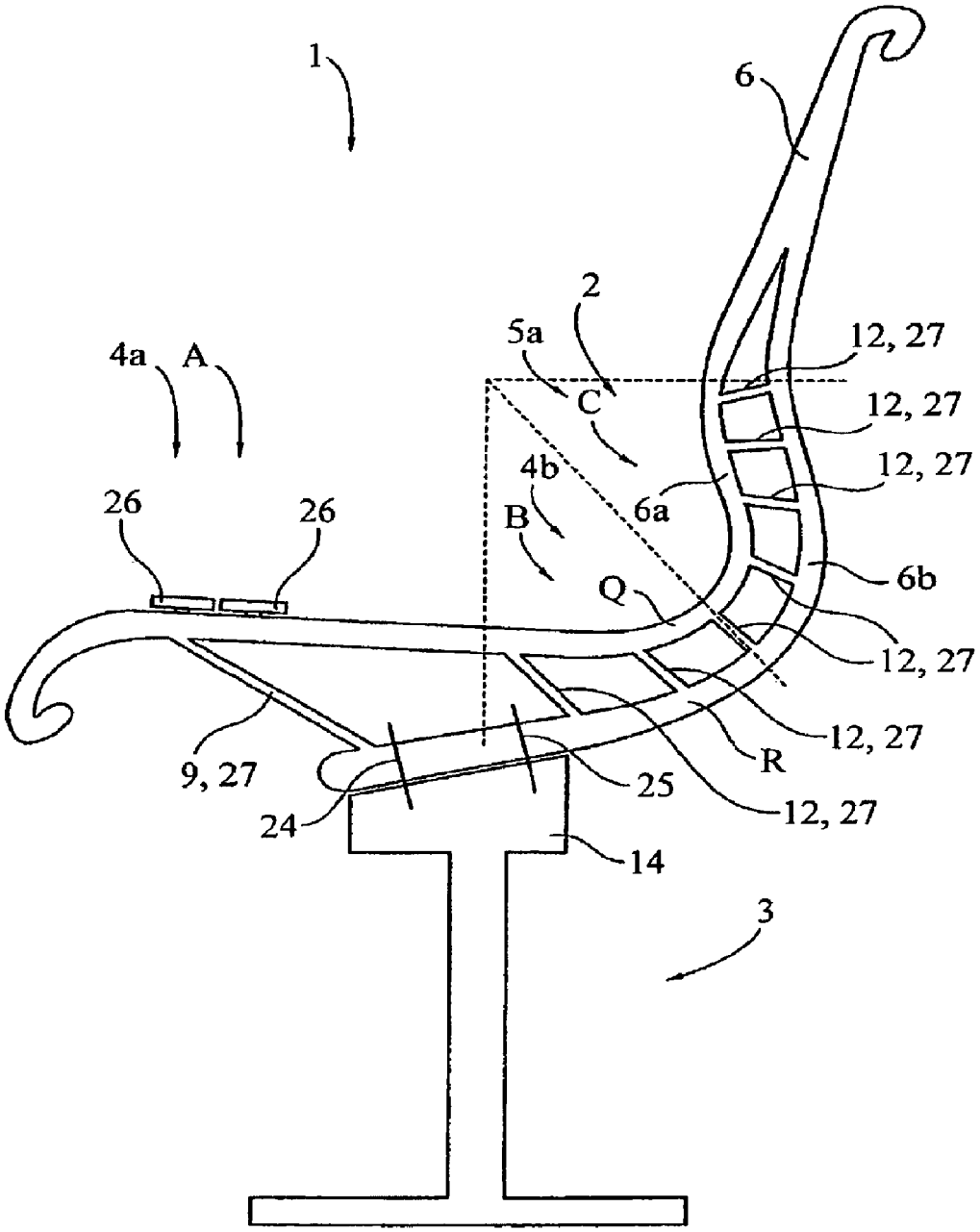
FIG. 8 shows: a simplified side view of a fifth variant embodiment of a seat according to the invention.

FIG. 8 illustrates a fifth variant embodiment of a seat 1 in a simplified side view. A seat element 2 is screwed here by lower supports 6*b* of two supporting arms 6 (only one supporting arm is visible in the side view) to a transverse support 14 of an underframe 3 at two fastening points 24, 25. The lower support 6*b* and an upper support 6*a* of the supporting arm 6 are connected in a region A of a front seat part 4*a* via a guide element 9. The guide element 9 is integrally formed as a single piece with the upper support 6*a* and the lower support 6*b* of the supporting arm 6. In a region B of a rear seat part 4*b* and a region C of a lower backrest part 5*a*, the upper support 6*a* and the lower support 6*b* are connected to each other by seven connecting links 12 which are likewise integrally formed as a single piece with said supports. The upper support 6*a* is formed in the regions B and C by a central section Q, and the lower support 6*b* is formed in the regions B and C by a central section R. Instead of a fabric, in this embodiment the upper supports 6*a* of the two supporting arms 6 bear a multiplicity of transverse slats 26 which connect the two supports 6*a*. It should be understood that a fabric, or other body support member, is also suitably employed. Only two transverse slats are illustrated by way of example. The guide element 9 and the connecting links 12 are designed as spokes 27 and the latter, like the upper and the lower support 6*a*, 6*b*, are made from plastic. The seat 1 is in a basic position I.

Figure 9:
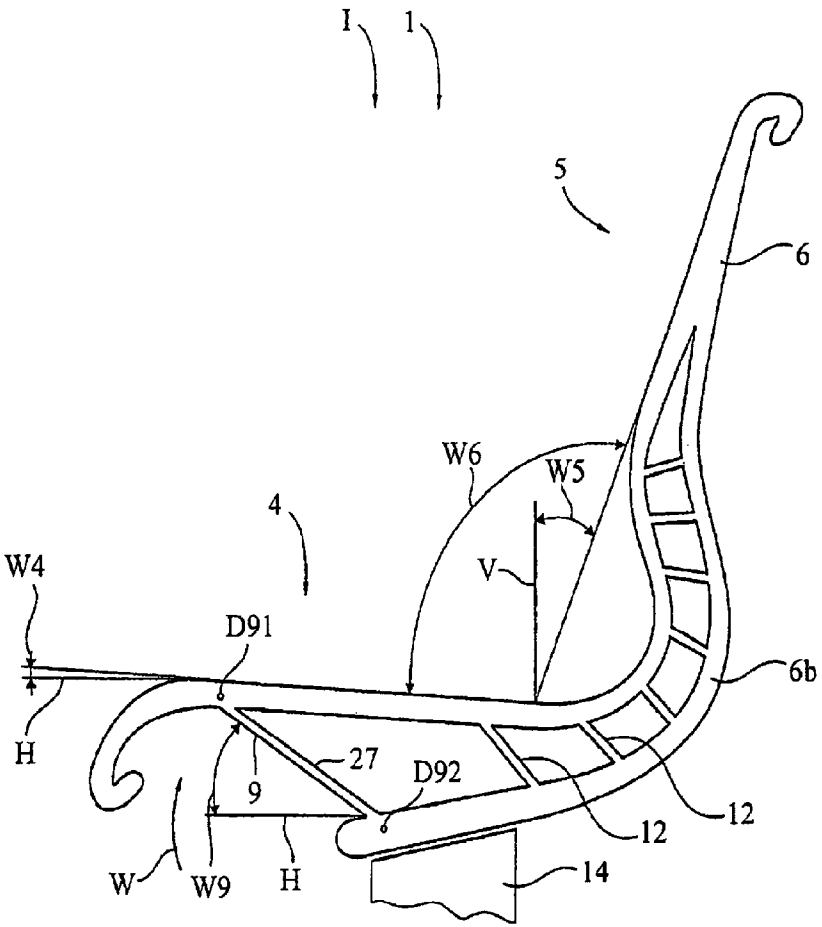
FIG. 9 shows: an enlarged illustration of the supporting element of the seat, shown in FIG. 8, in a basic position.
Figure 10:
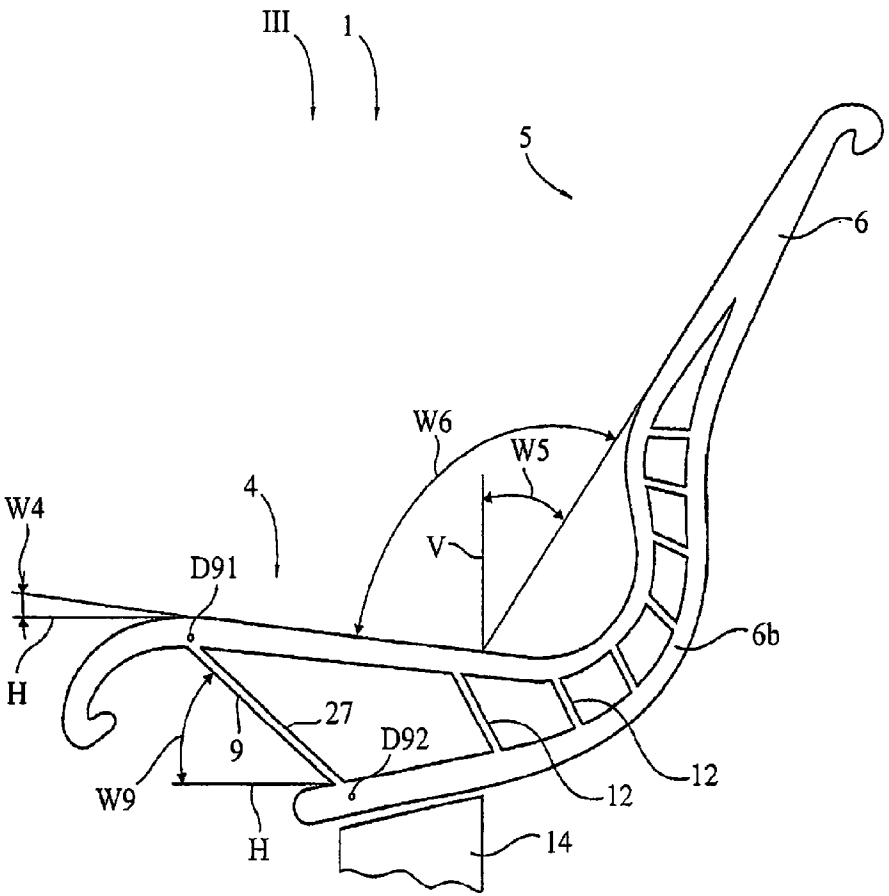
FIG. 10 shows: an enlarged illustration of the supporting element of the seat, shown in FIG. 8, in an intermediate position.
Figure 11:
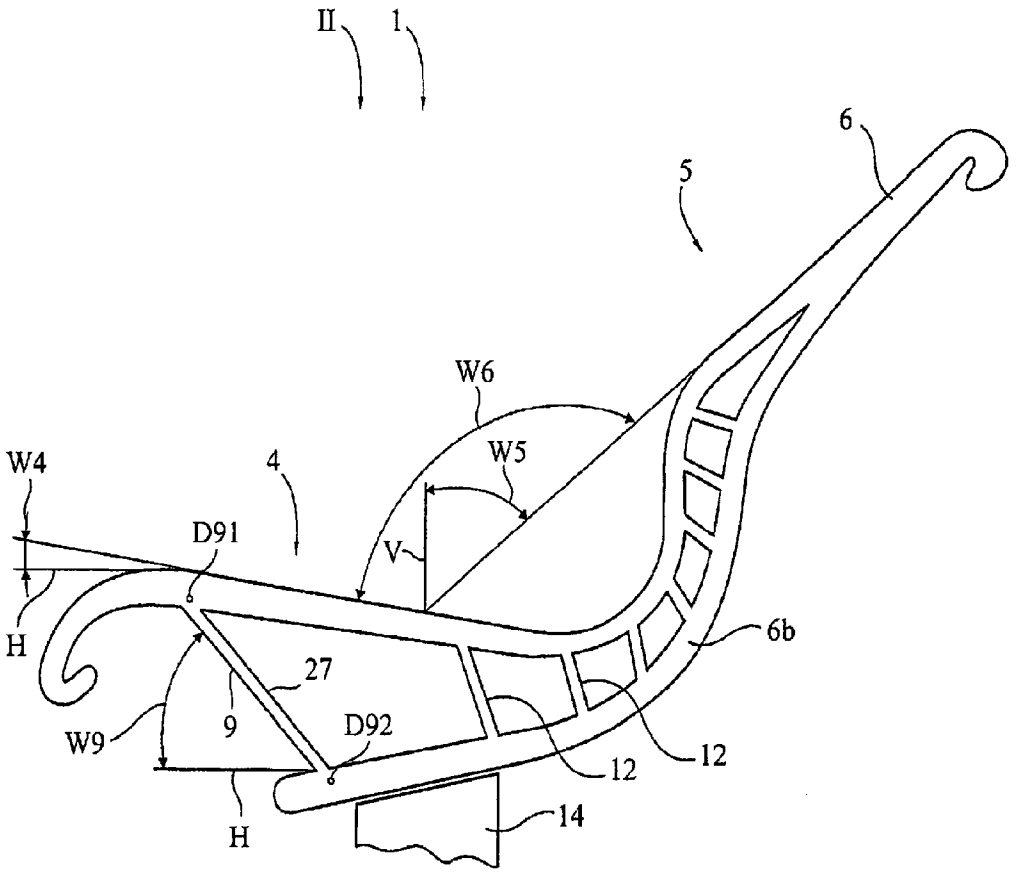
FIG. 11 shows: an enlarged illustration of the supporting element of the seat, shown in FIG. 8, in a resting position.

FIGS. 9, 10 and 11 exclusively illustrate the supporting arm 6 and part of the transverse support 14 of the seat 1 shown in FIG. 8. FIG. 9 shows the supporting arm 6 in the basic position I, FIG. 11 shows the supporting arm 6 in a resting position II, and FIG. 10 shows the supporting arm 6 in an intermediate position III located between the basic position I and the resting position II. In the three positions I-III illustrated, the following values then arise for an opening angle W6 between seat part 4 and backrest part 5, for an angle W4 between the seat part 4 and a horizontal H, for an angle W5 between the backrest part 5 and a vertical V, and for an angle W9 taken up by the guide element 9 with respect to a further horizontal H:

| | W6 | W4 | W5 | W9 |
|---|---|---|---|---|
| I - Basic position | 105 | 2 | 18 | 32 |
| III - Intermediate position | 118 | 6 | 33 | 40 |
| II - Resting position | 130 | 8 | 48 | 46 |

Figure 12:
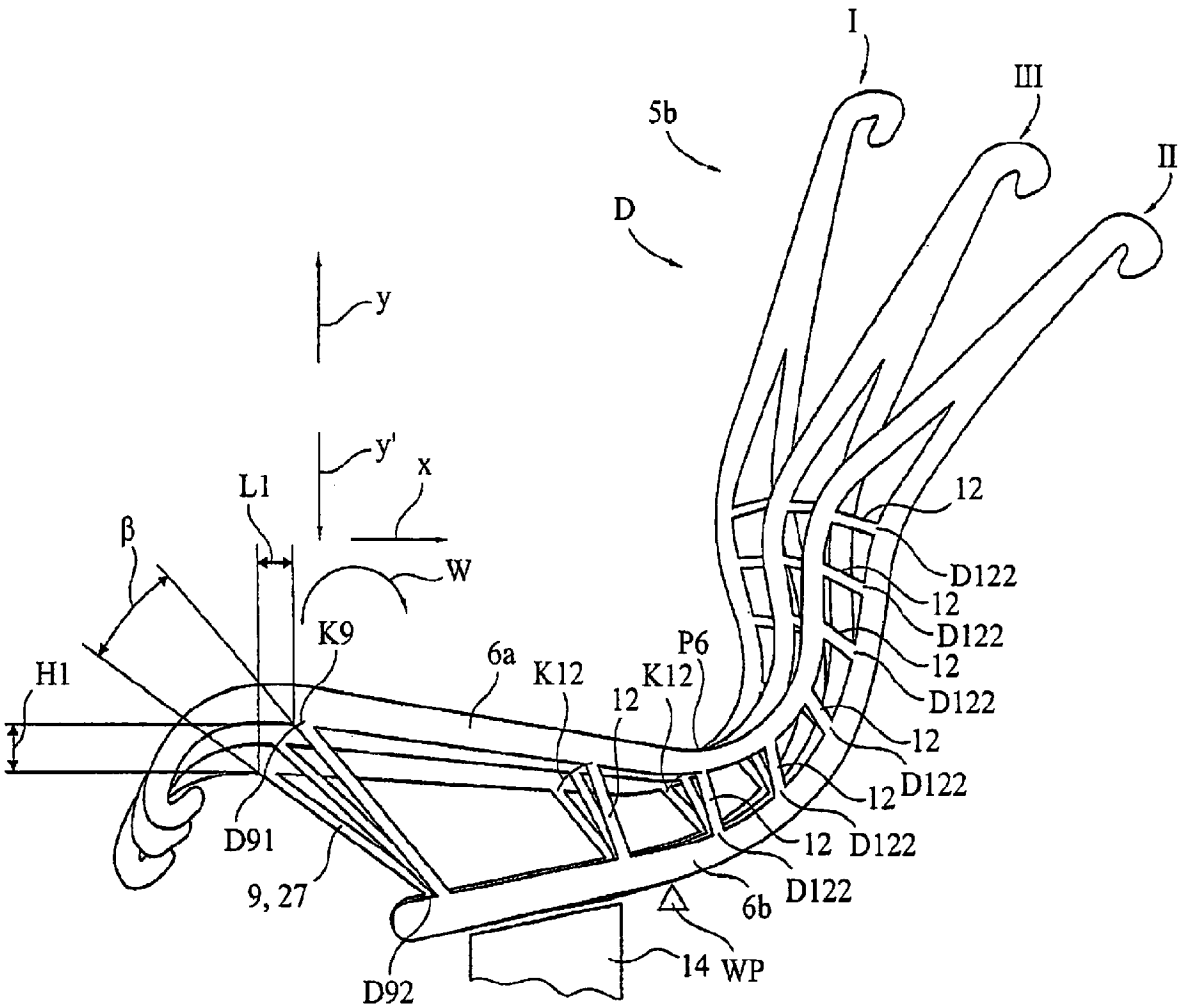
FIG. 12 shows: a superimposed illustration of the positions, shown in FIGS. 9 to 11, of the supporting element.

The guide element 9 rotates about a pivotal point or elastic region D92 from the basic position I in the clockwise direction in a direction of rotation w into the resting position II (compare FIGS. 9 and 11). In this connection, the guide element 9, which is designed as a spoke 27, is situated in all possible positions between 9 o'clock and 12 o'clock between the basic position I and the resting position II. The angle W9 taken up in this case by the guide element 9 changes from 32° to 46° and therefore increases by β=14° (also see FIG. 12). During the rotation, the guide element 9 raises the upper support 6*a* or the region A of the front seat part 4*a* at a pivotal point or elastic region D91. In the elastic region D91, the guide element 9 merges into the upper support 6*a*. Upon rotation of the elastic region 91 on an arcuate path K9, the region A is raised upwards by a distance H1 in an arrow direction y and is displaced to the right by a distance L1 in an arrow direction x (see FIG. 12). This movement can be described by a type of rocking movement of the supporting arm 6 at a rocking point or rocking region WP. The rocking region here is arranged approximately wherever the lower support 6*b* of the supporting arm 6 leaves the transverse support 14 as a cantilever or wherever elastic deformation of the lower support 6*b* is possible. The supporting arm 6 is bent up in particular as a result of loading of a region D of an upper backrest part 5*b*. The upper support 6*a* here, as it is bent up from the lower support 6*b*, is pulled rearwards and downwards in the arrow direction x and an arrow direction y'. During this bending-up movement, the upper support 6*a* is guided by the guide element 9 and by the connecting links 12 on the lower support 6*b* on a multiplicity of paths K9 and K12. As an individual leans back, this pulling-back action of the upper support 6*a* causes the upper support 6*a* to be raised on the left from a point P6 and causes the upper support 6*a* to be lowered on the right from the point P6. Therefore, during the movement into the position II, the seat part 4 is raised and, at the same time, the backrest part 5 is lowered. During the transition from the basic position I into the resting position II, the connecting links 12 all rotate to the right in the arrow direction w about pivotal points or elastic regions D112 on the lower support 6*b*. In the process, the elastic regions D112 also change their position by the lower support 6*b* being bent up.

Figure 38:
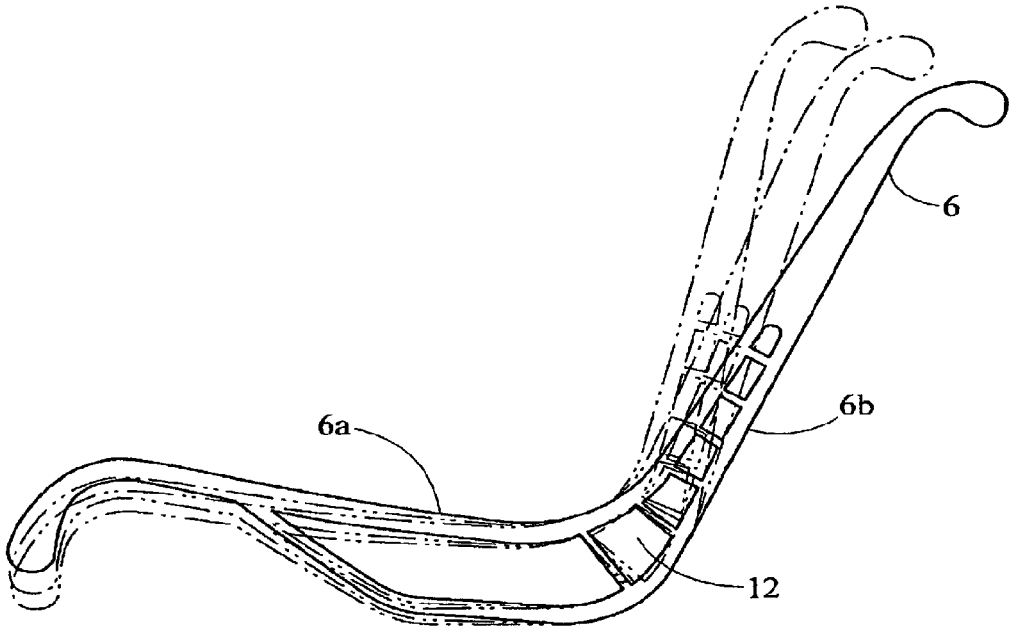
FIG. 38 shows: a side, schematic view illustrating the kinematic movement of an alternative body support structure.
Figure 39:
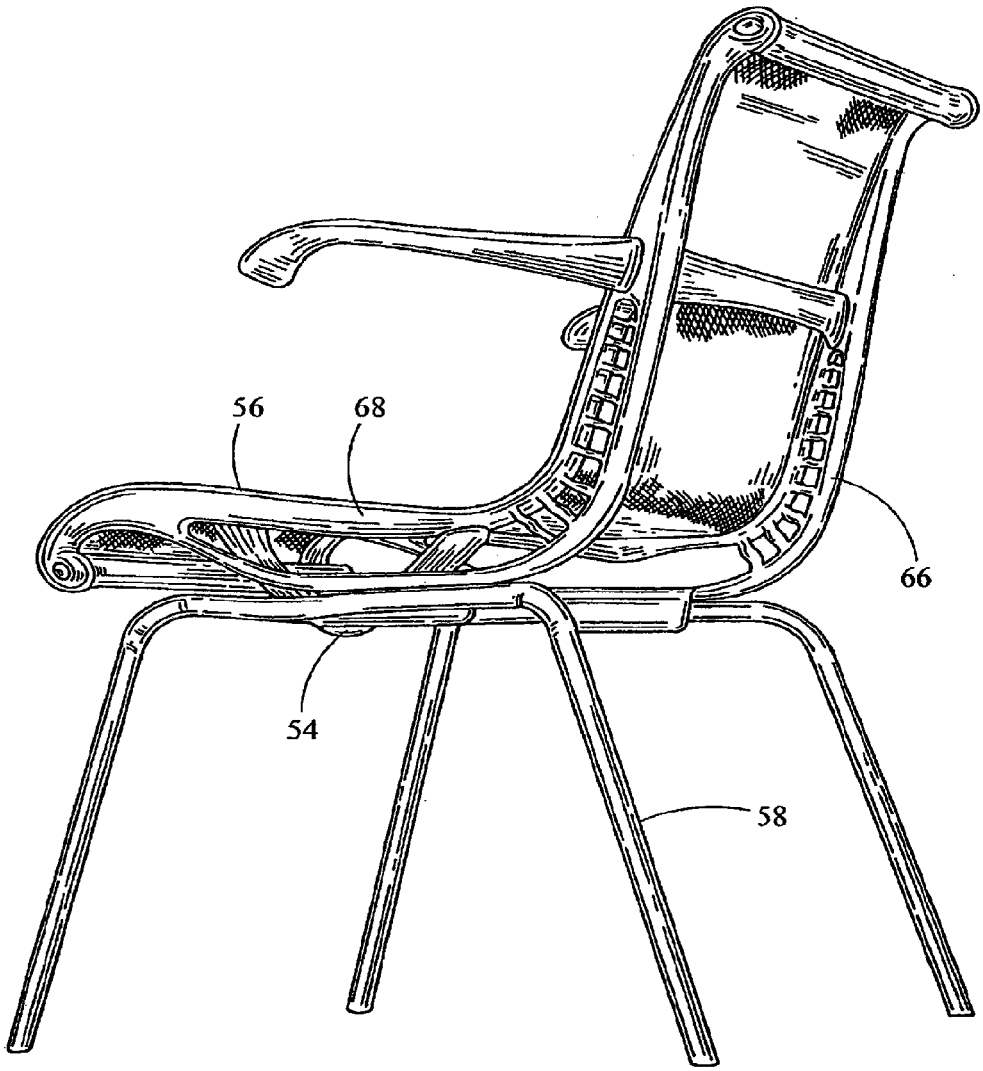
FIG. 39 shows: a rear, perspective view of the body support structure shown in FIG. 38.
Figure 40:
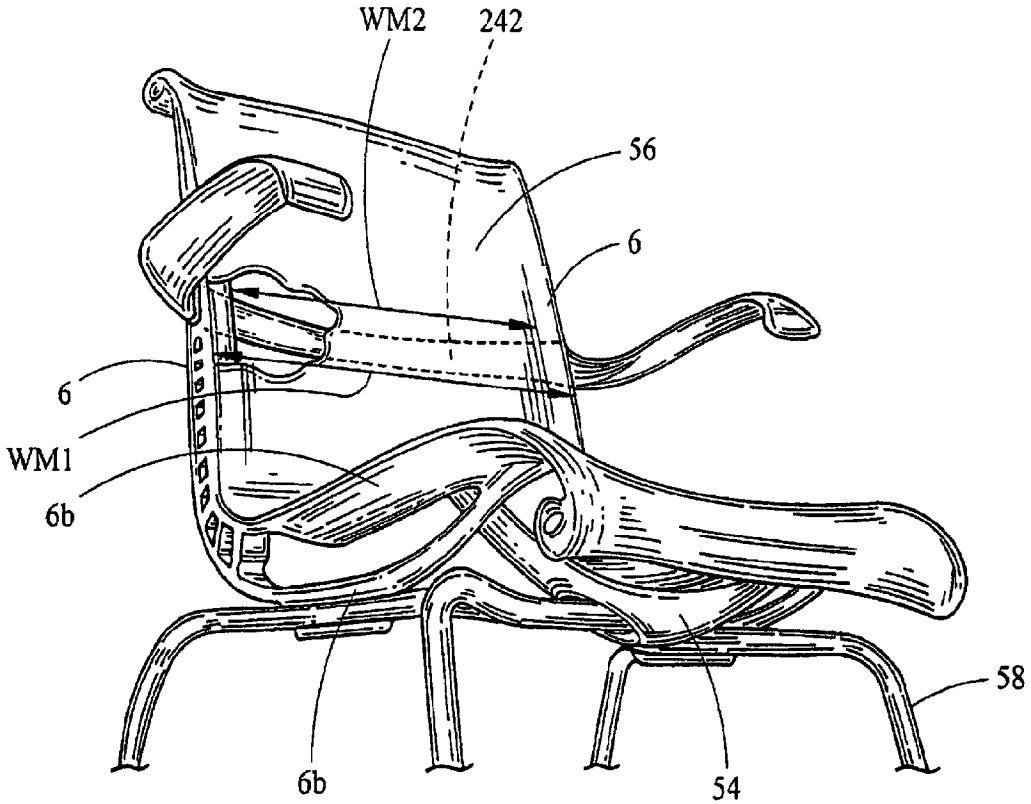
FIG. 40 shows: a lower, perspective view of the body support structure shown in FIG. 39.

Referring to FIGS. 38-40, another embodiment of the seating arrangement is provided similar to that shown in FIGS. 8-12. In this embodiment, the lower support 6*b* extends forwardly and acts as a leaf spring, as it is joined to the front support at a forward location. The movement of the beams 6*a*, 6*b* is performed by bending the members, without any true pivot points. A forward cross member 54 maintains tension in the membrane 56 between the beams 6. The lower supports 6*b* are connected to a fixed leg assembly 58 which further supports the cross member 54.

Figure 41:
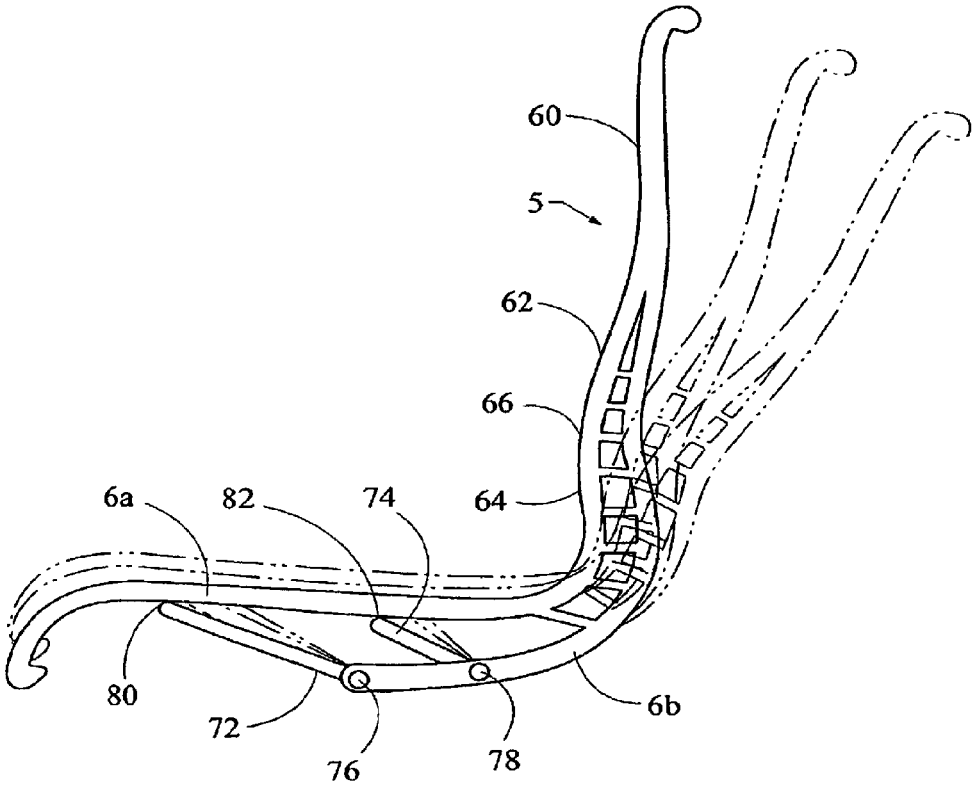
FIG. 41 shows: a side, schematic view illustrating the kinematic movement of an alternative body support structure.
Figure 42:
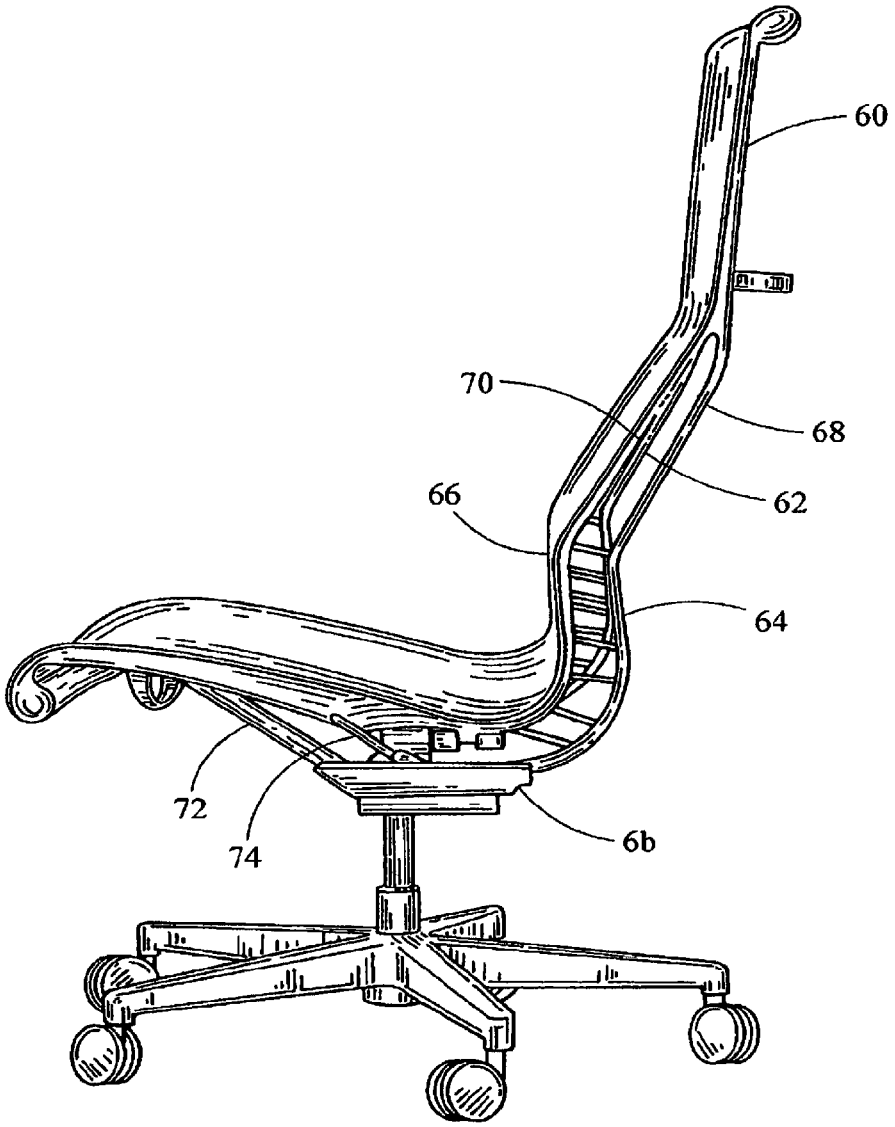
FIG. 42 shows: a side view of a body support structure shown in FIG. 41.
Figure 43:
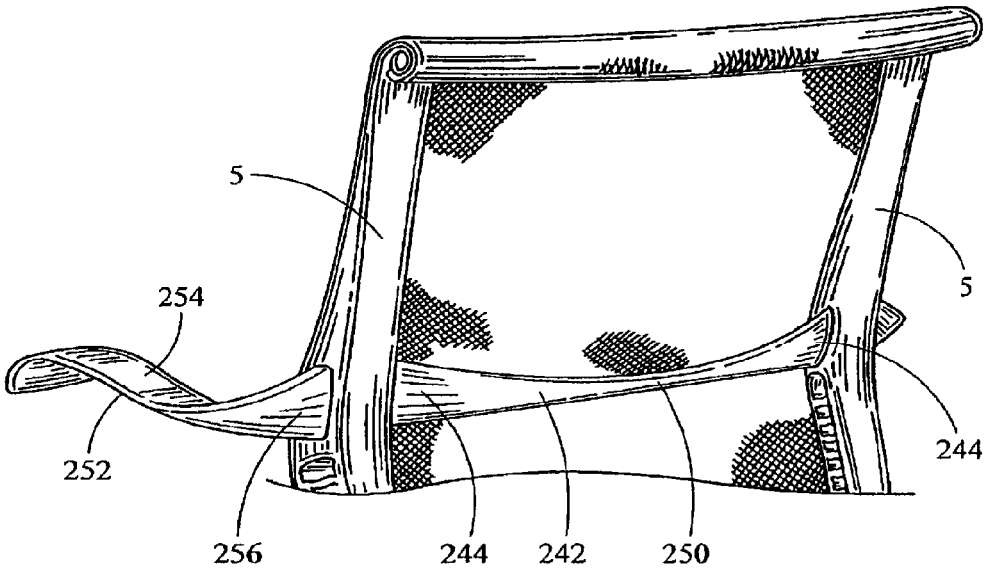
FIG. 43 shows: a rear, perspective view of an upper region of a back and armrests.
Figure 45:
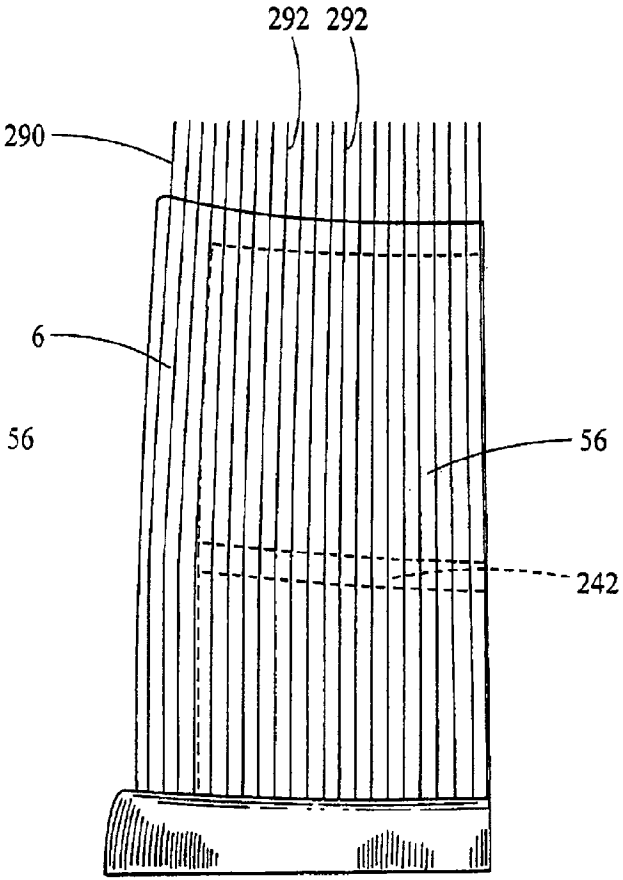
FIG. 45 shows: a schematic view of a membrane weave pattern after final assembly.
Figure 44:
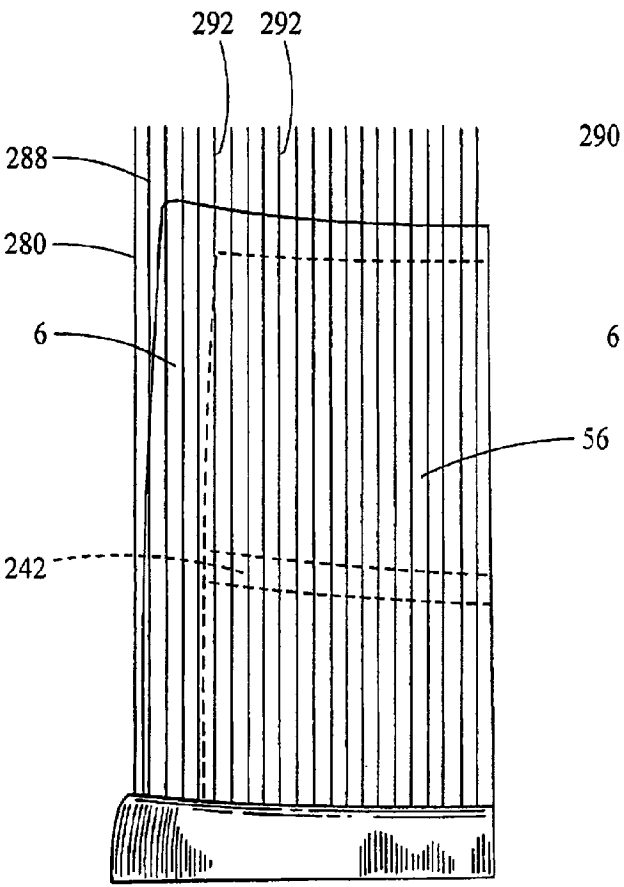
FIG. 44 shows: a schematic view of a membrane weave pattern before final assembly.

Referring to FIGS. 41 and 42, another embodiment of the seating arrangement includes a back 5 having an upper most portion 60 formed from a single beam component free of any gap or spacing, a middle portion 62 angled relative to the upper portion and a lower portion 64 angled relative to the middle portion, with the bowed junction 66 between the lower and middle portion formed at substantially the lumbar region of the backrest. A pair of forward link members 72, 74 form a four-bar linkage. The middle portion is formed by spaced apart beams 68, 70 forming a gap therebetween that is free of any linking members as shown in FIG. 42. The link members 72, 74 each extend forwardly from a lower pivot axis 76, 78 on the lower support beam 6*b* to an upper pivot axis 80, 82 on the upper support beam 6*a*. Due to this configuration, a sufficient counterbalance weight is provided, for example when a user places their legs on an ottoman or other raised foot support. At the same time, as shown in FIG. 41, almost the entirety of the seat is raised in parallel, as opposed to just a front lip portion thereof.

Figure 13:
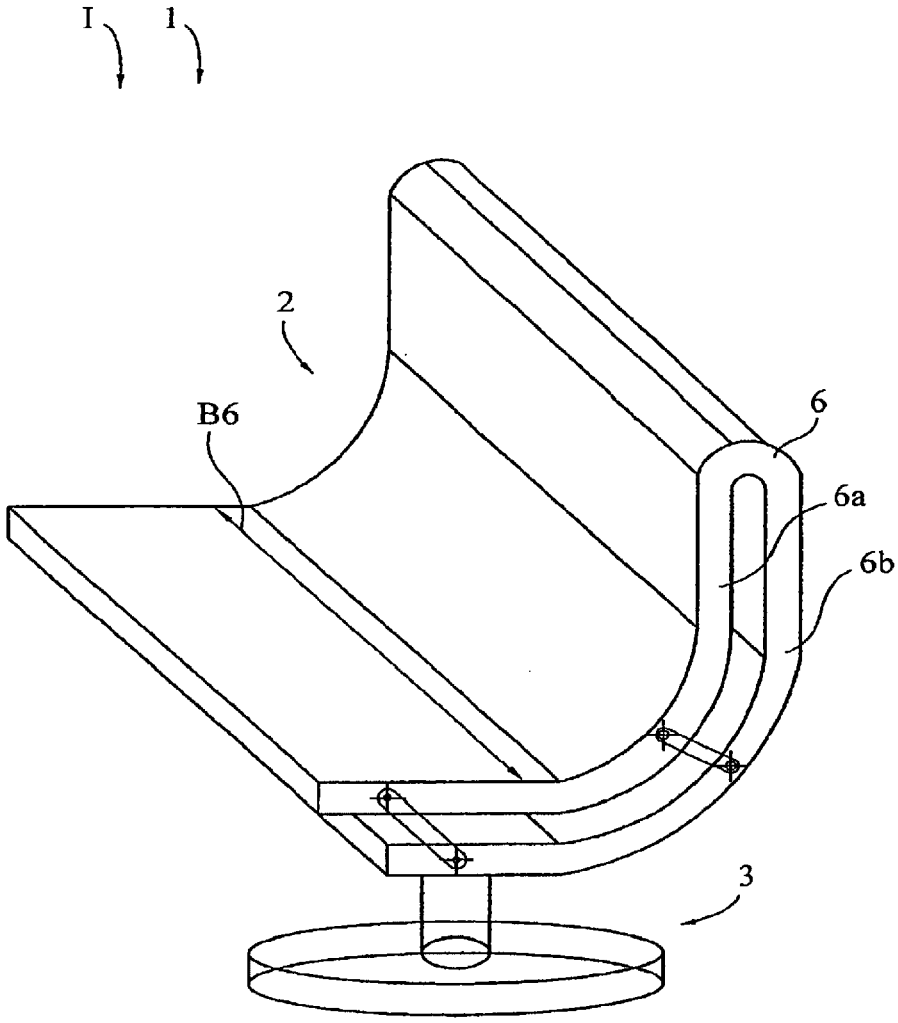
FIG. 13 shows: a simplified perspective view of a sixth variant embodiment of a seat according to the invention.

FIG. 13 illustrates another variant embodiment of a seat 1 according to the invention in a simplified perspective view. A seat element 2 is essentially formed solely by a supporting arm 6 with supports 6*a* and 6*b*. For this purpose, the supporting arm 6 has a width B6 required for the seat element 2. The lower support 6*b* is fastened on an underframe 3 of the seat 1. The seat 1 or the seat element 2 is in a basic position I.

Figure 14:
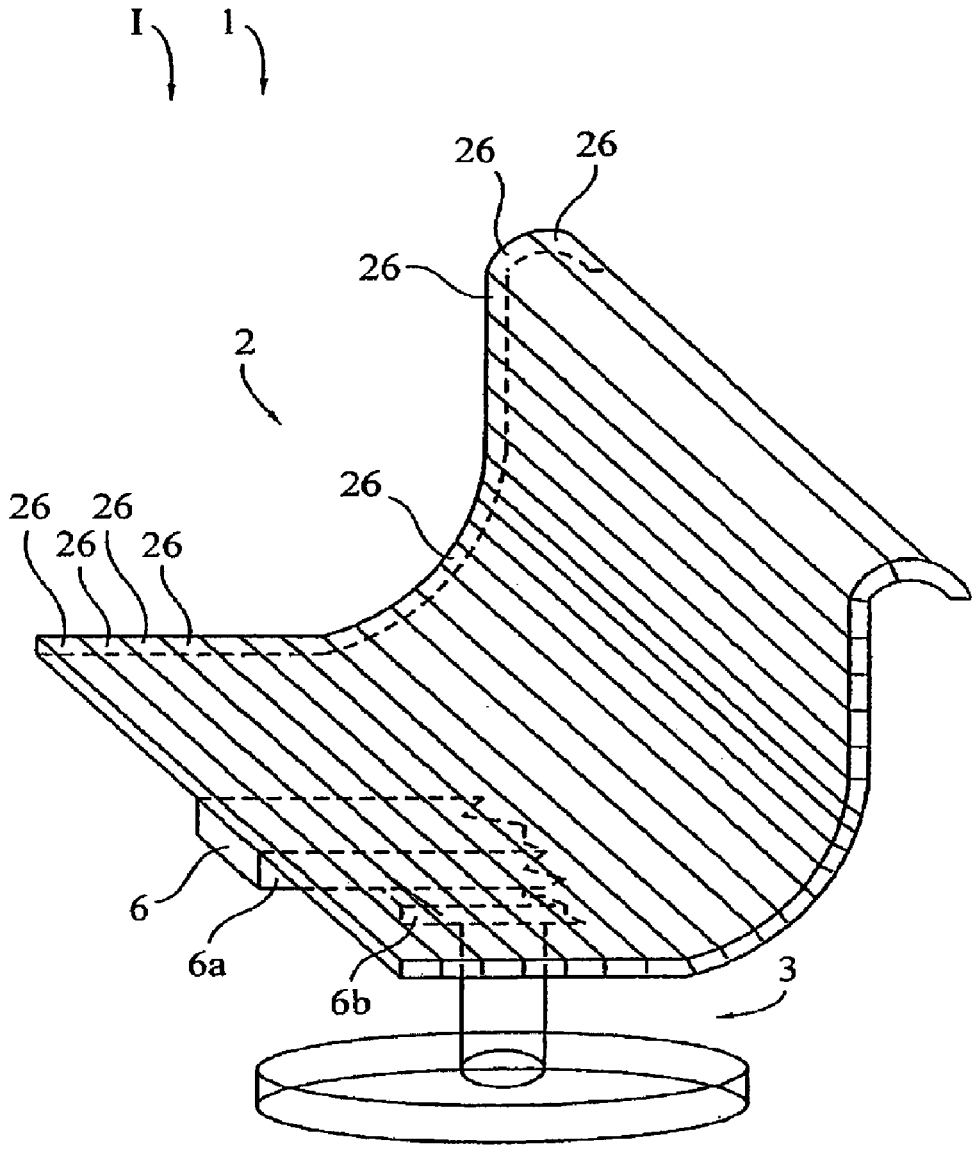
FIG. 14 shows: a simplified perspective view of a seventh variant embodiment of a seat according to the invention.

FIG. 14 illustrates another variant embodiment of a seat 1 according to the invention in a simplified perspective view. A seat element 2 is essentially formed by a supporting arm 6 (only partially illustrated) with supports 6*a* and 6*b* and transverse slats 26. The transverse slats 26 are arranged on the upper support 6*a* of the supporting arm 6 and are movable in relation to one another in order not to inhibit or obstruct the deformation of the upper support 6*a*, which deformation arises as a basic position I illustrated is left. The lower support 6*b* is fastened on an underframe 3 of the seat 1.

Figure 15:
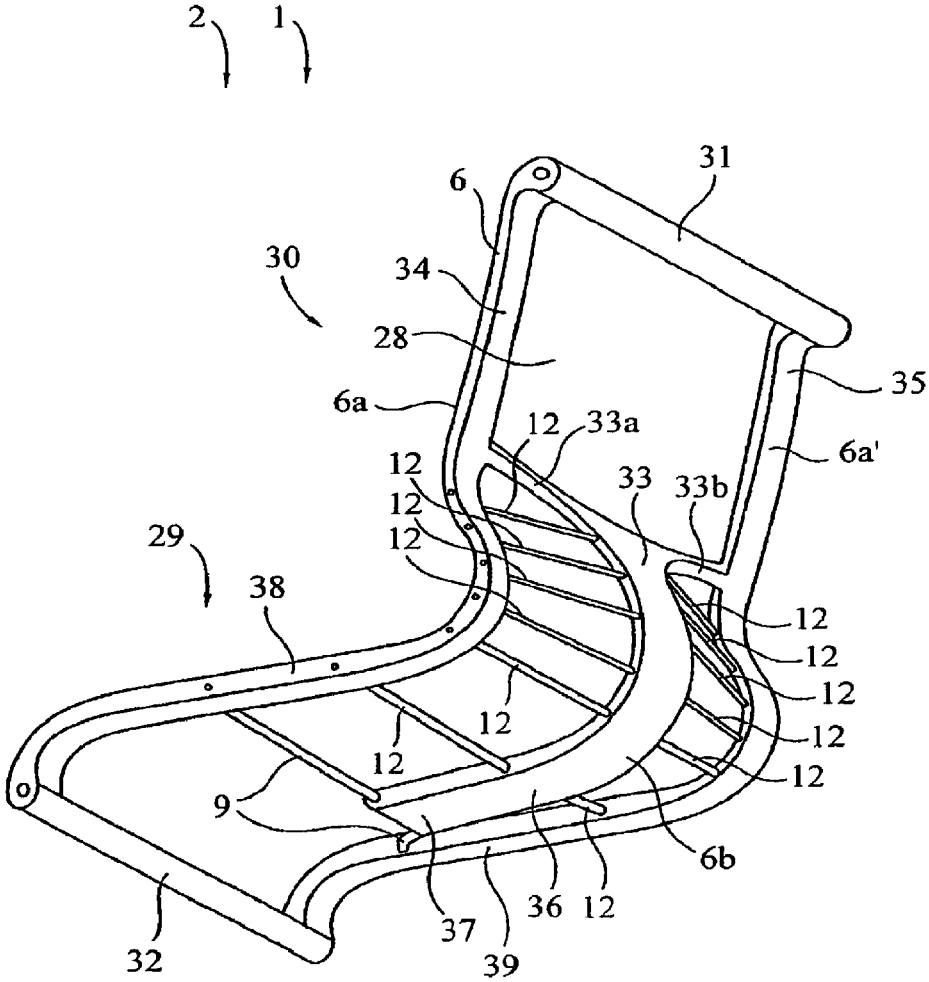
FIG. 15 shows: a perspective view of a seat element of an eighth variant embodiment of a seat according to the invention.

FIG. 15 illustrates a perspective view of a seat element 2 of another variant embodiment of a seat 1. The seat element 2 has a supporting arm 6 which bears a covering 28 which forms a seat surface 29 and a backrest 30. The supporting arm 6 comprises a left, upper support 6*a*, a right, upper support 6*a*' and a lower support 6*b* located between them. The lower support 6*b* is connected to the left, upper support 6*a* by mechanical connecting links 12 and to the right, upper support 6*a*' by further mechanical connecting links 12. The upper supports 6*a* and 6*a*' are connected to each other by two transverse supports 31 and 32. An upwardly directed, approximately vertically situated limb 33 of the lower support 6*b* is divided into two struts 33*a*, 33*b* and merges with the latter into upwardly directed limbs 34, 35 of the upper supports 6*a*, 6*a*'. By this means, the upper supports 6*a* and 6*a*' and the lower support 6*b* form the single-part supporting arm 6. An approximately horizontally running limb 36 of the lower support 6*b* is connected at a free end 37 via a guide element 9 to an approximately horizontally running limb 38 of the left, upper support 6*a* and to an approximately horizontally running limb 39 of the right, upper support 6*a*'.

Figure 16:
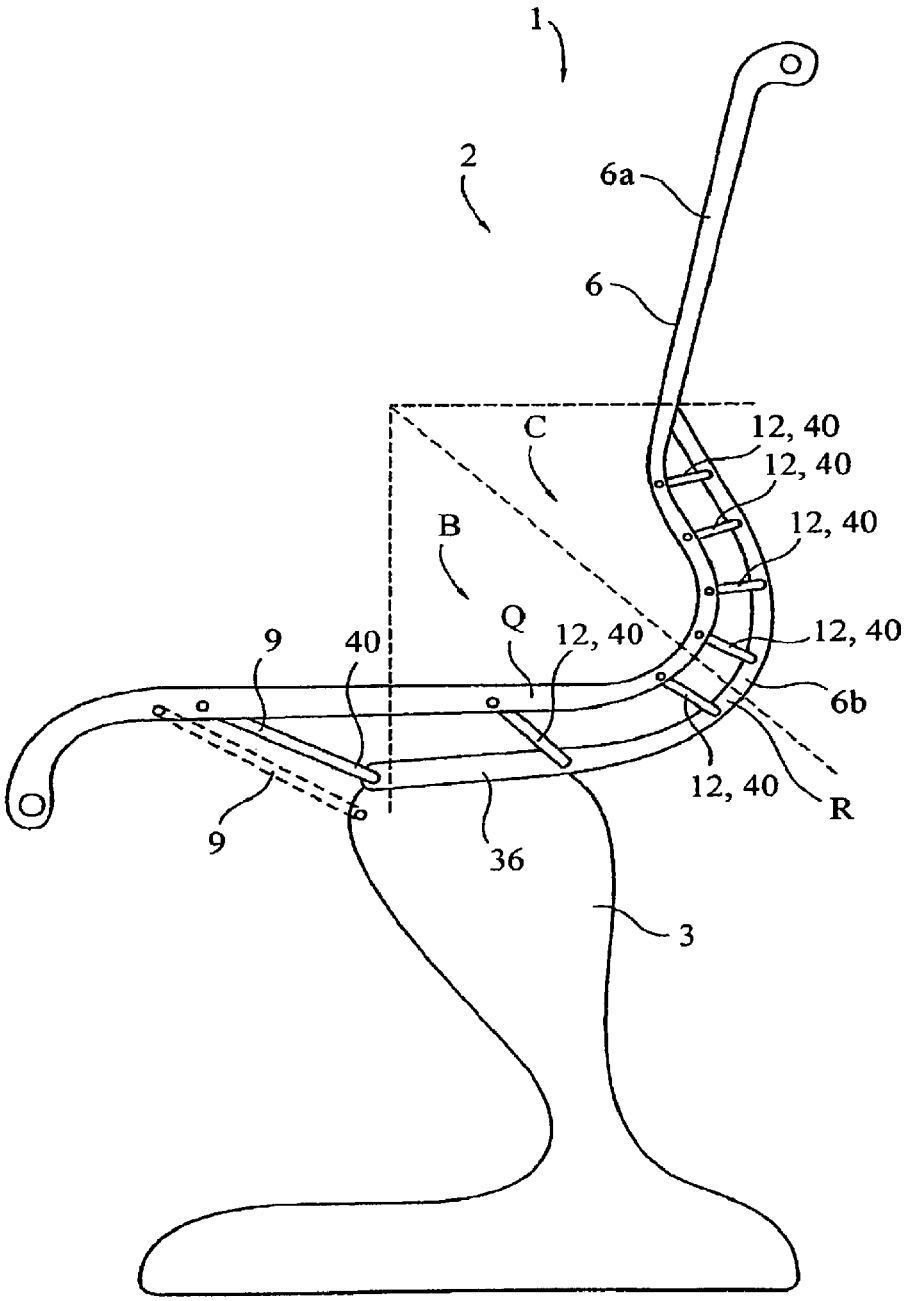
FIG. 16 shows: a side view of the eighth variant embodiment of the seat.

FIG. 16 shows a side view of the seat 1, the seat element 2 of which is already known from FIG. 15. The side view also illustrates an underframe 3 of the seat 1. The underframe 3 is connected to the limb 36 of the lower support 6*b*. Only the left, upper support 6*a* of the upper supports can be seen in the side view, the right, upper support is completely concealed. The supporting arm 6 which is of single-part design is connected between its upper support 6*a* and its lower support 6*b* via the guide element 9 and six connecting links 12. The guide element 9 and the connecting links 12 are designed as struts 40 which are mounted rotatably in the upper support 6*a* and the lower support 6*b*. A variant embodiment for the arrangement of the guide element 9, which arrangement replaces the guide element 9 (illustrated by solid lines), is illustrated by dashed lines. The guide element 9 shown by dashed lines connects the underframe 3 and the upper support 6*a*. A seat part 4 of the seat 1 is situated with a rear seat part 4*b* in a region B, and a backrest part 5 is situated with a lower backrest part 5*a* in a region C. In the regions B and C, the upper supports 6*a*, 6*a*' are formed by central sections Q and Q'. The lower support 6*b* is formed in these two regions B and C by a central section R. All six connecting links 12 visible in FIG. 16 are arranged between the central section Q of the upper support 6*a* and the central section R of the lower support 6*b*. A further six connecting links are arranged between the upper support 6*a*' and the lower support 6*b* (see FIG. 17).

Figure 17:
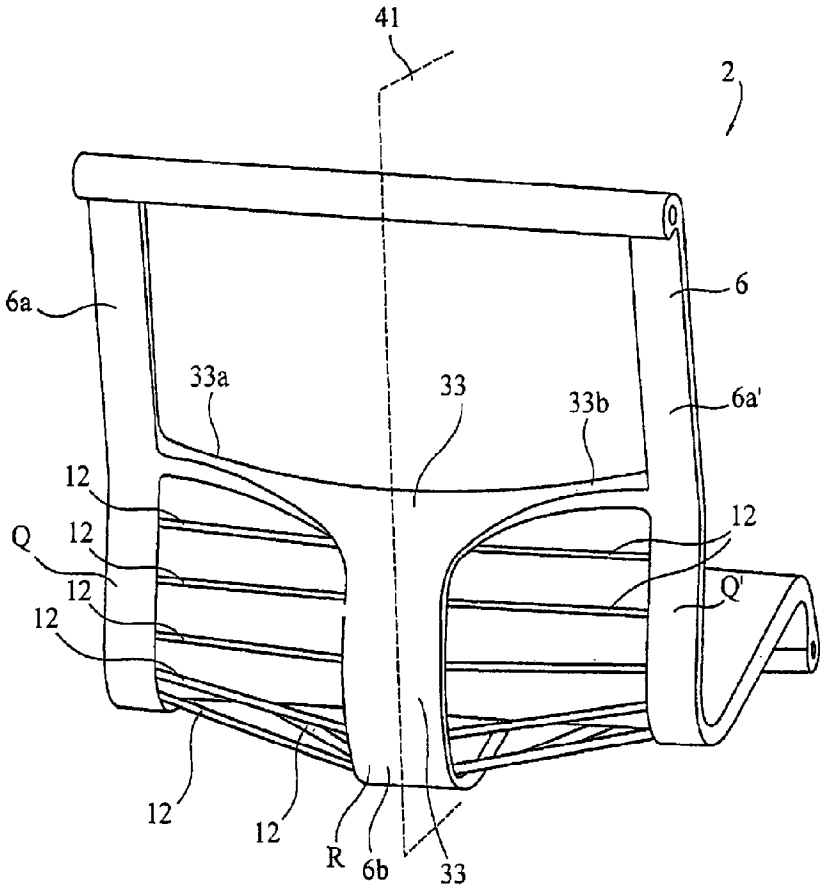
FIG. 17 shows: a further perspective view of the seat element known from FIG. 15.

FIG. 17 illustrates, in a further perspective view, the seat element 2 shown in FIG. 15. It can be seen from this view that the seat element 2 or the supporting arm 6 is formed mirror-symmetrically with respect to a plane 41 situated vertically in space.

Figure 19:
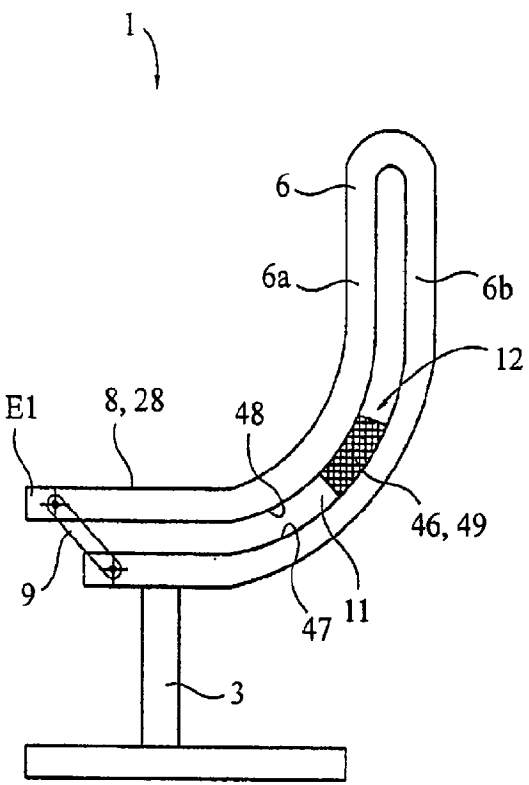
FIGS. 18-20 show: side views of a ninth, tenth and eleventh variant embodiment of a seat according to the invention.
Figure 18:
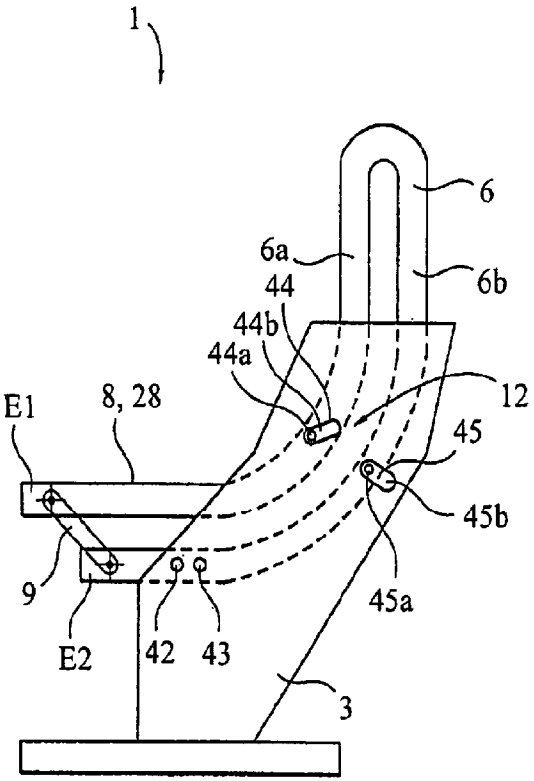
Figure 20:
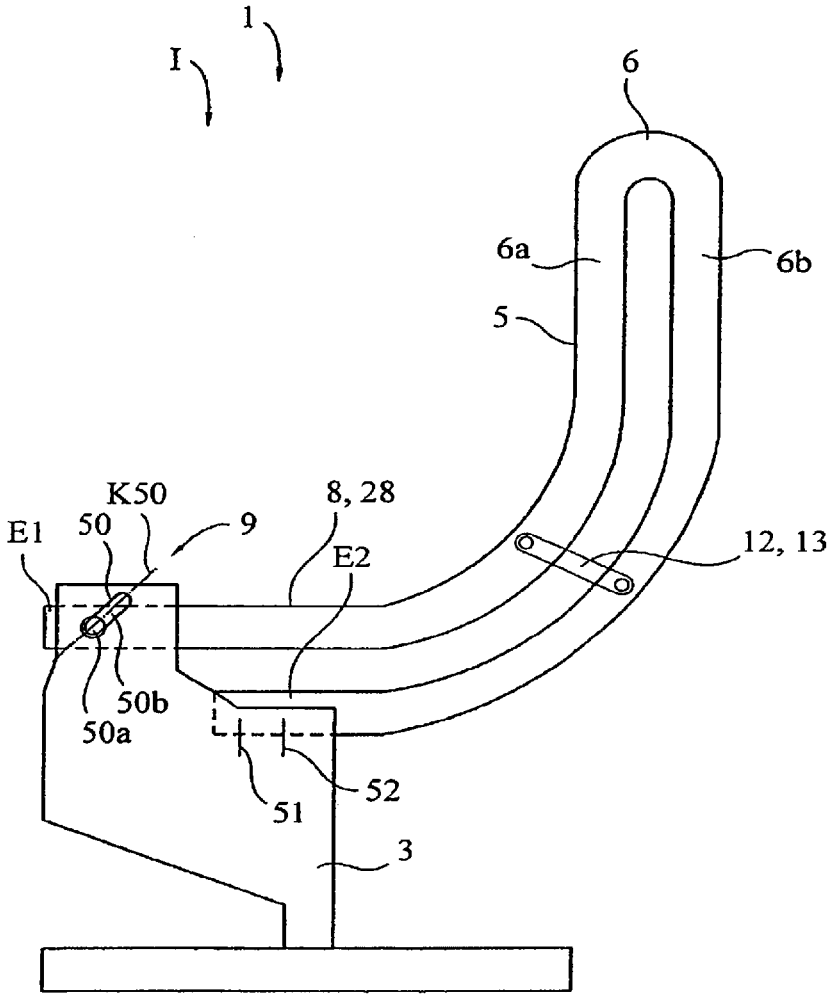

FIGS. 18 to 20 illustrate three further variant embodiments of seats 1 according to the invention. The three seats 1 are designed according to the seat shown in FIG. 1*b* and each have two supporting arms 6 which bear a fabric 8 as the covering 28. In the side views, the second supporting arm is entirely concealed by the first supporting arm 6. For simplification, only the supporting arm 6 is described in each case. The other supporting arm is constructed comparably in each case and is comparably fastened to an underframe 3.

In the case of the variant embodiment shown in FIG. 18, a lower support 6*b* of the supporting arm 6 is fastened to the underframe 3 of the seat 1 by two bolts 42, 43. A connecting link 12 for connecting the supports 6*a* and 6*b* is formed by two slotted-guide mechanisms 44, 45. The slotted-guide mechanisms 44, 45 respectively comprise a pin 44*a* and 45*a* and a slot 44*b* and 45*b*. The slots 44*b* and 45*b* are formed on the underframe 3, and the pins 44*a* and 45*a* are connected to the supports 6*a* and 6*b*. A free end E1 of the upper support 6*a* is guided on the lower support 6*b* by means of a guide element 9.

In the case of the variant embodiment shown in FIG. 19, a connecting link 12 between an upper support 6*a* and a lower support 6*b* of the supporting arm 6 is formed by an elastic element 46. The elastic element is arranged in an intermediate space 11 between the supports 6*a* and 6*b*. In order also to be able to transmit shearing forces, the elastic element 46 is adhesively bonded to an upper side 47 of the lower support 6*b* and to a lower side 48 of the upper support 6*a*. The elastic element 46 is designed, for example, as a rubber block 49. The supporting arm 6 is fastened by its lower support 6*b* on the underframe 3. A free end E1 of the upper support 6*a* is guided on the lower support 6*b* via a guide element 9.

In the case of the variant embodiment shown in FIG. 20, a connecting link 12 between an upper support 6*a* and a lower support 6*b* of the supporting arm 6 is designed as a lever 13, as already known from preceding exemplary embodiments. In contrast to the preceding exemplary embodiments, a guide element 9 is formed by a slotted-guide mechanism 50. The latter comprises a pin 50*a* and a slot 50*b*. The pin 50*a* is fastened to a free end E1 of the upper support 6*a* and slides in the slot 50*b*, which is formed on the lower part 3. During a movement of the seat element 1 from the basic position I illustrated in FIG. 20 into a resting position, the pin 50*a* and the upper support 6*a* connected thereto move upwards on a curve K50 in the direction of a backrest part 5. The lower support 6*b* is screwed at a free end E2 to the underframe by means of two screws 51, 52.

FIGS. 21 to 25 illustrate side views of further variants of a seating arrangement 1, the seating arrangement 1 having a seat 4 which in respect of two carrying arms 6 or beams. The second carrying arm is completely concealed by the first carrying arm 6 in the side views of FIGS. 21-25. In order to simplify the description, only the first carrying arm 6 and the fastening thereof on a substructure 3 will be described. The second carrying arm, which is not visible, is of identical construction.

Figure 21:
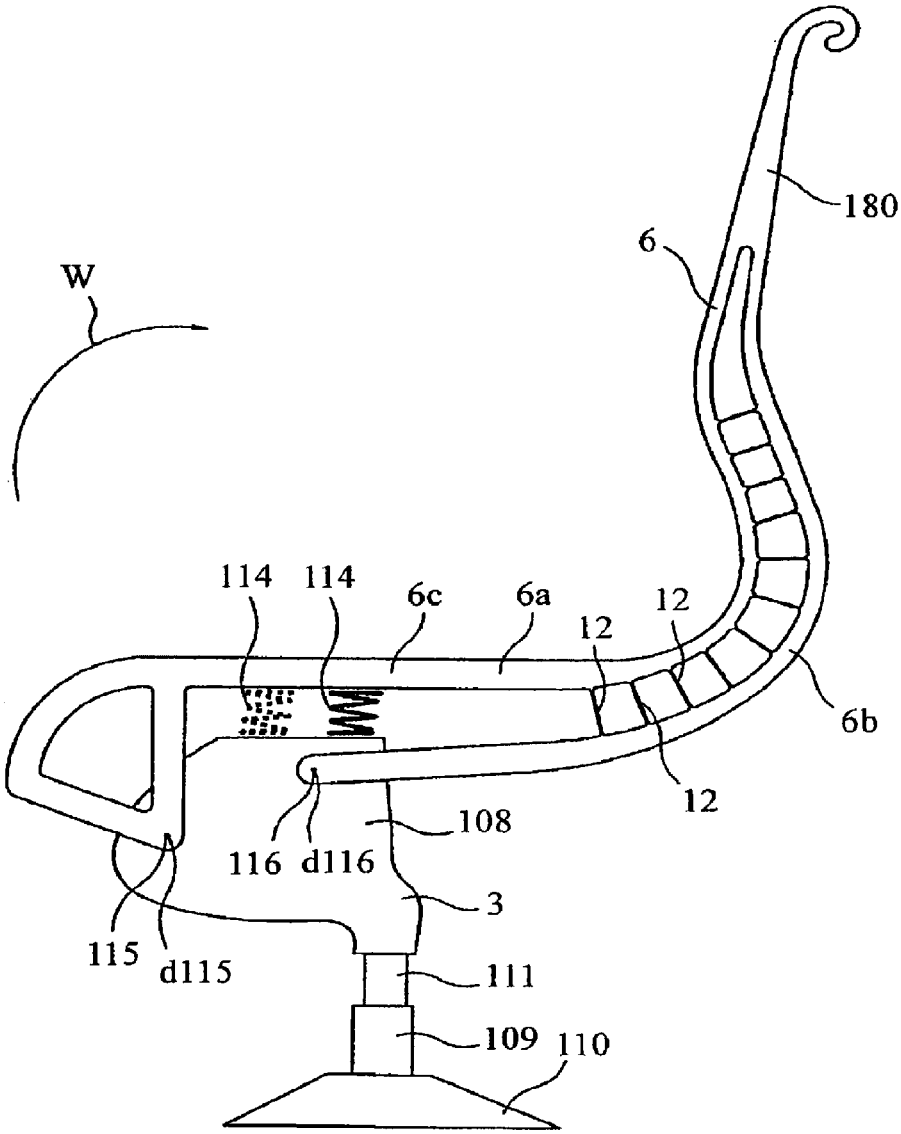
FIGS. 21-24 show: side views of variants of a seating arrangement.

In the case of variant of the seating arrangement 1, which is illustrated in FIG. 21, an upper carrier 6*a*, or beam member, is articulated on an upper part 108 of the substructure 3 such that it can be rotated in a first bearing 115, about an axis of rotation d115. Furthermore, a lower carrier 6*b*, or beam member, of the carrying arm 6 is articulated on the upper part 108 such that it can be rotated in a second bearing 116, about an axis of rotation d116. The upper carrier 6*a* and the lower carrier 6*b* are connected to one another via mechanical linking members 12, the lower carrier 6*b* being offset, or spaced apart, in relation to the upper carrier 6*a* so as to form a gap therebetween. The substructure 3 includes the upper part 108, a central part 109, a lower part 110 and a height-adjustable spring element 111 mounted between the upper part 108 and the central part 109. The lower part 110 may also be configured as a base part with castors. The upper carrier 6*a* of the carrying arm 6 is resiliently mounted on the upper part 108 of the substructure 3 via a spring element 114. For this purpose, the upper carrier 6*a* rests on the spring element 114 by way of its horizontal, first leg 6*c*. The additional support against a rotary movement of the carrying arm 6 about the axes of rotation d115 and d116 in a direction of rotation w can be modified by the properties of the spring element 114 and also by the positioning thereof. Dashed lines have been used to illustrate an alternative positioning of the spring element 114.

Figure 60:
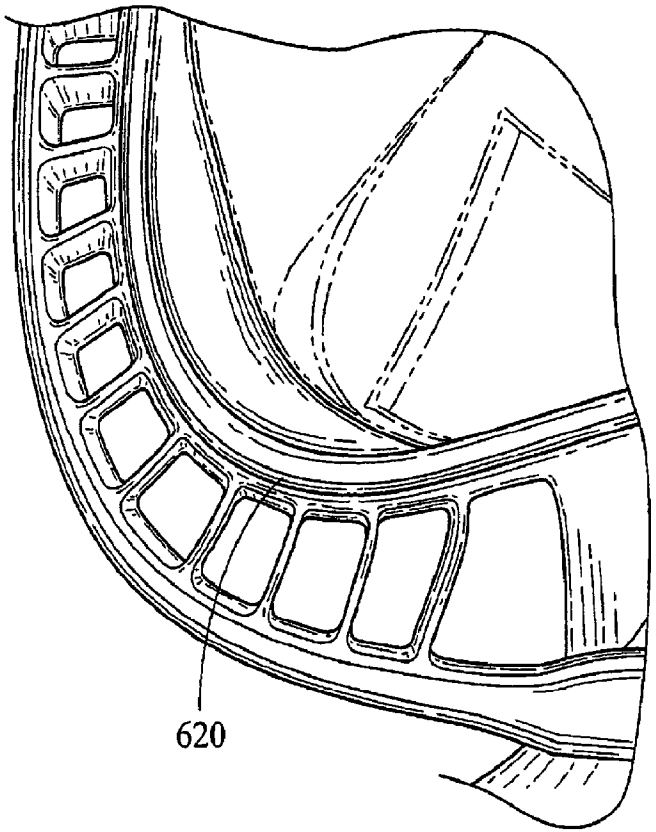
FIG. 60 shows a partial side view of a seating structure incorporating the load support structure shown in FIG. 56 in a reclined position.
Figure 59:
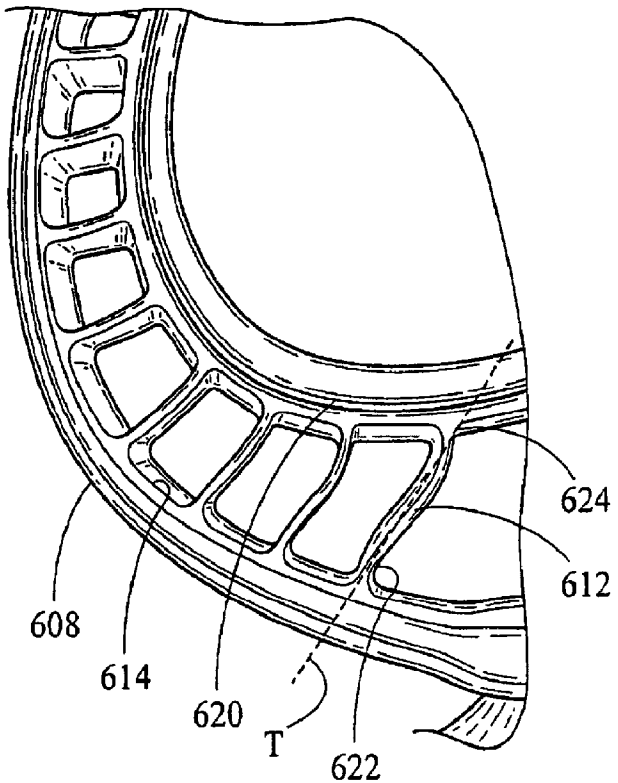
FIG. 59 shows a partial side view of a seating structure incorporating the load support structure shown in FIG. 56 in a neutral, upright position.
Figure 61:
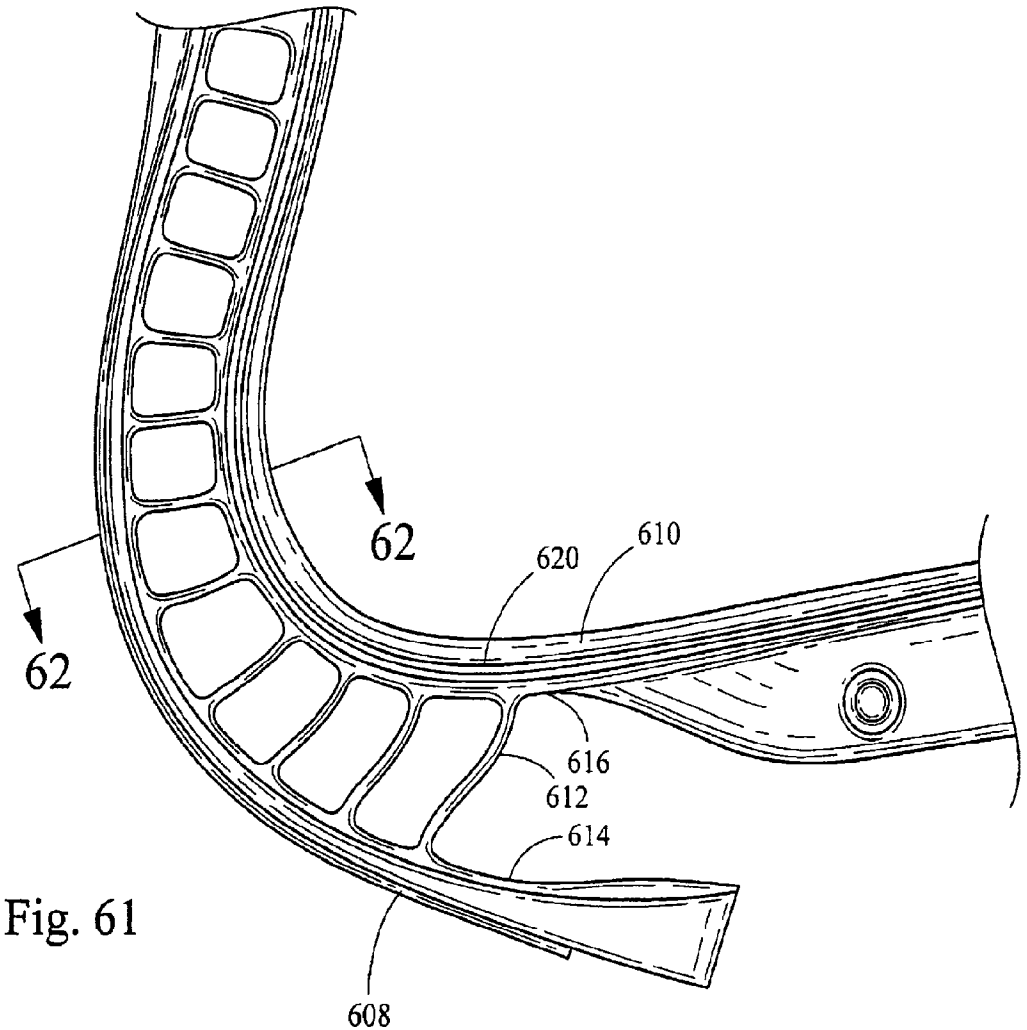
FIG. 61 is a partial side view of the load support structure.

Referring to FIGS. 56 and 59-61, at least some of a plurality, and in one embodiment all, of linking members 612 are non-linear, for example being curved or bent forwardly at a lower connecting portion 622 thereof, and curved or bent rearwardly at an upper connecting portion 624 thereof (reversed "S" shape when viewed from the exterior side of the beam), such that a tangent line T through a middle of the link is not oriented perpendicular to the upper and lower carrier arms 606*a*, 606*b*, when the seating structure is in a neutral, upright position as shown in FIG. 59. In a preferred embodiment, at least the lower linking members beneath the seat and buttock portion are curved. As the user reclines in the seating structure, the linking members straighten out as shown in FIG. 60 (partially reclined position) and can become completely straight in a fully reclined position, wherein the linking members are put in tension. In this way, the linking members do not take any substantial load in compression, but rather only in tension. It should be understood that the linking members could be configured with only a curved upper portion or only a curved lower portion, and furthermore that the curvature could be directed in the opposite direction, or that both curvature are directed in the same direction.

Exterior, upper and lower portions 610, 608 of the upper and lower carrier members 606*a*, 606*b* can be made of a different material than the interior portions 616, 614 of the same carrier members, which are molded with the linking members 612, FIGS. 59-62. In particular, the support members can be formed in a two-shot molding process, wherein either the exterior portions 610, 608 are first molded, and then the interior portions 616, 614 and linking members 612 molded thereto, or vice versa. For example, the exterior portions can be made, for example and without limitation, of glass filled Nylon, unfilled Nylon, glass filled polypropylene, unfilled polypropylene, polycarbonate, polycarbonate/ABS blend, acetal, or combinations thereof. The interior portions and linking members can be made of the same materials, or of various elastomeric materials, including without limitation, Hytrel, polyester elastomers, polypropylene elastomers, nylon elastomers, thermoplastic urethane elastomers or combinations thereof.

Figure 56:
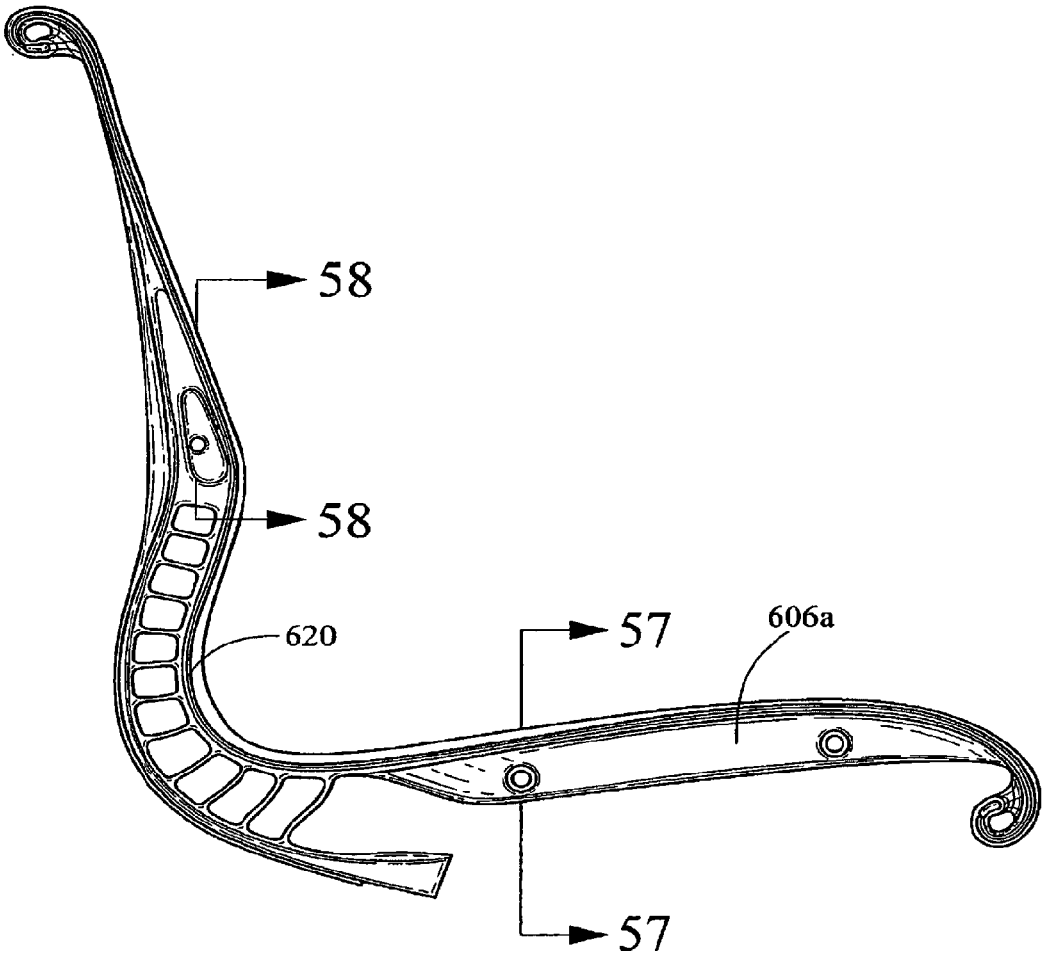
FIG. 56 shows: a side view of an alternative embodiment of a load support structure.
Figure 57:
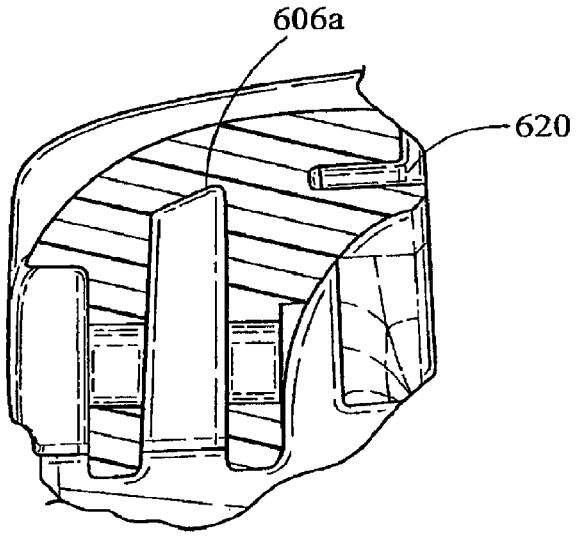
FIG. 57 shows: a cross sectional view of the load support structure shown in FIG. 56 taken along line 57-57.
Figure 62:
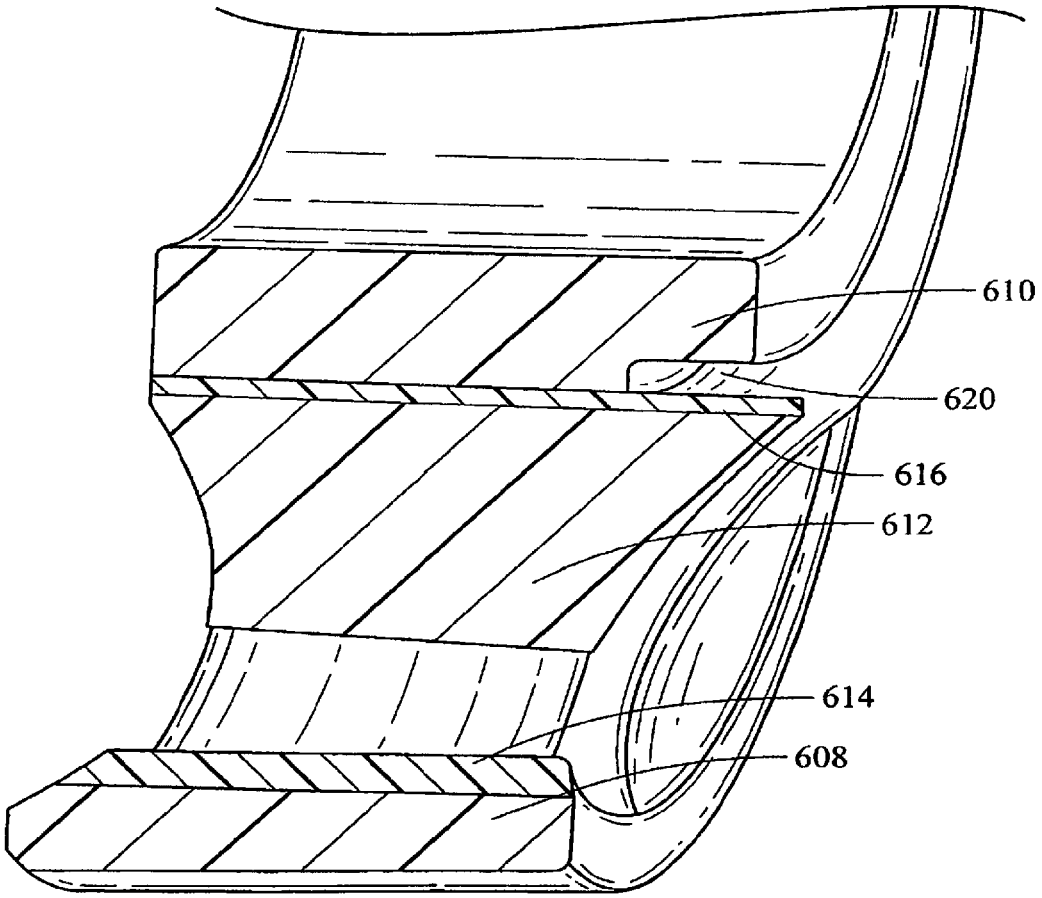
FIG. 62 is a cross-sectional view of the load support structure taken along line 62-62 in FIG. 61.

As shown in FIGS. 56-62, a groove 620 facing laterally outwardly is formed in the upper carrier member 606*a*. The groove can be formed entirely in the material forming the forward portion of the upper carrier 606*a* as shown in FIGS. 56 and 57, or between the material forming the upper portion 610 and the lower portion 616, which can help reduce high stress points in the beam. The inner top portion of the groove, as shown in FIG. 62, can also be curved to help reduce stresses at the corners of the groove 620.

Figure 22:
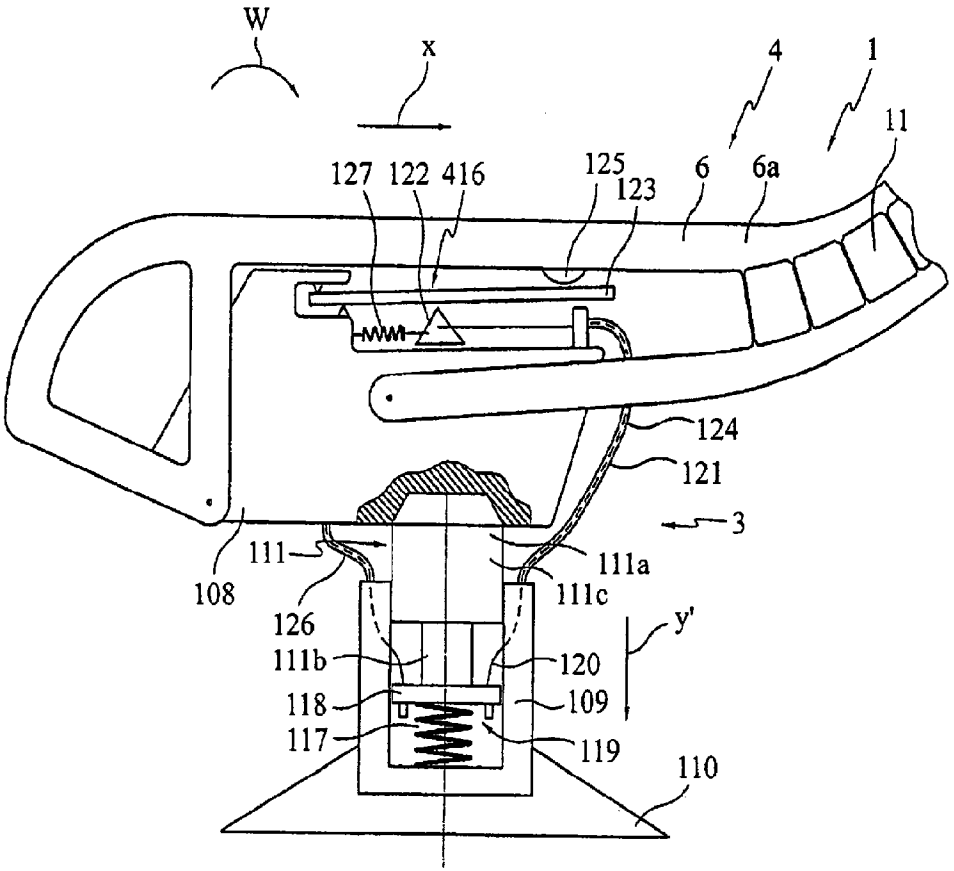

FIG. 22 shows a variant of the seating arrangement 1 with a spring mechanism 416. The second carrying arm, which is not visible in the side view, is assigned a spring mechanism of identical construction, which is completely concealed by the first spring mechanism 416. The substructure 3 of the seating arrangement 1 comprises an upper part 108, a central part 109 and a lower part 110. A height-adjustable spring element 111 is arranged between the upper part 108 and the central part 109. The upper part 108 also bears the spring mechanism 116. The height-adjustable spring element 111 comprises a pneumatic spring 111*a* and a spring element 117 arranged beneath a piston rod 111*b* of the pneumatic spring 111*a*. The piston rod 111*b* is guided in a pressure tube 111*c*. The upper part 108 is fastened on the pressure tube 111*c*, the pressure tube 111*c* being guided with sliding action in the vertical direction in the central part 109. The pneumatic spring 111*a* is supported on the spring element 117 by a flange plate 118 arranged on the piston rod 111*b*. The flange plate 118 and the spring element 117 form a weighing mechanism 119, which can establish the weight to which the seat 4 is subjected by an individual.

Figure 26:
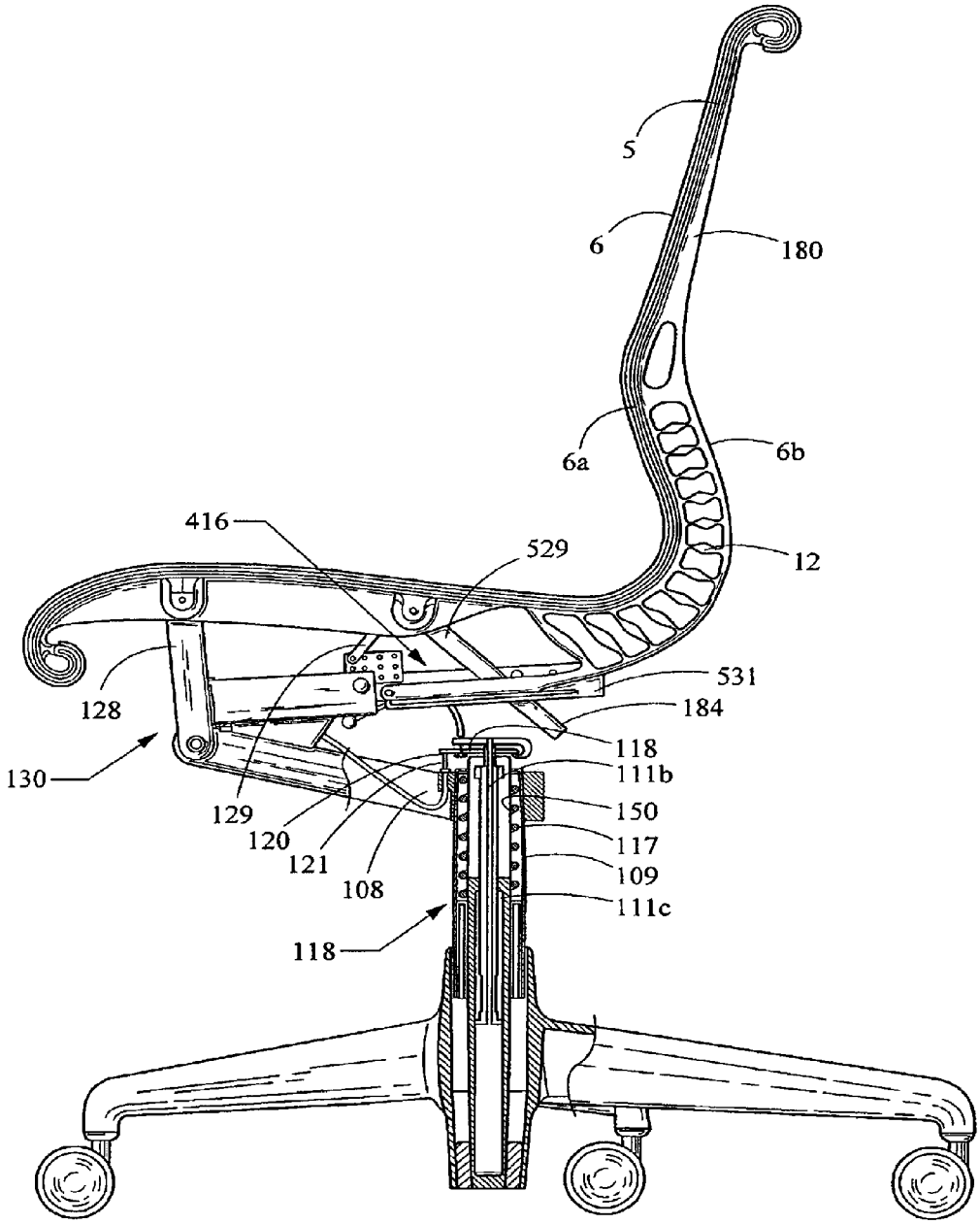
FIG. 26 shows: a side view of another embodiment of a seating arrangement.
Figure 27:
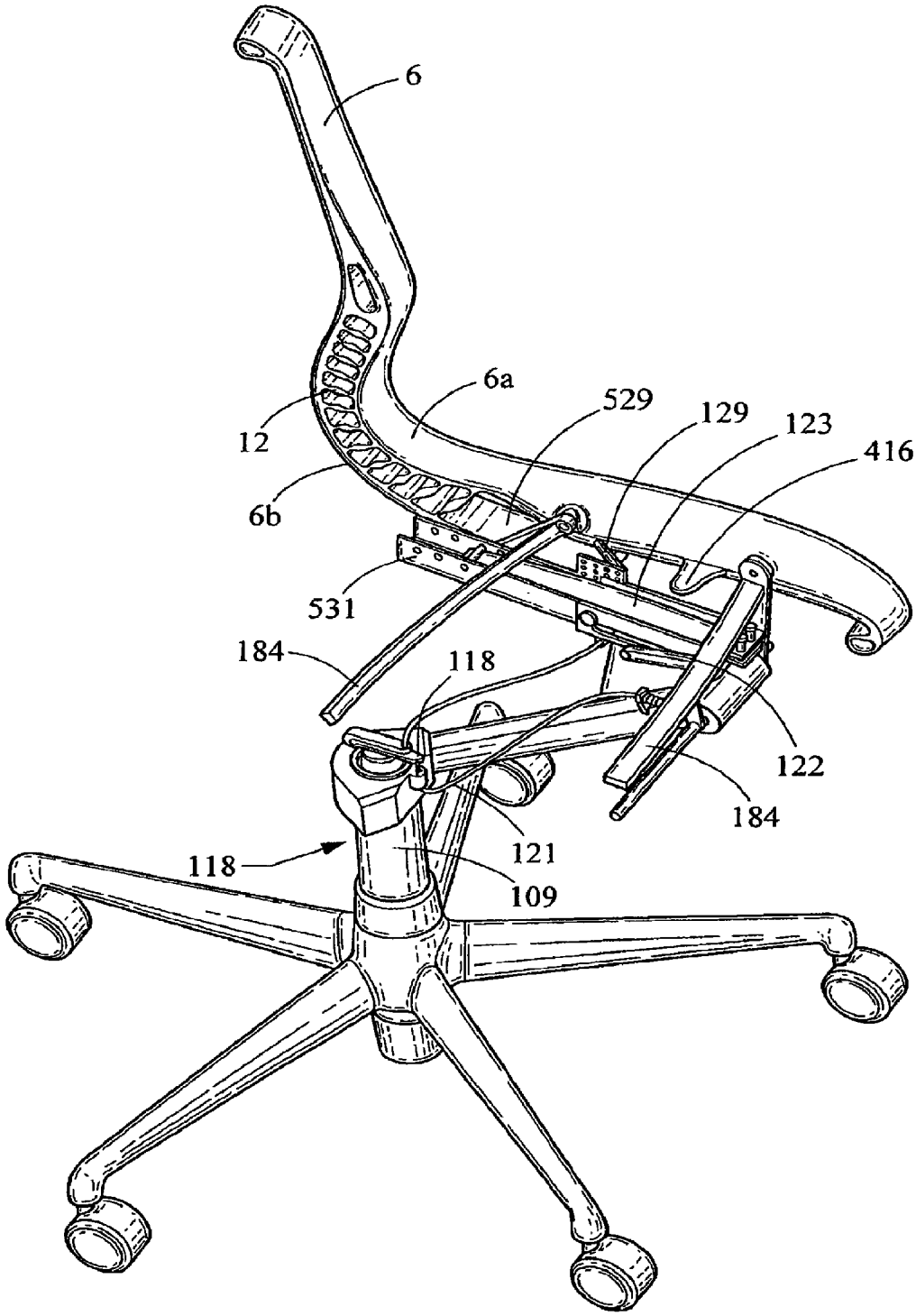
FIG. 27 shows: a partial, perspective view of the seating arrangement shown in FIG. 26.

In an alternative embodiment, shown in FIGS. 26 and 27, the spring element 117 is arranged around the top of the piston rod 111*b*, with the pressure tube 111*c* supported by the base. The upper part 108 is secured to a housing 109, which is supported by the spring and piston rod via an adapter 150. The various aspects of the weighing mechanism are further disclosed in International Application PCT/IB2007/000734, filed Mar. 22, 2007, which is hereby incorporated herein in its entirety.

The spring mechanism 116 is controlled via the weighing mechanism 119. A wire 120 of a Bowden cable 121 is fastened on the flange plate 118 of the weighing mechanism 119 and transmits the movement of the flange plate 118 to a bearing means 122, which is guided in a displaceable manner beneath a leaf spring 123. The spring mechanism 116 mentioned above comprises essentially the bearing means 122 and the leaf spring 123. The wire 120 of the Bowden cable 121 is guided in a hose 124, the hose being supported on the central part 108 and on the upper part 109. A vertical movement of the flange plate 118 in a direction y' causes the bearing means 122 to be drawn horizontally to the right in an arrow direction x by the Bowden cable 121. An upper carrier 6*a* of the carrying arm 6 thus undergoes relatively pronounced resilient deflection, corresponding to the loading to which the seat 4 is subjected, when the leaf spring 123 positions itself on the bearing means 122 as an individual sitting on the seat leans back. The upper carrier 6*a* is supported on the leaf spring 123. A second Bowden cable 126 is fastened on the flange plate 118. This second Bowden cable controls the second spring mechanism (not visible), which is assigned to the second carrying arm (not visible). When the seat 3 is relieved of loading, the bearing means 122 is drawn back by a spring element 127 into the position which is shown in FIG. 14. A level of prestressing of the leaf spring 123 is such that the bearing means 122 can move without any contact with the leaf spring 123 as long as an individual is only sitting on the seat in the upright position. The leaf spring 123 positions itself on the bearing means 122 for the first time when the individual leans back from their upright position, in a direction of rotation w, against a backrest 5. The spring mechanism 116 cushions the leaning-back movement of an individual in a weight-dependent manner. The seating arrangement 1 thus provides individuals of different weights with a high level of comfort without resilient deflection of the backrest having to be adjusted.

Figure 23:
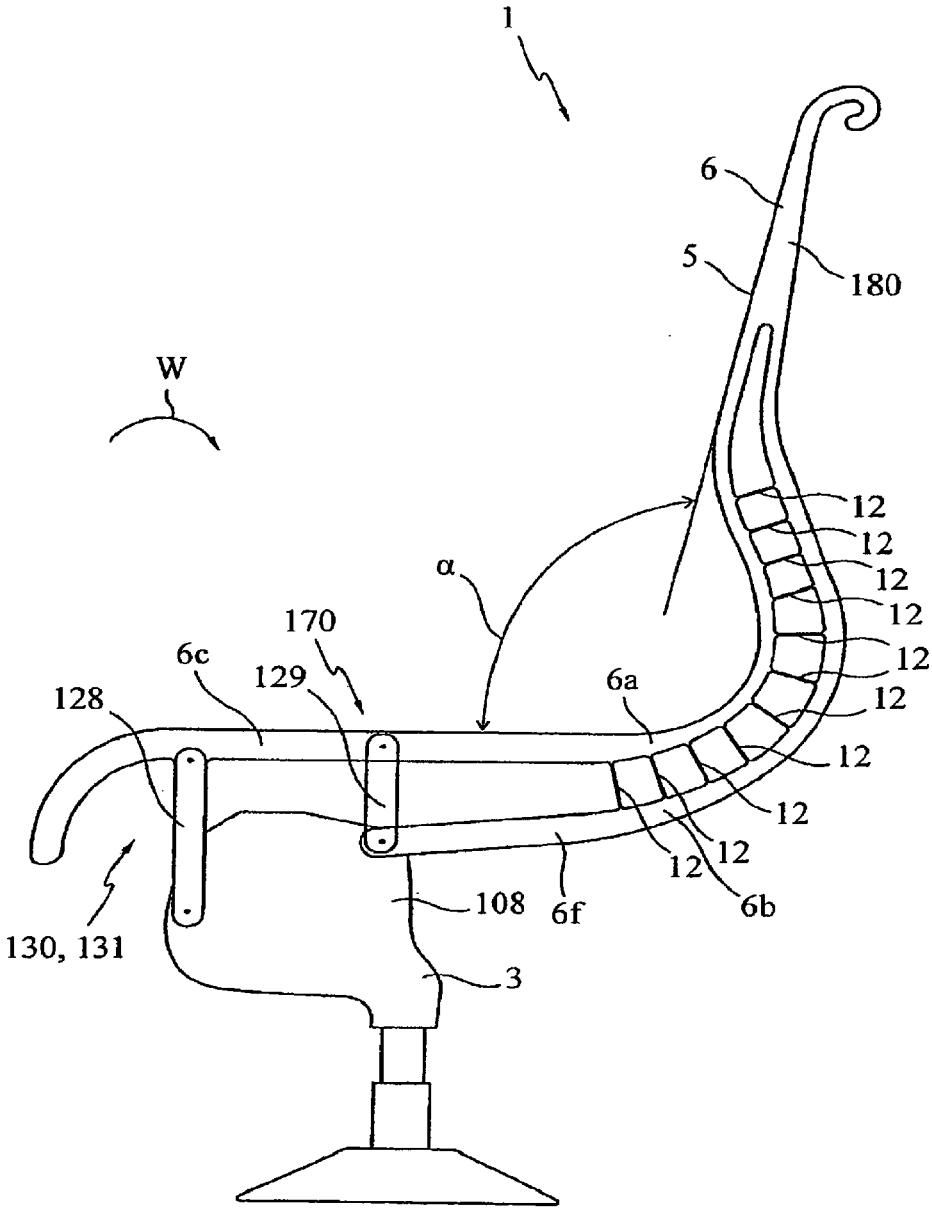

FIG. 23 illustrates another variant of the seating arrangement 1. An upper carrier 6*a* of the carrying arm 6 is articulated on an upper part 108 of the substructure 3 via two levers 128 and 129. The levers 128 and 129, along with the upper carrier 6*a*, form a four-bar linkage 130. This four-bar linkage 130 forms a coupling mechanism 131, which defines a tilting movement executed by the upper carrier 7*a* and/or a seat surface 170 when the seating arrangement 1 is subjected to loading by an individual sitting on it. Of course, a lower carrier 6*b*, which is connected to the upper carrier 6*a* at a connecting location 180 and by a number of linking members 12, counteracts a lowering movement of the upper carrier 6*a* in the manner described. Furthermore, a lowering movement of legs 6*c* and 6*f* of the carriers 6*a* and 6*b* in a direction of rotation w also results in an increase in an opening angle α between the seat surface 170 and a backrest 5.

Figure 24:
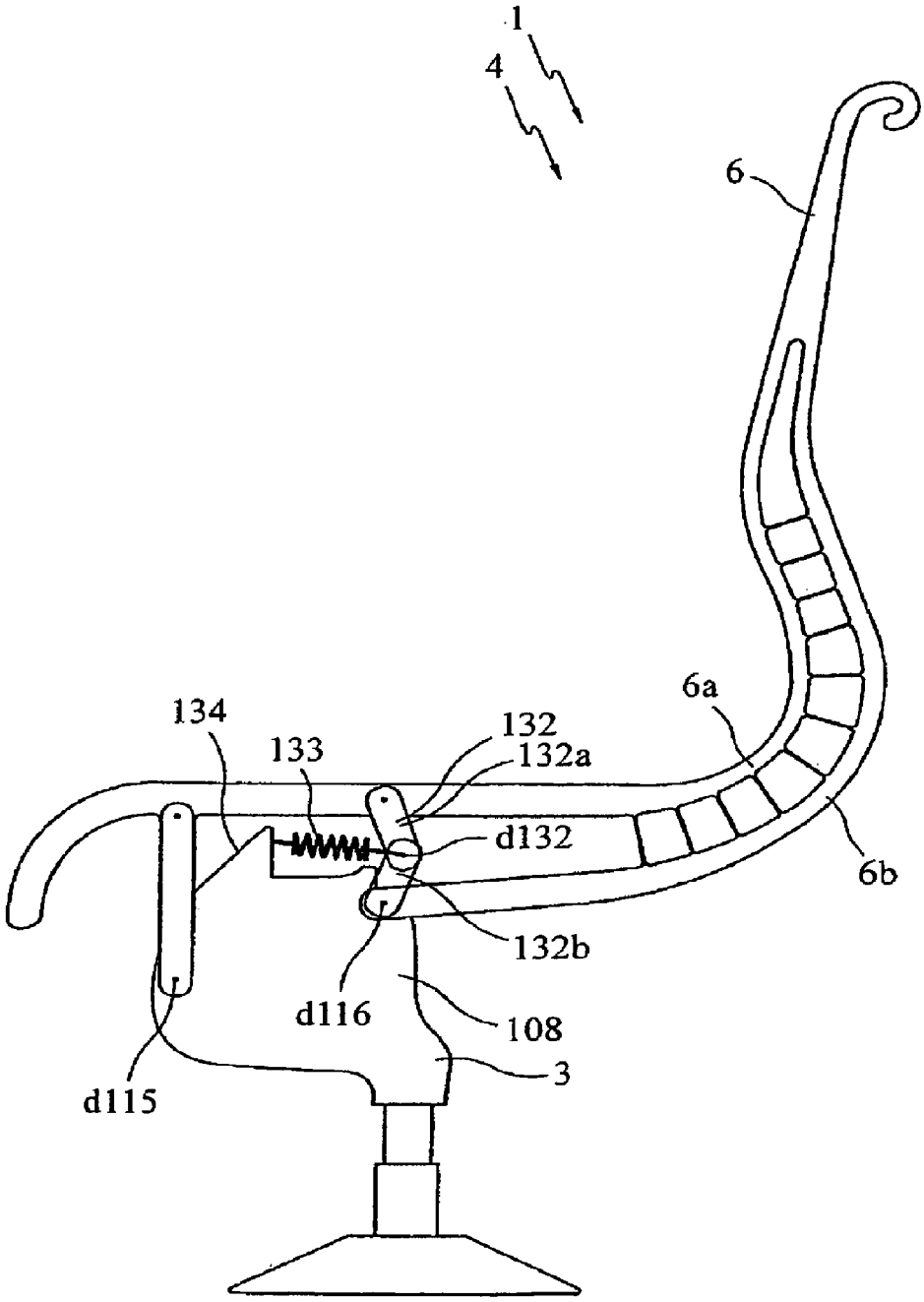

FIG. 24 illustrates a side view of another variant of a seating arrangement 1. An upper carrier 6*a* of the carrying arm 6 is articulated on an upper part 108 of the substructure 3 such that it can be rotated about an axis of rotation d115. Furthermore, a lower carrier 6*b* of the carrying arm 6 is articulated on the upper part 108 such that it can be rotated about an axis of rotation d116. In addition, the upper carrier 6*a* of the carrying arm 6 is articulated on the upper part 108 via a toggle 132, for rotation about the axis of rotation d116. The toggle 132 comprises an upper lever 132*a*, which is fastened in a rotatable manner on the upper carrier 6*a*, and a lower lever 132*b*, which can be rotated about the axis of rotation d116. The two levers 132*a* and 132*b* are connected to one another in an articulated manner about an axis of rotation d132. A spring 133 draws the toggle 132, by way of its lower lever 132*a*, against a stop 134, which is formed on the upper part 108. This spring mechanism 116, which is formed essentially from the toggle 132 and the spring 133, retains the seat 4 with an additional force in the position.

Figure 25:
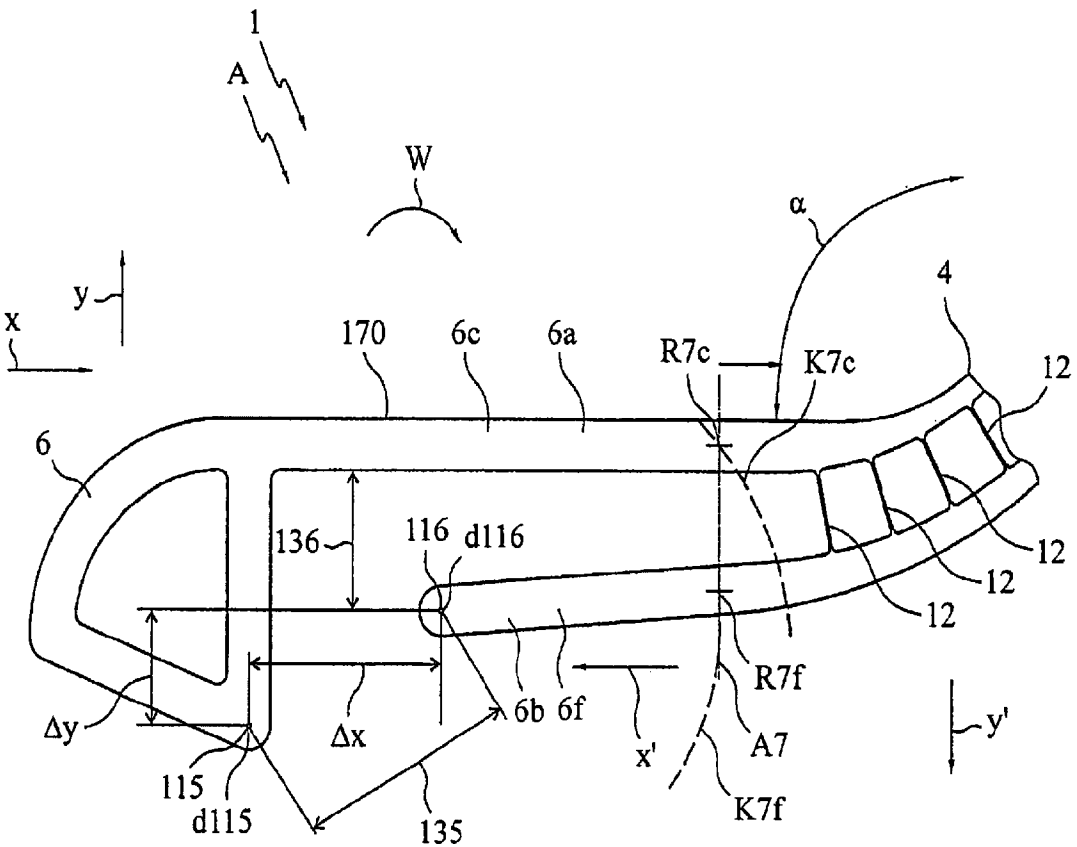
FIG. 25 shows: a detail-specific view of a carrying arm.

FIG. 25 shows a detail-specific view of the carrying arm 6. An upper reference point R7*c* is arranged on the horizontal, first leg 6*c* of the upper carrier 6*a*, and a lower reference point R7*f* is arranged on the horizontal, first leg 6*f* of the lower carrier 6*b*. The two reference points R7*c*, R7*f* are located on a vertical axis A7 in the non-loaded position A of the seating arrangement 1. When the seat 4 is subjected to loading and the carriers 6*a* and 6*b* are rotated correspondingly about their bearings 115 and 116 or axes of rotation d115 and d116, the two reference points R7*c*, R7*f* move vertically downward in an arrow direction y' and move apart from one another in the horizontal direction. During the lowering movement, the imaginary reference point R7*c* moves over a circular path K7*c* about the axis of rotation d115 and the imaginary reference point R7*f* moves over a circular path K7*f* about the axis of rotation d116. When the carrying arm 6 is subjected to loading by an individual (not illustrated), the carriers 6*a* and 6*b* rotate in a direction of rotation w about their axes of rotation d115 and d116. The offset arrangement of the axes of rotation d115 and d116 means that this results in the horizontal legs 6*c* and 6*f* of the two carriers 6*a* and 6*b* being displaced in opposite directions. The upper carrier 6*a* is displaced in the direction of the backrest 5, and the lower carrier 6*b* is displaced in the direction of its bearing 116. This displacement of the carriers 6*a* and 6*b* in opposite directions, brought about by the seating arrangement 1 being subjected to loading, results in the carrying arm 6 being extended where the carriers 6*a* and 6*b* are connected to one another by the linking members 12. When the approximately horizontal legs 6*c* and 6*f* of the carriers 6*a* and 6*b* are lowered, there is thus also an increase in the opening angle α between the seat surface 170 and the backrest 5. In order to allow this elastic deformation of the carrying arm 6, the carriers 6*a* and 6*b* are of resilient and elastic configuration in the region of their linking members 12. In order for the displacement of the carriers 6*a* and 6*b* in opposite directions to be achieved in the desired manner, the axis of rotation d116 is located above the axis of rotation d115, as seen in the vertical direction y, and the axes of rotation d115 and d116 are spaced apart from one another in the horizontal direction x. A spacing 135 provided between the axes of rotation d115 and d116 is larger than a spacing 136 between the axis of rotation d16 and the upper carrier 7*a*. There is a horizontal spacing Δx and vertical spacing Δy between the parallel axes of rotation d115 and d116. Rather than being restricted to exemplary embodiments, which have been illustrated or described, the invention also covers developments within the context of the claims. Plastic in particular is provided as the material for the carrying arm.

Referring to FIGS. 26 and 27, a seating arrangement is shown similar to the embodiment shown in FIG. 23, but with a weighing mechanism as previously described. An upper carrier 6*a* of the carrying arm 6 is articulated on an upper part 108 of the substructure 3 via two levers 128 and 129. The levers 128 and 129, along with the upper carrier 6*a*, form a four-bar linkage 130. This four-bar linkage 130 forms a coupling mechanism 131, which defines a tilting movement executed by the upper carrier 6*a* and/or a seat surface 170 when the seating arrangement 1 is subjected to loading by an individual sitting on it. In one embodiment, the lever 128 is substantially vertical, while the lever 129 also has a vertical vector component, with those levers absorbing the weight of the user as they initially sit in the seat prior to recline, which allows the weighing mechanism to function more efficiently. The levers 128, 129 further define the path of motion of the upper carrier 6*a* relative to the lower carrier. Of course, a lower carrier 6*b*, which is connected to the upper carrier 6*a* at a connecting location 180 and by a number of linking members 12, counteracts a lowering movement of the upper carrier 6*a* in the manner described. Furthermore, a lowering movement of legs 6*c* and 6*f* of the carriers 6*a* and 6*b* in a direction of rotation w also results in an increase in an opening angle α between the seat surface 170 and a backrest 5. A pair of cross members 184, or spreaders or brace members, maintain a predetermined distance between the laterally spaced carrying arms or beams.

The spreader 184 is connected to the upper arm 6*a*. In addition, a lever 529 is pivotally connected to the upper arm 6*a* and to an adapter 531 connected to the lower arm 6*b* so as to bear against the leaf spring.

Figure 28:
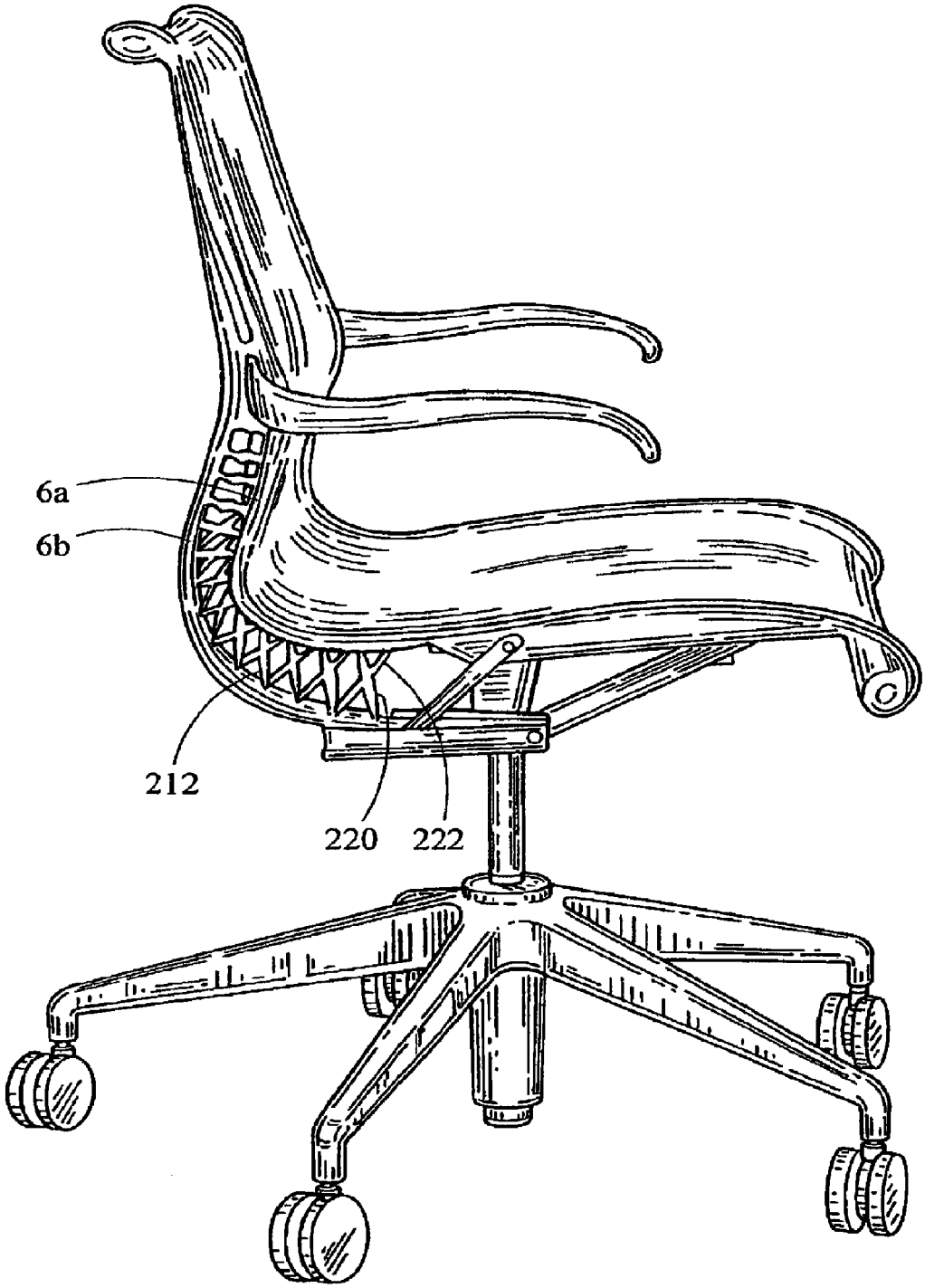
FIG. 28 shows: a side view of one embodiment of a seating arrangement.
Figure 29:
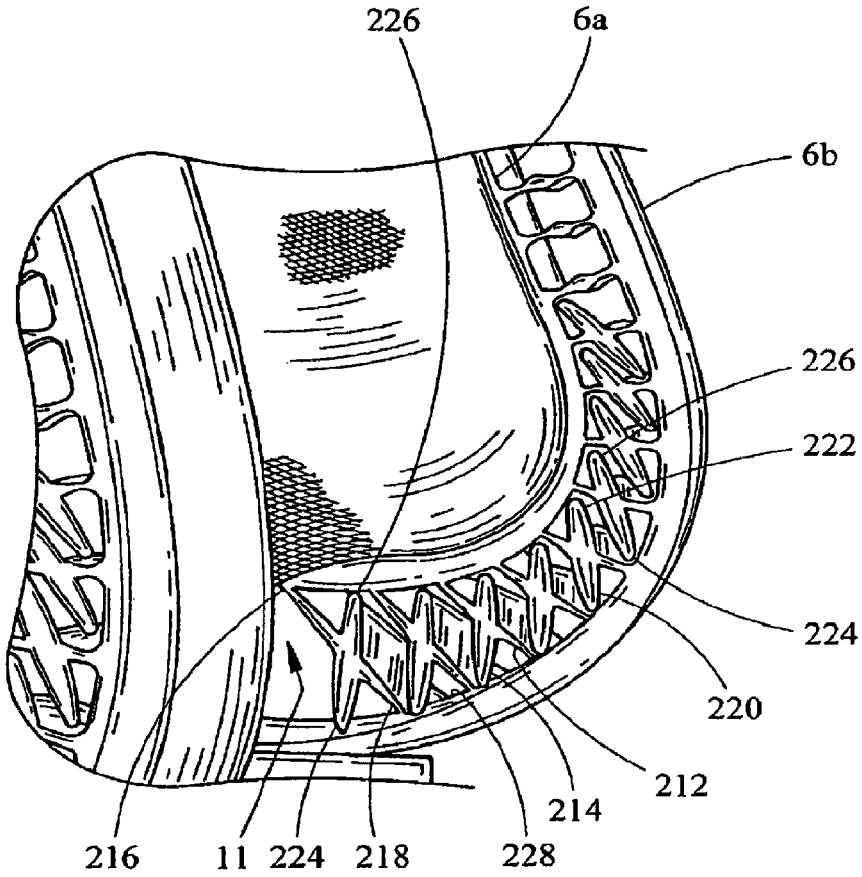
FIG. 29 shows: an enlarged partial view of a load support structure having a stop member, as shown in FIG. 28.

Referring to FIGS. 28 and 29, at least one, and preferably a plurality, of linking members 212 are configured with stop members 214. In particular, the linking members 212 bridge the gap 11 between the upper and lower carriers 6*a*, 6*b*, or beams, forming the beam or carrying arm. The linking members 212 have first and second end portions 216, 218 coupled to the upper and lower carriers 6*a*, 6*b* respectively. As the load support structure, or beam, is loaded, the carriers 6*a*, 6*b* move relative to each other from at least a first position to a second position, as the previously described. A stop member 214 extends from the linking member 212 at a location intermediate the end portions. In a preferred embodiment, the stop member includes first and second arm portions 220, 222 extending diagonally from the linking member, such that the linking member and stop member are substantially X-shaped. The stop member arms 220, 222 are each configured with end portions 224, 226.

The end portions 224, 226 are spaced from an adjacent beam 6*a*, 6*b* or carrier member when the carrier members are in the first position, e.g., an unloaded position. The end portions 224, 226 engage one of the upper and lower carrier members 6*a*, 6*b* as the carrier members are moved to the second, loaded position, with the stop members 214 preventing further movement of the carrier members relative to each other once engaged, so as to prevent the collapse of the beam. It should be understood that the stop members 214 can "engage" a carrier member 6*a*, 6*b* directly or indirectly, for example by way of engaging an adjacent linking member 212 connected to the carrier member. In a preferred embodiment, the stop member 214 engages the carrier member 6*a*, 6*b* at a junction 228 or interior shoulder between the beam and the linking member. It should also be understood that, while the load support structure is shown in connection with a seating arrangement, it may have other structural applications. It should also be understood that the term "coupled" as used herein means connected, whether directly or indirectly, for example by way of an intervening component, and includes integral formation of two or more components, or connection of separately formed components for example with various fasteners, including without limitation mechanical fasteners, adhesives, welding, stitching, tabs, snap-fits, etc. In a preferred embodiment, the upper and lower carrier members 6*a*, linking members 212 and stop members 214 are integrally formed. The stop members 214 prevent the beam from collapsing, for example when a user applies a load to the armrests of the chair when exiting the chair, or any other counterclockwise torsional load or downward vertical load when viewed from the left-hand side.

Figure 31A:
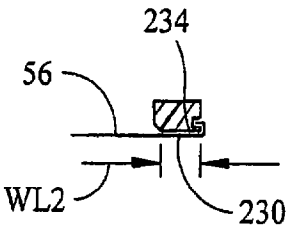
FIGS. 31A and 31B show: cross-sections of the load support structure taken along lines 31A-31A and 31B-31B in FIG. 31.
Figure 31B:
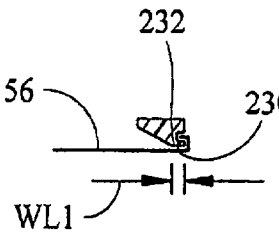
Figure 31:
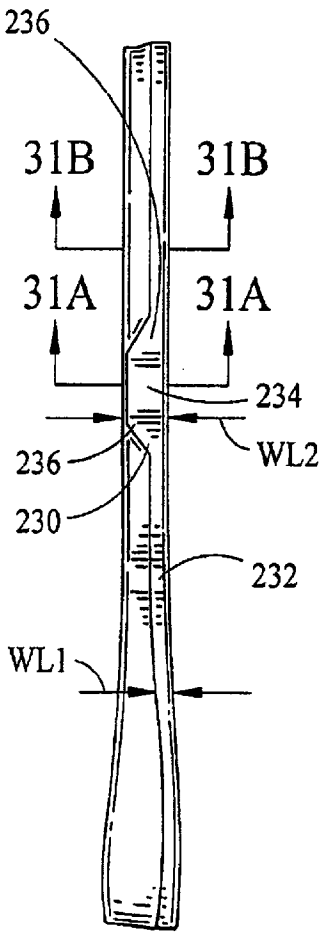
FIG. 31 shows: a front view of the load support structure shown in FIG. 30.
Figure 30:
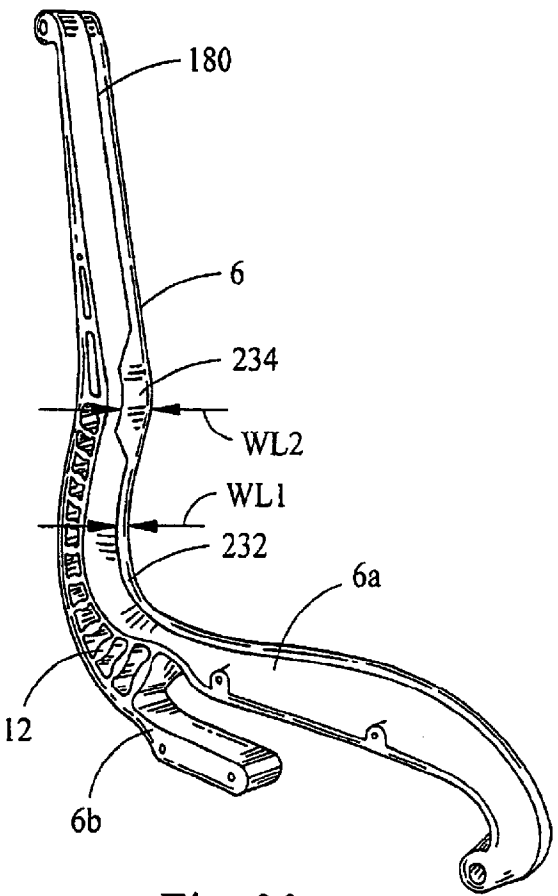
FIG. 30 show: a perspective view of one embodiment of a load support structure having different landing regions.
Figure 32:
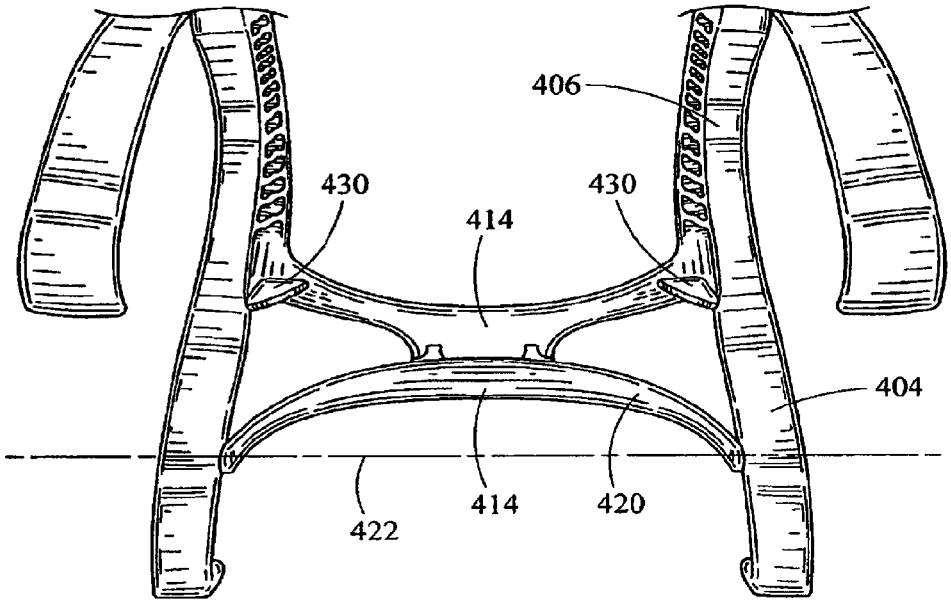
FIG. 32 show: a partial, top perspective view of a body support structure.
Figure 33:
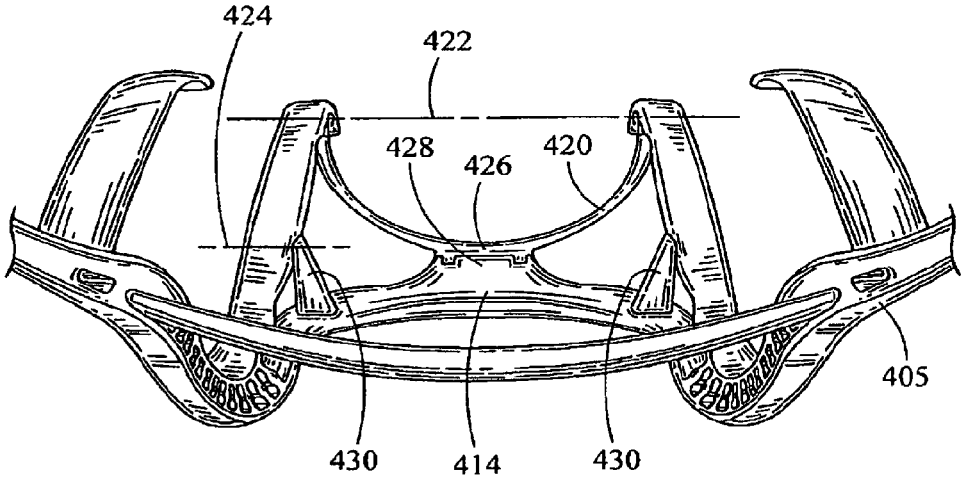
FIG. 33 shows: a partial, rear perspective view of the body support structure shown in FIG. 32.
Figure 34:
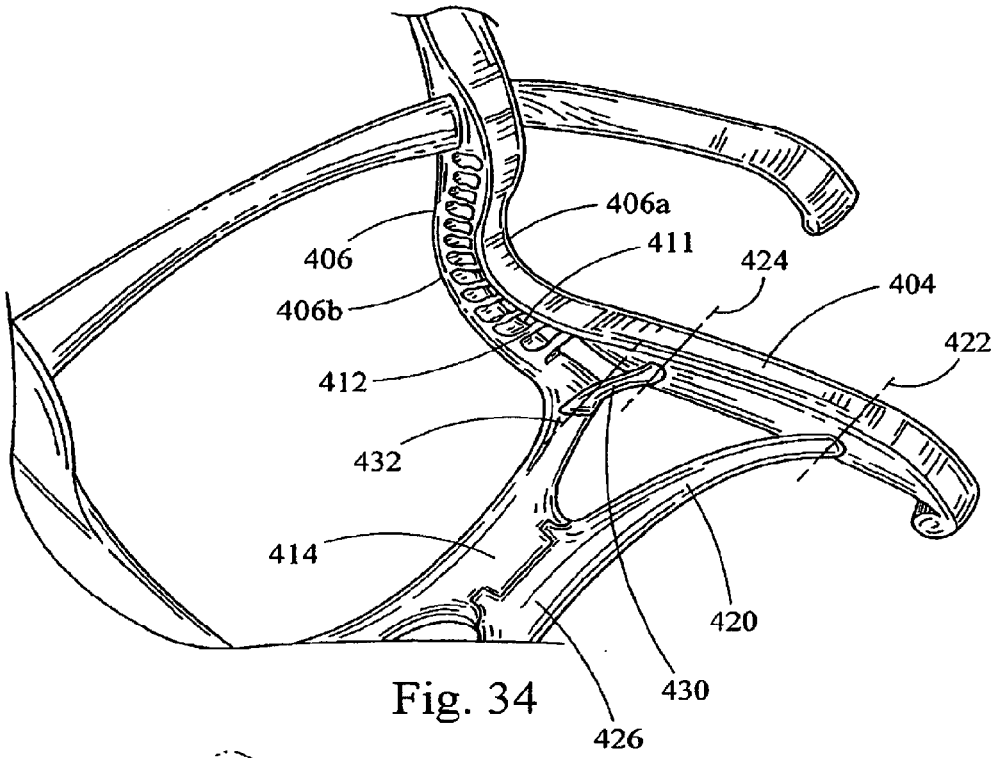
FIG. 34 shows: a partial, side perspective view of the body support structure shown in FIG. 32.
Figure 35:
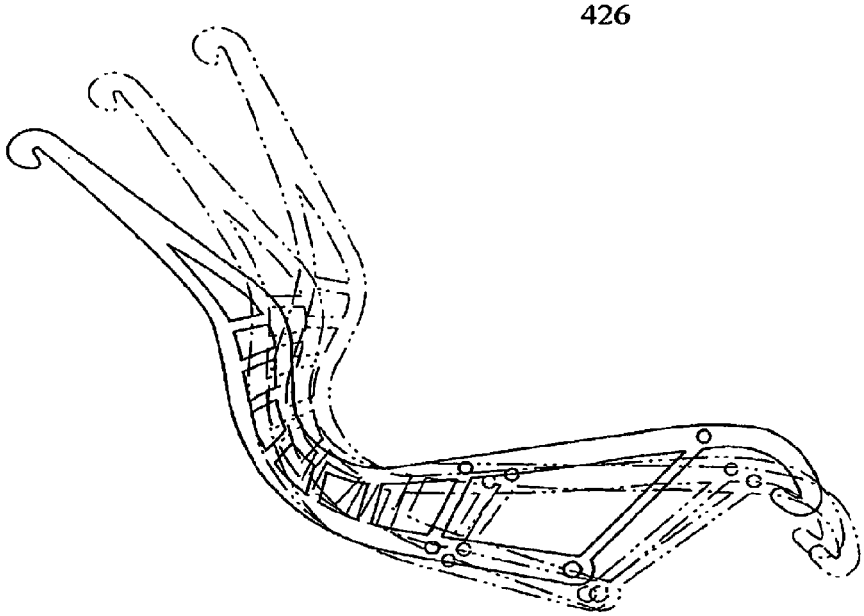
FIG. 35 shows: a side, schematic view illustrating the kinematic movement of the body support structure shown in FIG. 32.

Referring to FIGS. 30 and 31, a carrier 6, or beam, is shown as having a support surface 230, located in one embodiment on an outer portion of the carrier, with the inner portion tapering away therefrom. In one embodiment, the support surface is substantially continuously parallel along its length in at least one direction (e.g., a lateral horizontal direction), with any lateral tangent thereto being parallel to any other lateral tangent planar. As shown in FIGS. 31-31B, the support surface defines first and second landing regions 232, 234, which contact and support a body support material, such as a fabric or membrane 56, as shown in FIG. 40. The first landing region 232 has a first width WLI, while the second landing region 234 has a second width WL2, with the second width being greater than the first width. For example, in one embodiment, the first landing region can be formed as a thin edge, approaching a zero width, while the second width is substantially the entirety of the width of the beam. Of course, the widths can be varied relative to the beam width and each other so as to achieve a desired result. As shown in FIG. 31, a transition area 236 transitions between the landing regions. Although the load support structure can be used in other applications besides seating arrangements, the carrier 6 shown in FIGS. 30-31B is configured for use in a seating arrangement.

In a preferred embodiment, the second landing region 234 is formed adjacent the lumbar region of the user on a back support element. In one embodiment, shown in FIGS. 36 and 40, a pair of support elements 6 are spaced apart, with a membrane 56 stretched therebetween. The membrane 56 has a first support region 240 having a first width WMI defined between the first landing regions of the beams, and a second support region 238 having a second width WM2 defined between the second landing regions of the beams. The width of the second support region is less than the width of the first support region, with the membrane 56 thereby being prevented from deflecting as much in the second region as in the first region. In this way, the back 5 is provided with differential support, for example with more support in the lumbar region, without having to change the weave or materials of the membrane or alter the contour of the back. Preferably, the upright portions 5 of the carriers 6 are bowed forwardly at the lumbar region so as to provide additional support for that region of the user's back.

Referring to FIGS. 36, 37, 40, 43 and 50-53, a cross member 242 or spanner, functions as a rigid brace member that tensions the membrane 56 between the upright portions 5 of the beams. In a preferred embodiment, the cross member has opposite end portions 244 received through an inwardly opening mouth 246 of a cavity 248, or opening, on each upright. The end portions 244 are preferably configured with a greater height than width. For example, the end portions can be configured as rectangle, oval, obround or other elongated shapes. A middle, or intermediate portion 250 of the cross member has a greater width than height, with the contour of the cross member smoothly transitioning from the end portions 244 to the middle portion 250. The middles portion 250 can assume any cross-sectional shape, including a rectangle, oval, obround, or other elongated shape. The upper portions of the uprights 5, by way of the connection to the cross member 242, can flex or bend independently, thereby providing the overall back with torsional flexibility, which improves the comfort of the back. In another embodiment, the cross member is pivotally connected to each upright at the ends of the cross member to provide the bending and torsional flexibility.

Figure 58:
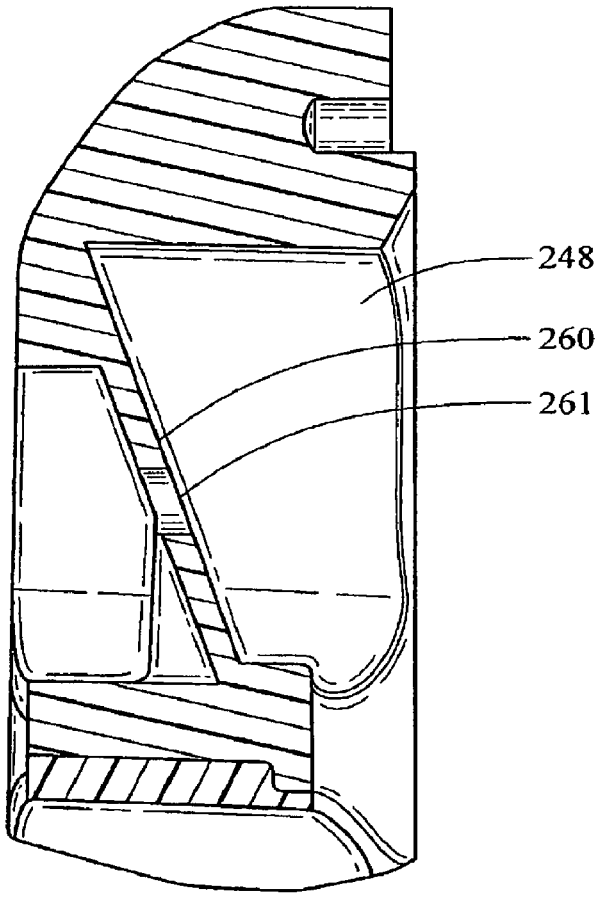
FIG. 58 shows: a cross-sectional view of the load support structure shown in FIG. 56 taken along line 58-58.

A pair of armrests 252 each includes a cantilevered arm support portion 254 extending forwardly, and an insert portion 256 extending laterally inwardly. The insert portion preferably has the same outer peripheral shape as the end portions 244 of the cross-member. The insert portion is received through an outwardly opening mouth 208 of the cavity. In one embodiment, as also shown in FIG. 58, an inner wall 260 divides the cavity 248 into an inner and outer cavity or receptacles, with the insert portion 256 of the armrest abutting the outer surface of the wall 260 and the end portion 244 of the cross member abutting the inner surface of the wall. Of course, it should be understood that the wall can be omitted, with the insert portion abutting, receiving/surrounding, or being received in/surrounded by the end portion of the cross member. In one embodiment, the insert portion 256 is releasably secured to the end portion 244. In one embodiment, the insert portion is provided with an opening 262 and a catch 264, while the cross member is provided with a resilient tab member 266 having a hook portion 268. A surface 270 of the hook is provided with a tapered surface, which engages a surface of the opening 262 and biases the tab member 266 until the hook portion 268 is received in an opening 272 and engages the catch 264 with a snap-fit. The tab member 266 is inserted through an opening 261 in the wall 260. It should be understood that the tab member and catch can be reversed, with the tab member being formed on the insert portion and the catch formed on the end portion. It also should be understood that the arm can be releasably engaged with other devices, including cam locks, fasteners, adhesive, etc. The tab member is provided with an undercut 276 so as to allow it to be biased out of engagement with the catch. A surface of the tab spaced from the hook portion is configured as a release component 278, which can be engaged by the user to bias the tab out of engagement with the catch.

Figure 54:
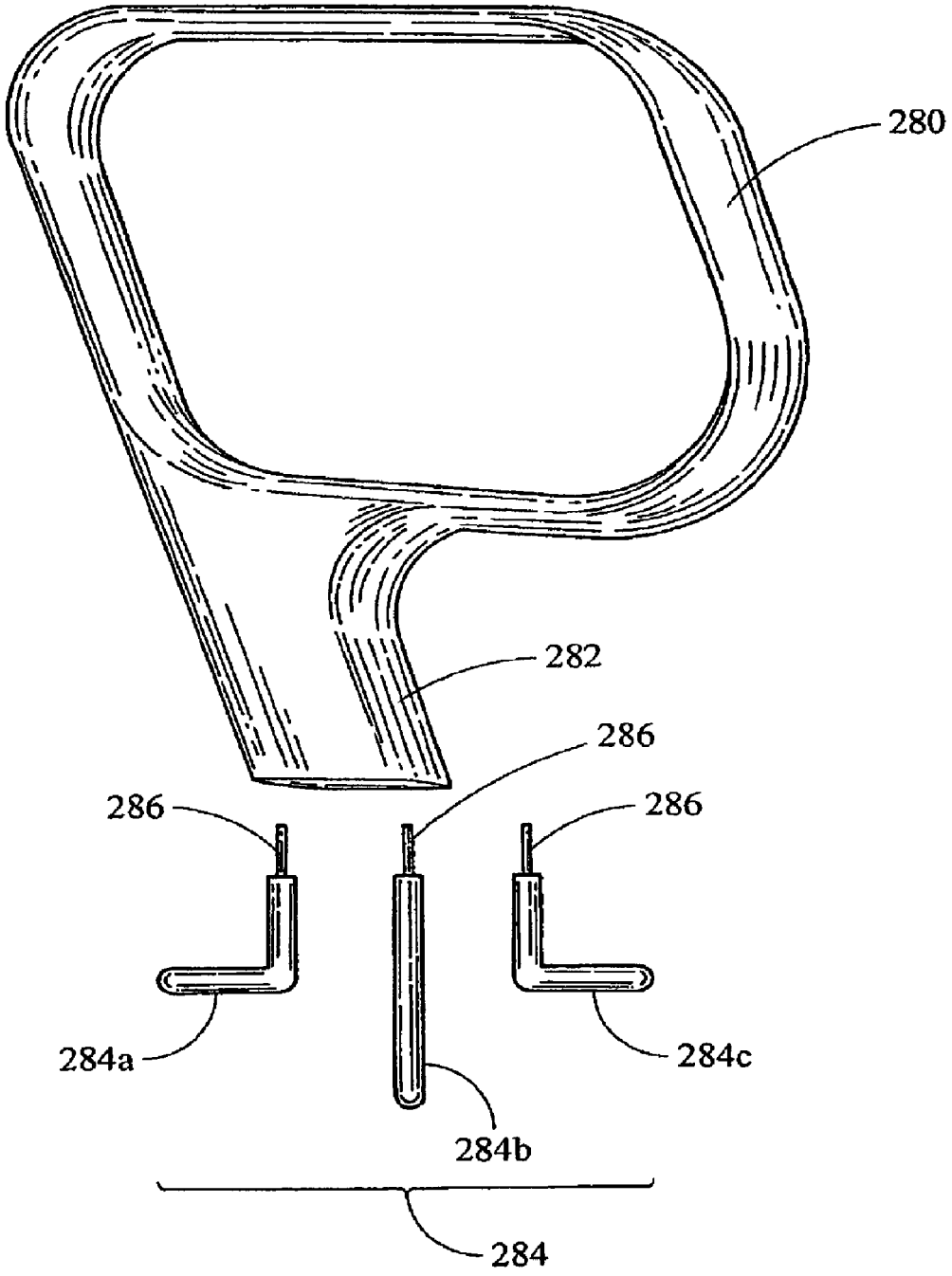
FIG. 54 shows: a side view of an alternative embodiment of a modular armrest with three alternative attachment devices.
Figure 55:
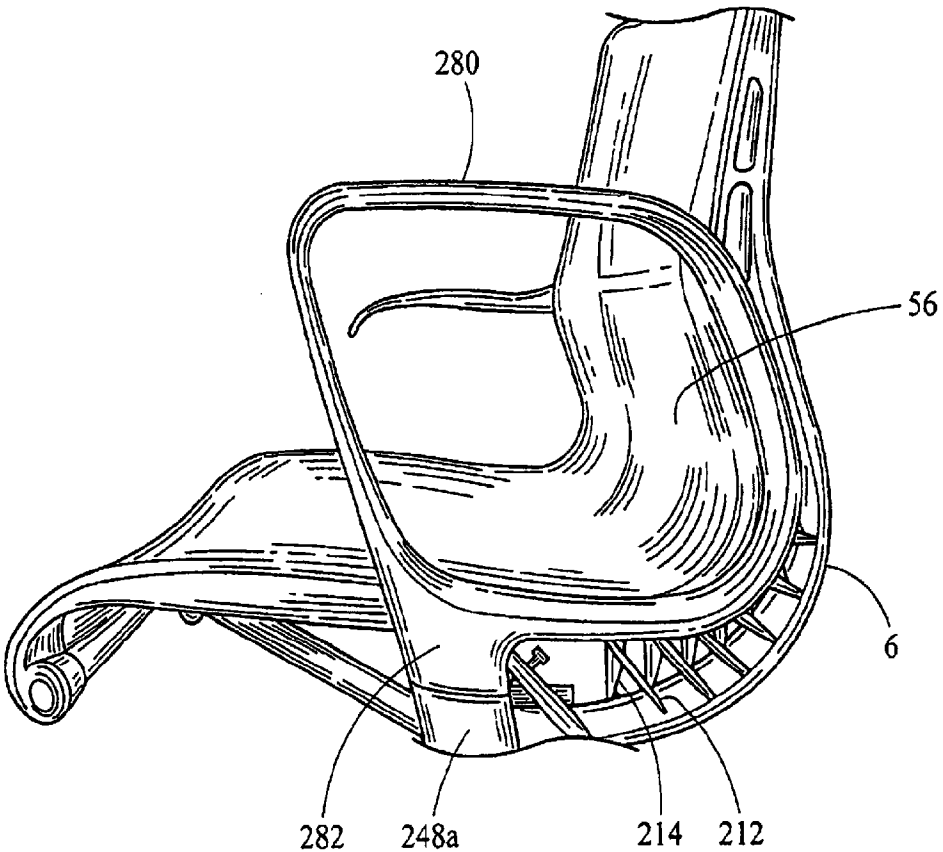
FIG. 55 shows: a side view of the armrest shown in FIG. 54 attached to a left side of a body support structure.

In an alternative embodiment of the armrest, shown in FIG. 54, a closed loop 280 forms an arm support portion, with a tubular support member 282 extending downwardly therefrom. A lower support includes an interfacing element 284 having an insert portion 286 received in the tubular portion. The armrest is modular and can interface with at least three different interface configurations 284*a,b,c*, including a right-hand interface, a left-hand interface and a center interface, used for example on a bench seating arrangement shown for example in FIG. 37.

Figure 63:
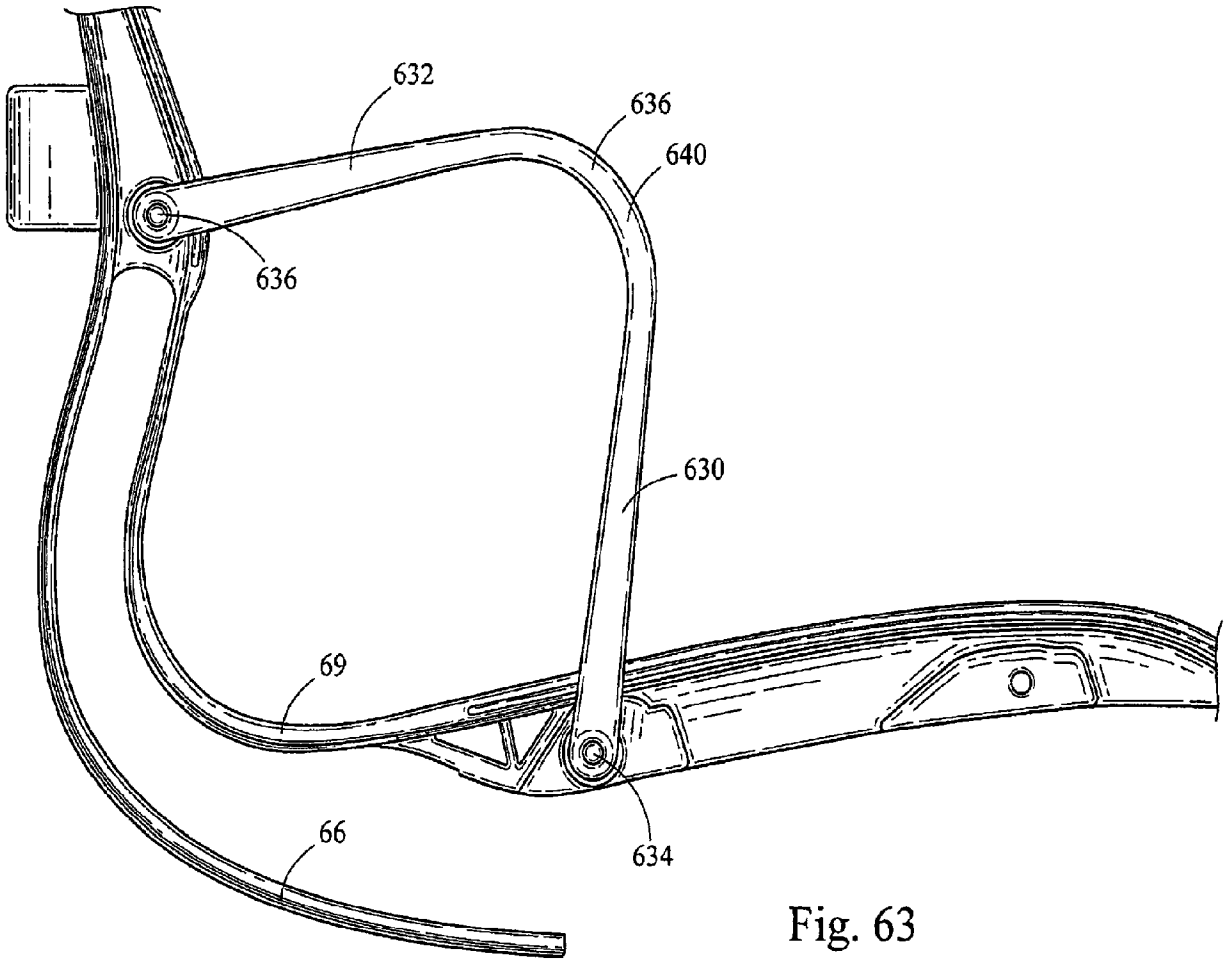
FIG. 63 is an alternative embodiment of a seating structure incorporating an armrest and without the linking members shown.

In yet another alternative embodiment, shown in FIG. 63 (linking members omitted), a connector member 640 is pivotally connected at both ends thereof to the support member at axes 634, 636. In a preferred embodiment, the connector member is configured as an armrest having an upwardly extending portion 630 and a forwardly extending portion 632 joined at an intermediate portion 636, with the forwardly extending portion forming a rest surface for the arm of the user. The connector member or armrest stores energy and acts as a spring as the user reclines in the seating structure, such that carrier members 6*a* and 6*b* can be made thinner so as to reduce stresses therein. The portions 630, 632 are joined by a curved, living hinge portion 636, which can be thinner then the other portions to provide flexibility. The armrest can be made of glass filled polypropylene, nylon or other suitable materials. The linking members have been omitted from FIG. 63 for the sake of simplicity, and it should be understood that the embodiment shown preferably includes linking members.

Figure 46:
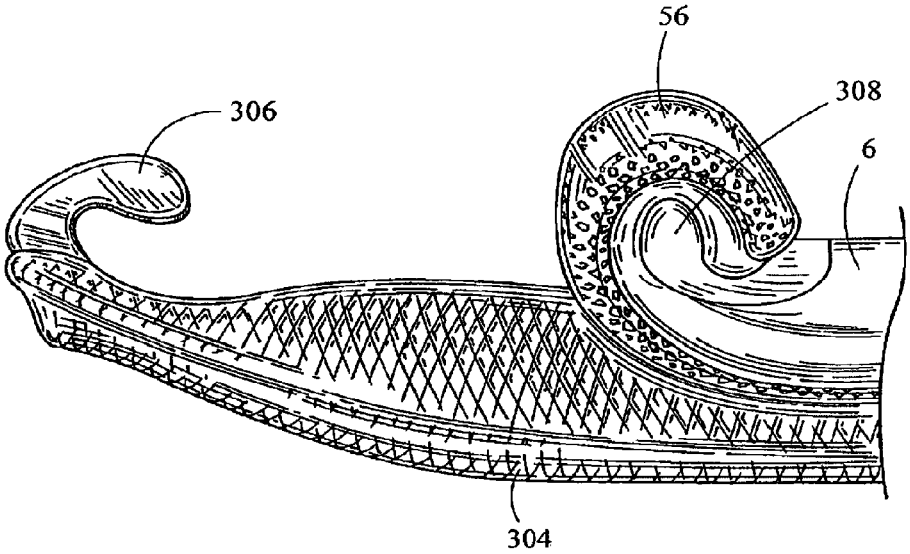
FIG. 46 shows: a partial, side view of an unassembled overlay attachment mechanism.
Figure 47:
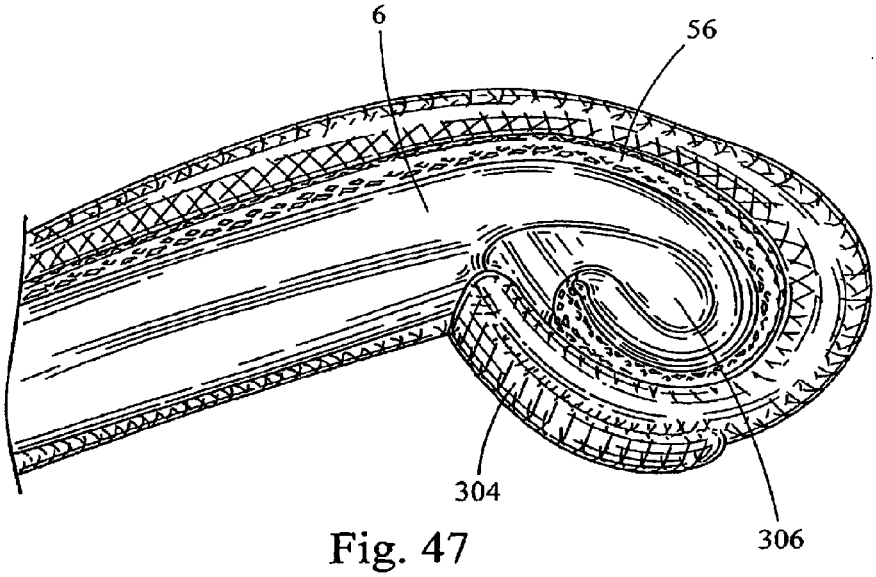
FIG. 47 shows: a partial, side view of an assembled overlay attachment mechanism.
Figure 48:
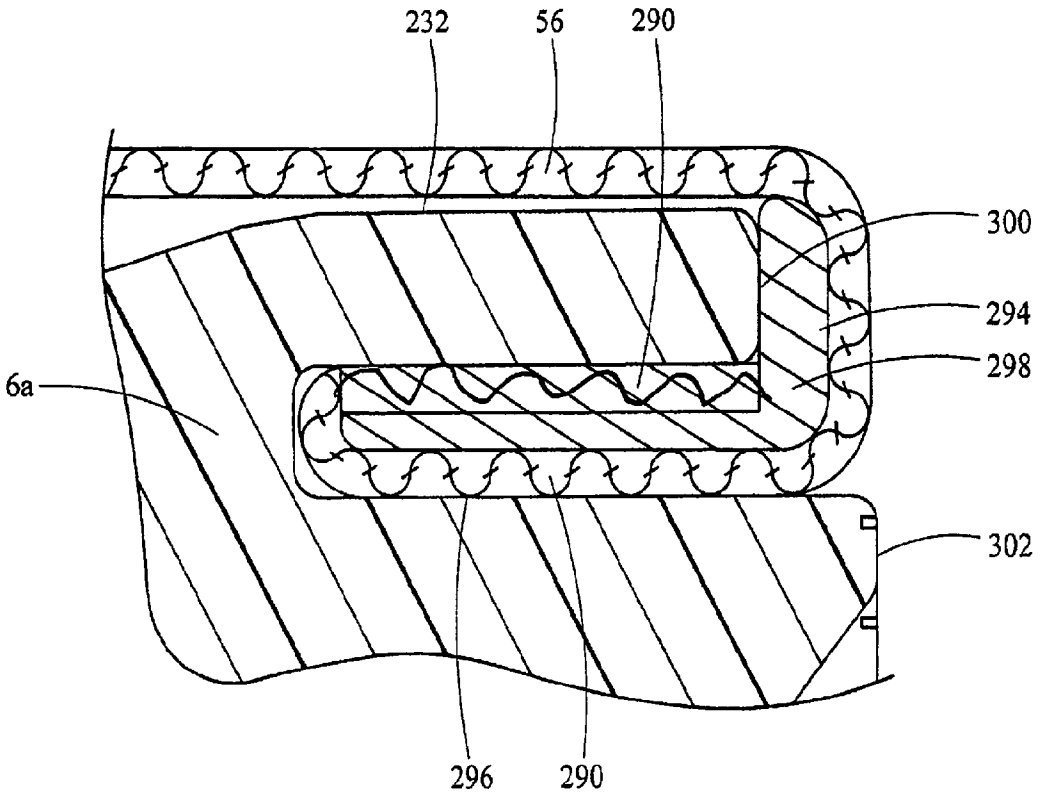
FIG. 48 shows: a cross-sectional view of a membrane attachment assembly.

Referring to FIGS. 43-45 and 49, a method of assembling a load support structure, and in particular a seating arrangement, includes providing a rectangular blank of stretchable, flexible membrane 56, or other fabric. The blank 288 has a side edges 290 that are parallel and are aligned with the beams, which are also parallel in an unloaded condition. In a preferred embodiment, the membrane is provided with a visible weave pattern, which includes longitudinally oriented lines 292 running parallel to the side edges of the blank, formed for example and without limitation by elastomeric monofilaments. The membrane can be made from various materials described in U.S. Pat. No. 6,059,368, and U.S. patent application Ser. No. 09/666,624, entitled Carrier and Attachment Method for Load Bearing Fabric, filed Sep. 20, 2000, the entire disclosures of which are hereby incorporated herein by reference. The membrane 56 is connected to the laterally spaced beams 6, for example as shown in FIGS. 46-48, so as to define a body support surface, which can support the user directly (e.g., when exposed) or indirectly (e.g., when covered with an additional layer (e.g., foam, fabric, etc.)). In particular, the side edges 290 are folded over and overmolded with a carrier member 294, with the edge portion then being inserted into a cavity or recess 296, 620 opening laterally outwardly, as also shown in FIGS. 59 and 60. In one embodiment, the carrier further includes a bumper portion 298 bearing against a side of the beam, so as to reduce wear and tear on the membrane and provide additional flex. An upper side edge or surface 300 of the beam is offset inwardly from a lower side edge or surface 302 of the beam so as to accommodate the thickness of the carrier and membrane, which lies substantially flush with the lower side surface 302. The carrier 294 is preferably made of HYTREL material.

An overlay material 304 can also be secured over the membrane. The overlay can be easily removed for cleaning or replacement, for example to quickly alter the aesthetics of the chair. The overlay, such as a fabric or other three-dimensional material, includes a plug 306 that is configured to be received in an opening 308 formed in an end portion of the beam, configured in one embodiment as a hook portion or C-shaped scroll. A similar connection is made to front edge of the carrier arms defining the seat.

The connection of the membrane 56 to the spaced apart beams 6 puts the membrane in tension. In addition, the cross member 242, which acts as a brace, bends the beams laterally, such that the upper ends of the beams toe inwardly. In this way, the beams 6 are provided with a tapered contour that imparts different desired tensions to the membrane without the need for making a complicated shaped membrane. As the beams 6 bend, the membrane 56, which is attached thereto, simply conforms, with the weave pattern generally corresponding to and aligned with the beams so as to provide an aesthetically pleasing appearance.

Figure 49:
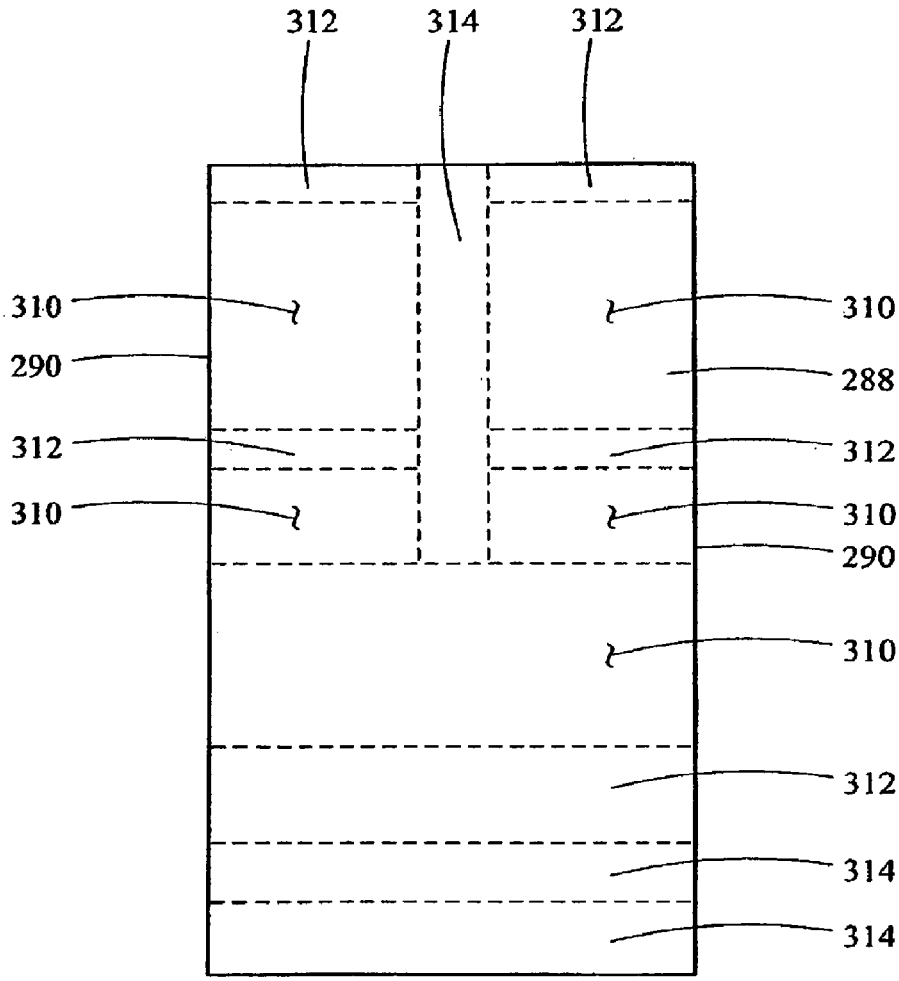
FIG. 49 shows: a layout of a membrane showing different regions of stiffness.
Figure 50:
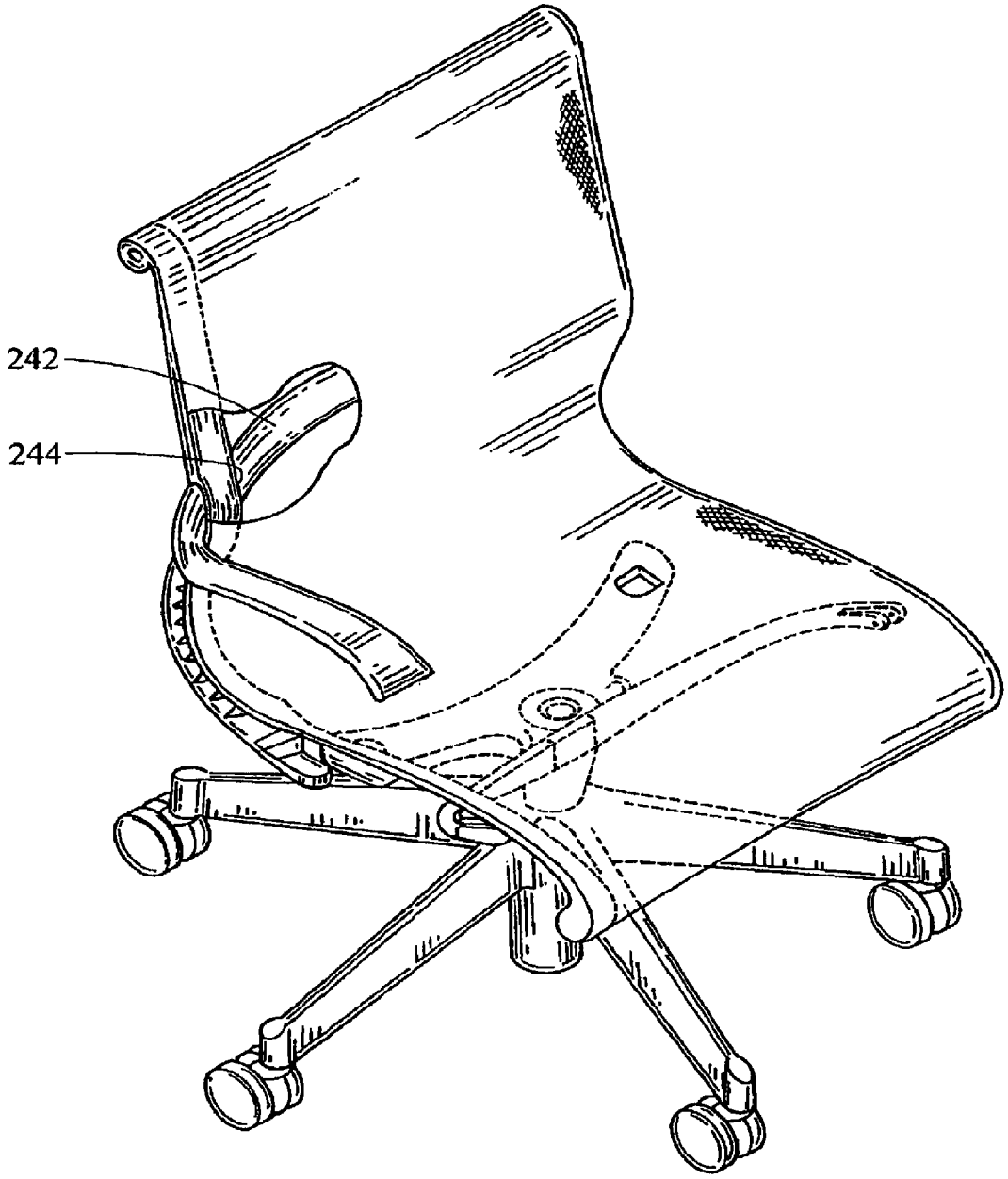
FIG. 50 shows: a partial, perspective view of a body support structure with an armrest.
Figure 51:
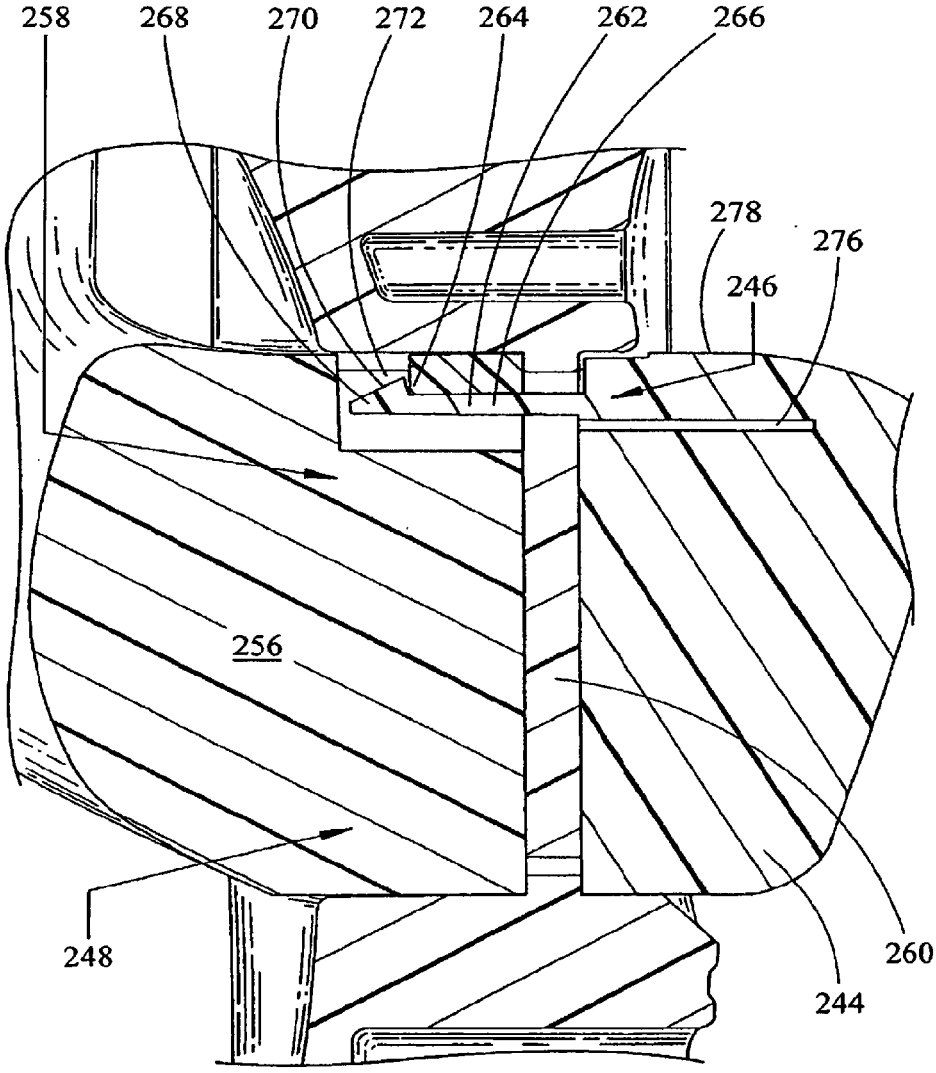
FIG. 51 shows: a cross-sectional view of an armrest and cross-member attachment to a frame member.
Figure 53:
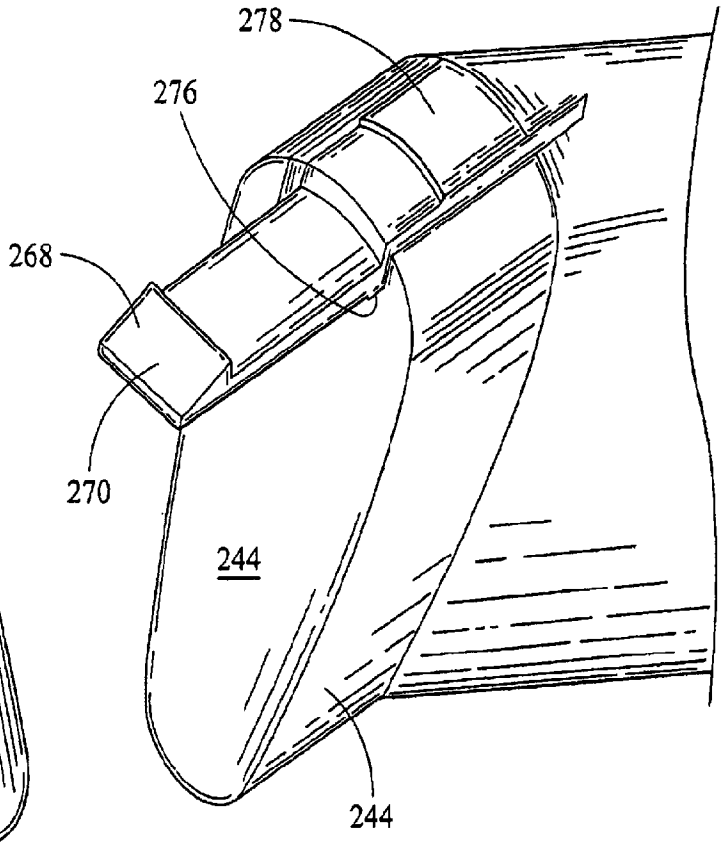
FIG. 53 shows: a perspective view of an end portion of a cross member.
Figure 52:
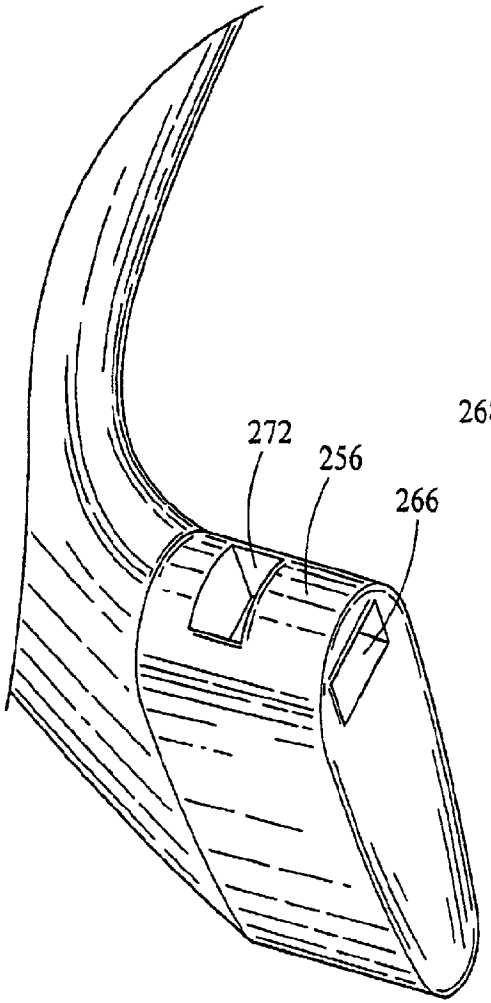
FIG. 52 shows: a perspective view of an insert portion of an armrest.

Referring to FIG. 49, the membrane blank 288 can further be provided with differential stiffnesses by changes in the weave and materials. For example and without limitation, the flexibility or stiffness can be varied by varying the flexural modulus of monofilaments or yarns, by varying the quantity of the monofilaments and/or yarns per inch, and/or by varying the weave pattern of the monafilaments and/or yarns. In an exemplary embodiment, the blank is provided with regions 310, 312, 314 exhibiting three different stiffness properties, with the second stiffness being about 1.5 times the stiffness of the first and the third being about 2.0 times the stiffness of the first Stiffness is measured and defined by an Indentation Force Deflection test, wherein a predetermined deflection is applied, with the amount of force measured as required to achieve the predetermined deflection. The greater the load required to achieve a predetermined deflection, the greater the stiffness. As can be seen in FIG. 49, the front regions 314 of the seat and the spinal region of the back are made the most stiff, with the lumbar and uppermost regions 312 of the back being made the next stiffest. The lower, outboard regions 310 of the back, the thoracic regions of the back and the rear, buttock supporting portion of the seat are made the least stiff.

On suitable test method for Indentation Force Deflection is as follows:

Indentation Force Deflection Test

1. Objective
   - 1.1 To determine the support of the suspension material in seat frames.
     - 1.1.1 This test is based on ASTM Standard Test Methods for Flexible Cellular Materials-Slab, Bonded, and Molded Urethane Foams, designation: D 3574-91, Test $B_1$. The test is modified to accommodate the test fixtures that have been developed to monitor the pellicle tension in production.
     - 1.1.2 This test was originally developed for the Aeron chair.
2. Test Specimen
   - 2.1 A frame assembly, including the frame, suspension material and normal assembly components.
3. Apparatus
   - 3.1 Machine capable of applying an increasing load at a rate 6±1 in./min. and approximately 2 in./min.
   - 3.2 Fixtures to support the test specimen such that the loaded area is approximately horizontal.

3.3 A circular load head TD-128 having a flat central section and curved peripheries.

4. Procedure 4.1 Mount the test specimen in a way that supports the seat frame with the loaded area approximately horizontal.

4.2 Position the geometric center the specimen beneath the center of the TD-128, unless otherwise specified.

4.3 Preflex the area to be tested by twice lowering TD-128 to a deflection of 2.0"±0.1" at 6"±1" per minute.

4.4 Allow the specimen to rest 6±1 min. without load after the preflex.

4.5 Bring the TD-128 into contact with the suspension material to determine the starting point, with less than 1 lbs. or preload. (Reference point=0 deflection.)

4.6 Load the specimen at 2 in./min. until 2.0"±0.1" of deflection is obtained.

4.7 Allow the TD-128 to remain in the position for 60±3 seconds and record the resultant force.

4.8 Remove the TD-128 and note any changes in the components.

5. Specifications 5.1 The following items must be specified to perform this test:

Load location, if different from the center of the seat.

Seat orientation if different than horizontal.

In another embodiment, a membrane blank 730, or suspension material, is tapered from a lower edge 732, intended to be disposed at the front edge of the seat, to a top edge 734, intended to be disposed at a top of the backrest. For example, in one exemplary embodiment, the front edge has a width of 473.1 mm, with an additional 9 mm on each side 738 for in-molding with the carrier 290, while an intermediate width, adjacent the transition 736 from the seat to back, is 464.5 mm and a top edge 734 has a width of 448.6 mm. The overall length is 1045.3 mm, with a length between the top edge 734 and the intermediate transition location 736 of 679.4 mm The top edge has a 2.5% stretch, while the intermediate region has a 5% stretch, and the side edges 738 having no stretch. Stretch is defined in terms of strain, i.e. (change in length)/(original length), or elongation. By providing a taper, or a narrower width at the top versus the bottom, the relative stretch can be tuned the seat and back of the chair, or even between different portions of the seat or back. For example, if the top of the suspension membrane is 15 inches across and the bottom is 20 inches across, and the beams are moved apart 1 inch during assembly, the bottom stretch would be 5% (1 inch/20 inches) and the top stretch would be 6.7% (1 inch/15 inches). In one preferred embodiment, however, the distance between the tops of the beams are closer than the distance between the lower portions of the beams, such that the stretch of the back portion of the suspension membrane is less than the stretch of the seat portion of the suspension membrane. If the membrane "blank" were rectangular, then it is possible that a negative stretch (saggy fabric) would be imparted to the backrest portion of the suspension material when the seat is stretched a desired amount.

Figure 64:
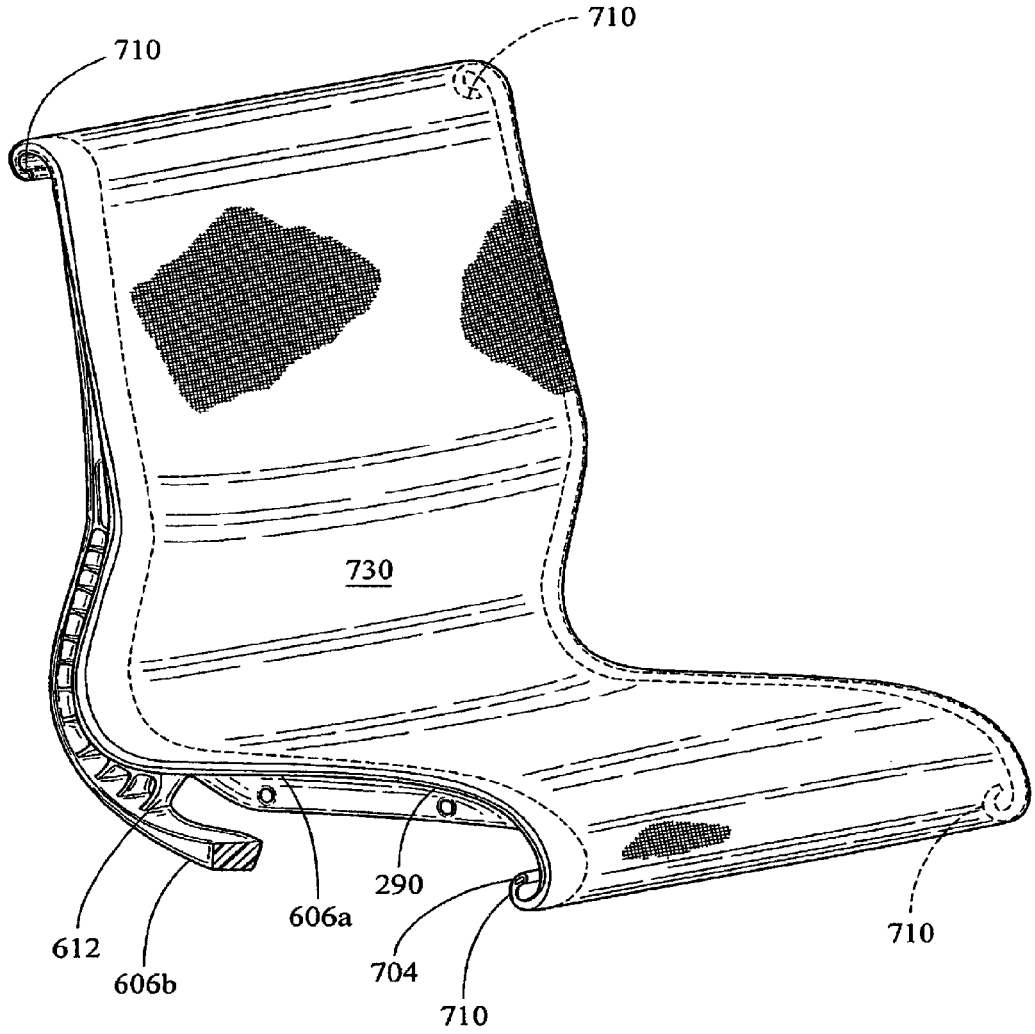
FIG. 64 is a perspective view of a seating structure.
Figure 65:
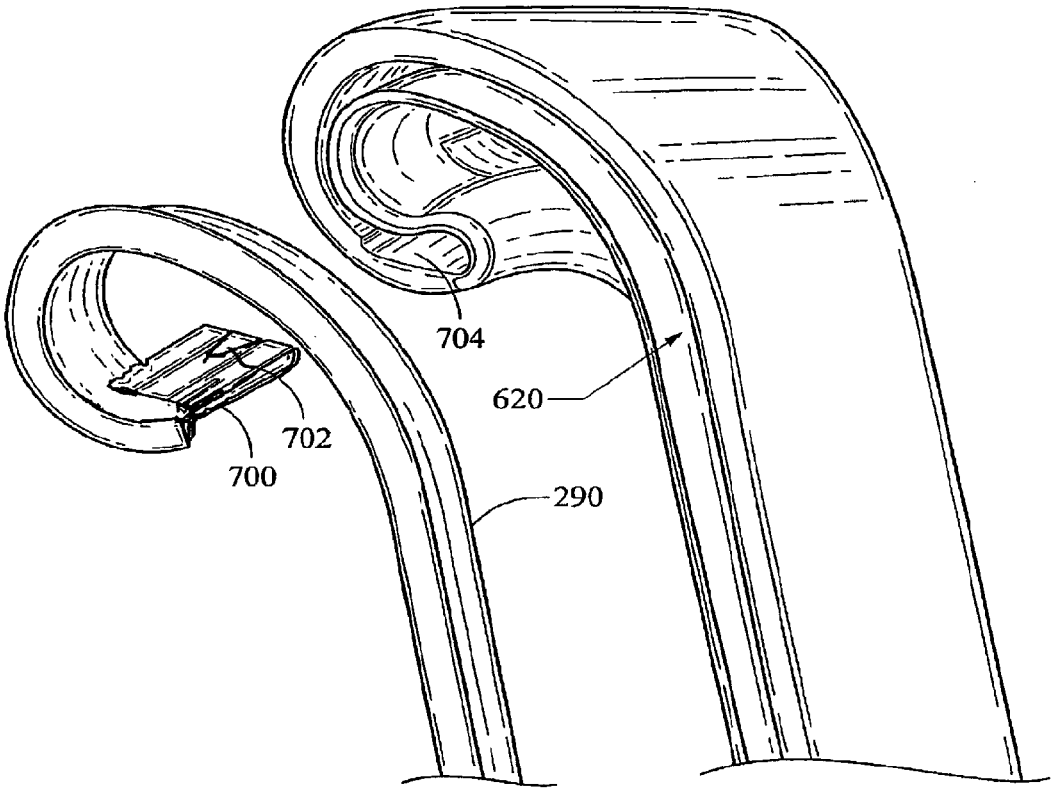
FIG. 65 is an exploded, partial view of a load support structure, carrier member and retainer.
Figure 66:
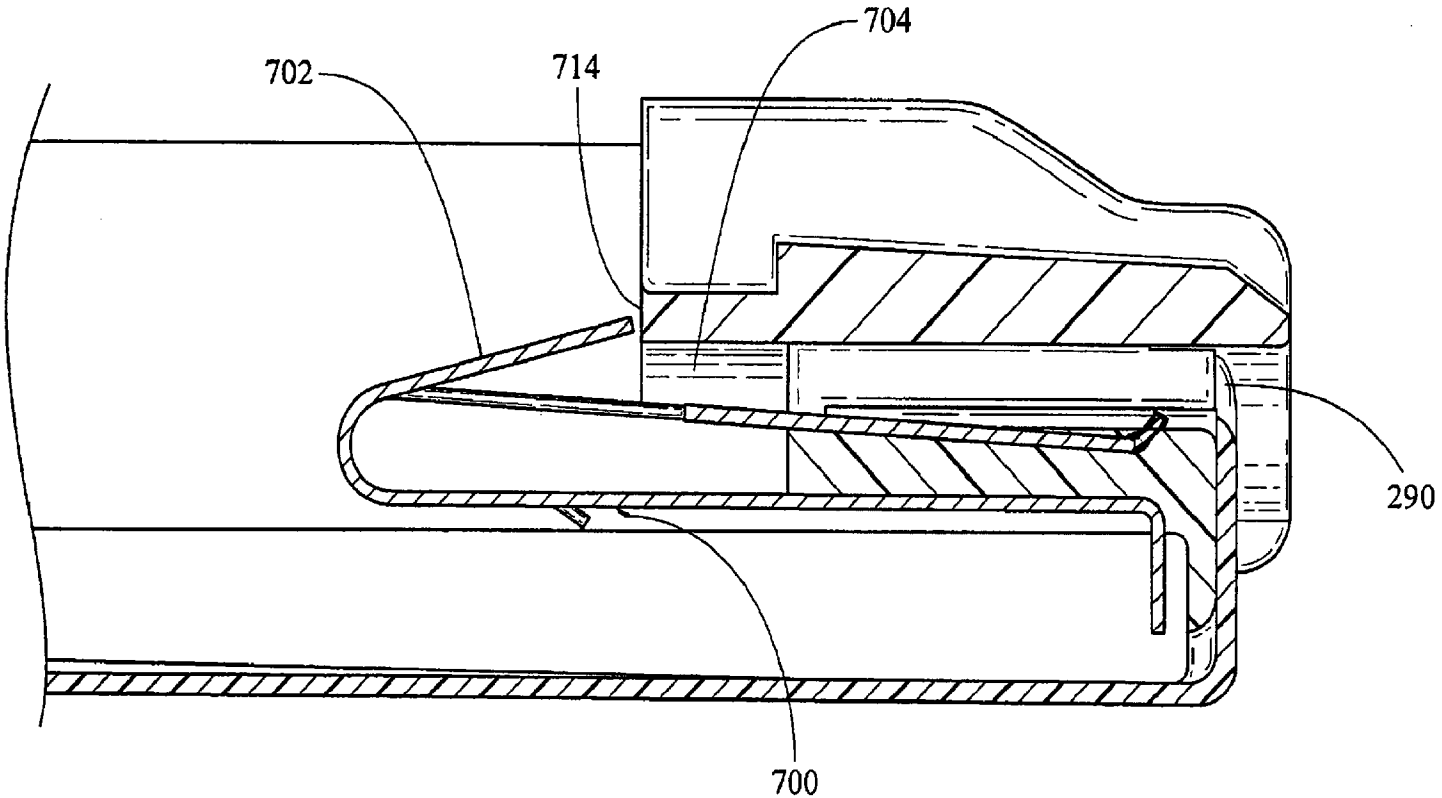
FIG. 66 is a partial, cross-sectional view of the retainer, load support structure, carrier member and membrane.

Referring to FIGS. 64-68, the carrier 290 with the in-molded suspension material is inserted into the groove 296, 620 formed in the spaced apart beams (fabric omitted from FIG. 65 for the purposes of clarity). In addition, four clips 700, configured in one embodiment as spring steel clips, are secured to the fabric or membrane material, for example with one or more hooks or barbs, along with sliding the clip 700 (U-shaped) over the carrier 290 and fabric as shown in FIG. 65 (fabric omitted for clarity). The carrier 290 and membrane are pressed into the groove 620, and the clips 700, preferably steel, are then inserted into openings 704 facing laterally outwardly at the four corners 710 of the beam as shown in FIGS. 64-66. In particular, a laterally extending opening 704 is formed in the ends of each beam. A cantilevered catch portion 702 is depressed by the walls of the opening until it reaches the other side, where the spring force releases the catch portion 702, which engages the inner side surface 714 of the beam. The catch portion 702, or tab, can be pressed inwardly such that the attachment clip can be slid back out of the opening and thereby release the membrane.

Figure 67:
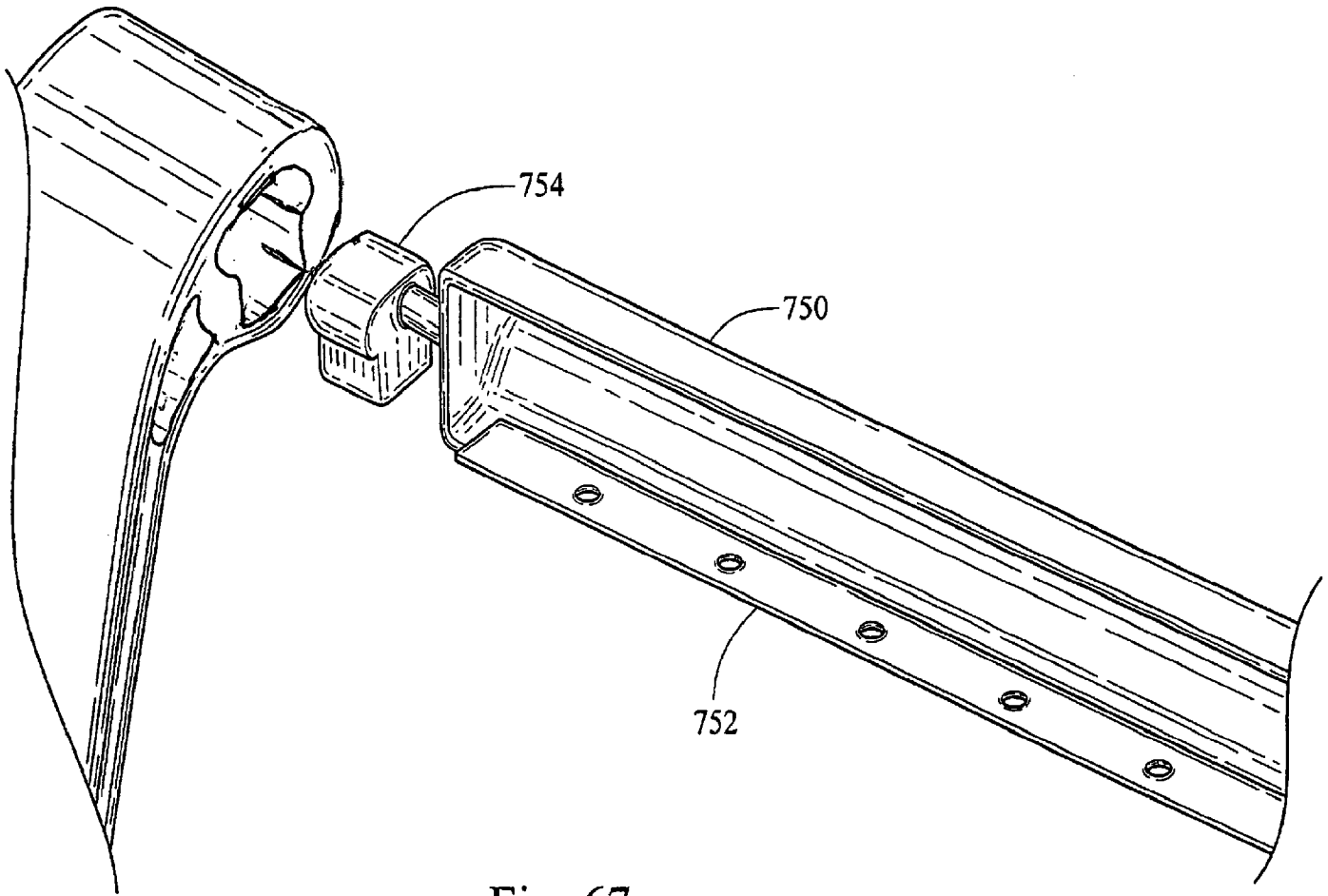
FIG. 67 is an exploded view of a top membrane support member.
Figure 68:
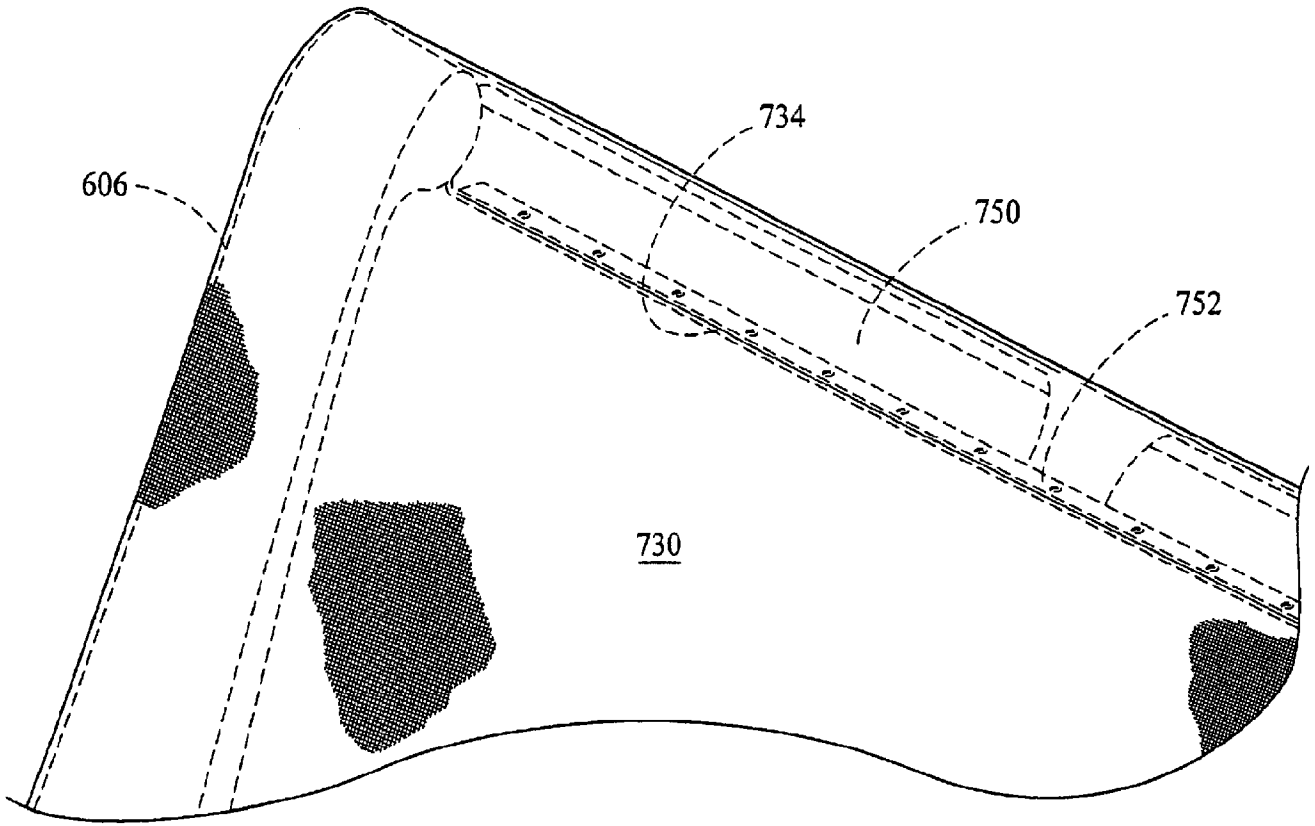
FIG. 68 is an partial view of the top portion of the seating structure.
Figure 69:
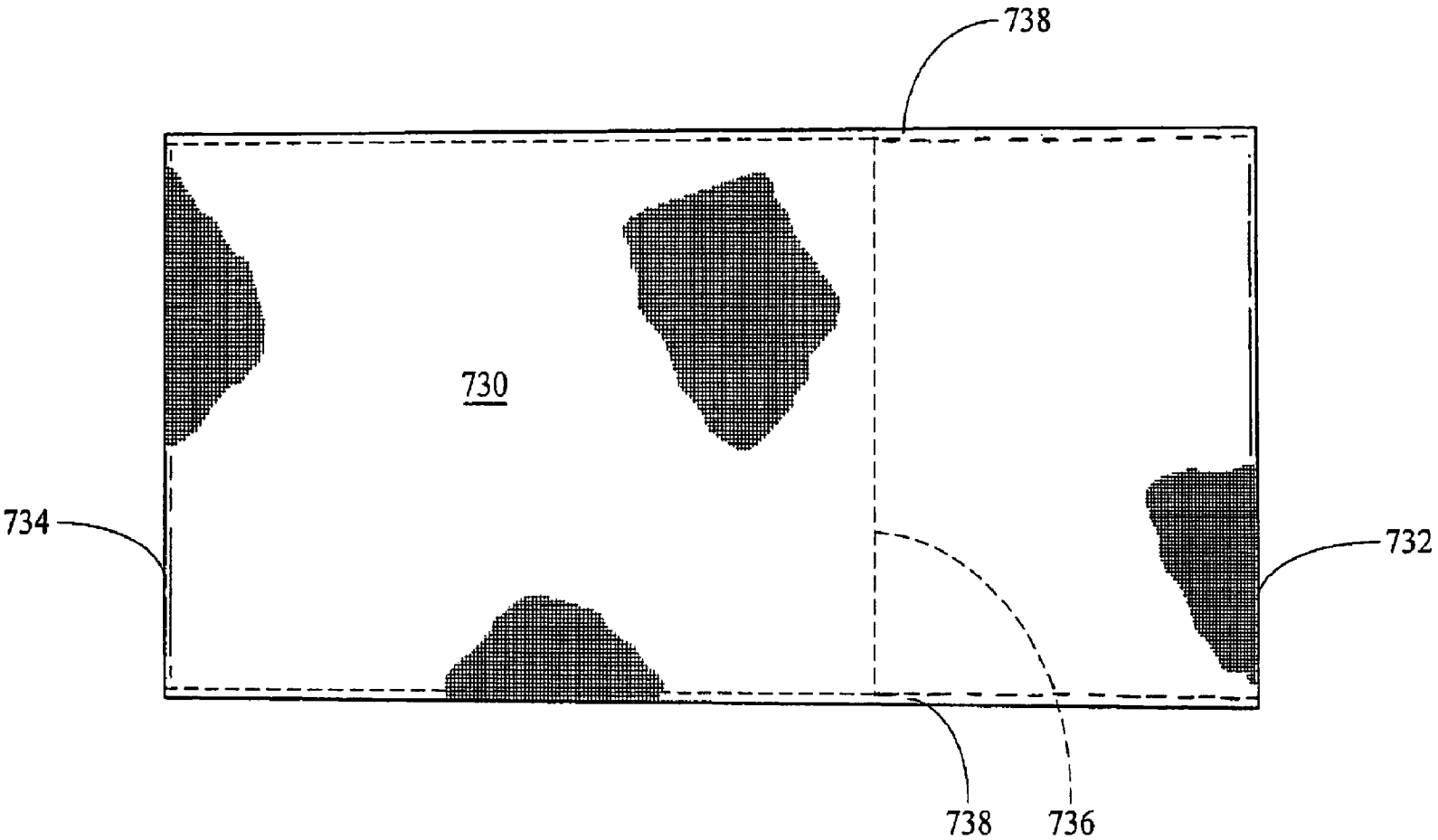
FIG. 69 is a plan view of a membrane.

Referring to FIGS. 67 and 68, after the membrane is secured to the sides of the beams with the carriers 290, the top 734 of the membrane is wrapped around one or more laterally extending cross member 750 and is secured to a fastener plate 752 disposed inside the cross member, for example with snaps or Christmas tree fasteners. The cross member 750 can be formed from two separate and spaced apart members joined with the fastener plate 752 that form a gap therebetween adjacent the middle of the top edge of the backrest. Of course, the membrane 730 can be secured to the cross member with conventional screws or adhesives, or combinations of the various fasteners. In another embodiment, an edge portion of the fabric is secured in a groove of the cross member, or is trapped between the cross member and fastener plate. In one embodiment, the cross member 750 is formed as a half or partial tubular structure, and is preferably a flexible material such as TPE. The fastener plate 752 is relatively rigid, such as a hard plastic such as polyester. After the fabric is secured to the cross member and/or fastener plate, the cross member 750 and fabric 730 are rotated to pull the fabric tight in the longitudinal/vertical direction. End portions 754 of the cross member are then secured to the ends of the beams 6, for example with a snap fit or with fasteners. The cross member 750 has end portions 754 configured and shaped (e.g., non-circular or oblong or "T" shaped) to prevent the cross member 750 from rotating relative to the beams 6. The cross member 750 allows the fabric 730 to maintain a curved appearance across the top edge of the backrest, while also allowing the membrane or fabric to be pulled tight toward the middle of the back to prevent a wrinkled appearance. The shape and material of the cross member 750 ensure that it does not interfere with the comfort of the user. The cross member also provides a handle or grippable portion for a user to move the chair about when not seated therein.

Referring to FIGS. 32-35, another embodiment of a seating arrangement includes a pair of carriers 406, or support members, each defining an upright 405 and a forwardly extending seat support 404. The support members 406 are spaced apart in the lateral direction, and each include first and second spaced apart beam members 406*a,b* forming a gap 411 therebetween as described above. At least one and preferably a plurality (meaning more than one) linking member 412 bridges the gap and connects the beam members. The second beam members 406*b*, shown in this embodiment as the lower beam member, are coupled with a cross member 414. In one embodiment, the cross-member 414 is integrally formed with the second beam members 406*b*, although it can be formed as a separate member. The cross member 414 is fixedly connected to a base at a middle portion thereof, such that the cross member does not rotate about a horizontal axis. The lower/forward portions of the second beams members 406*b* at the seat/back junction and/or under the seat, or portions thereof, extend inwardly toward a centerline relative to the beam members 406*a* spaced thereabove. In this way, the lower beam members diverge inwardly relative to the upper beam members, although portions of the upper and lower beam members 406*a,b* remain in a vertical plane in one embodiment.

Figure 36:
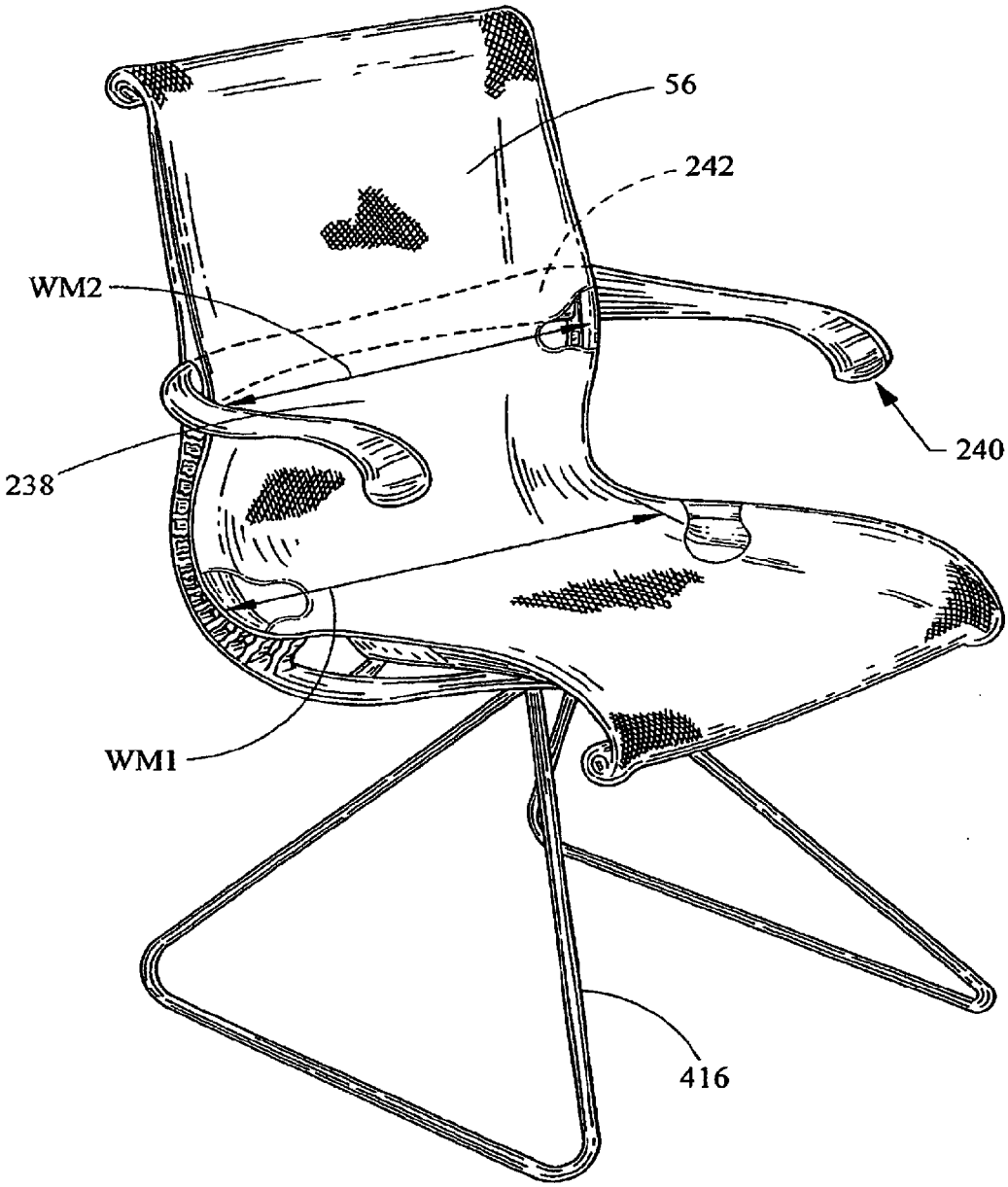
FIG. 36 shows: a perspective view of one embodiment of a body support structure.
Figure 37:
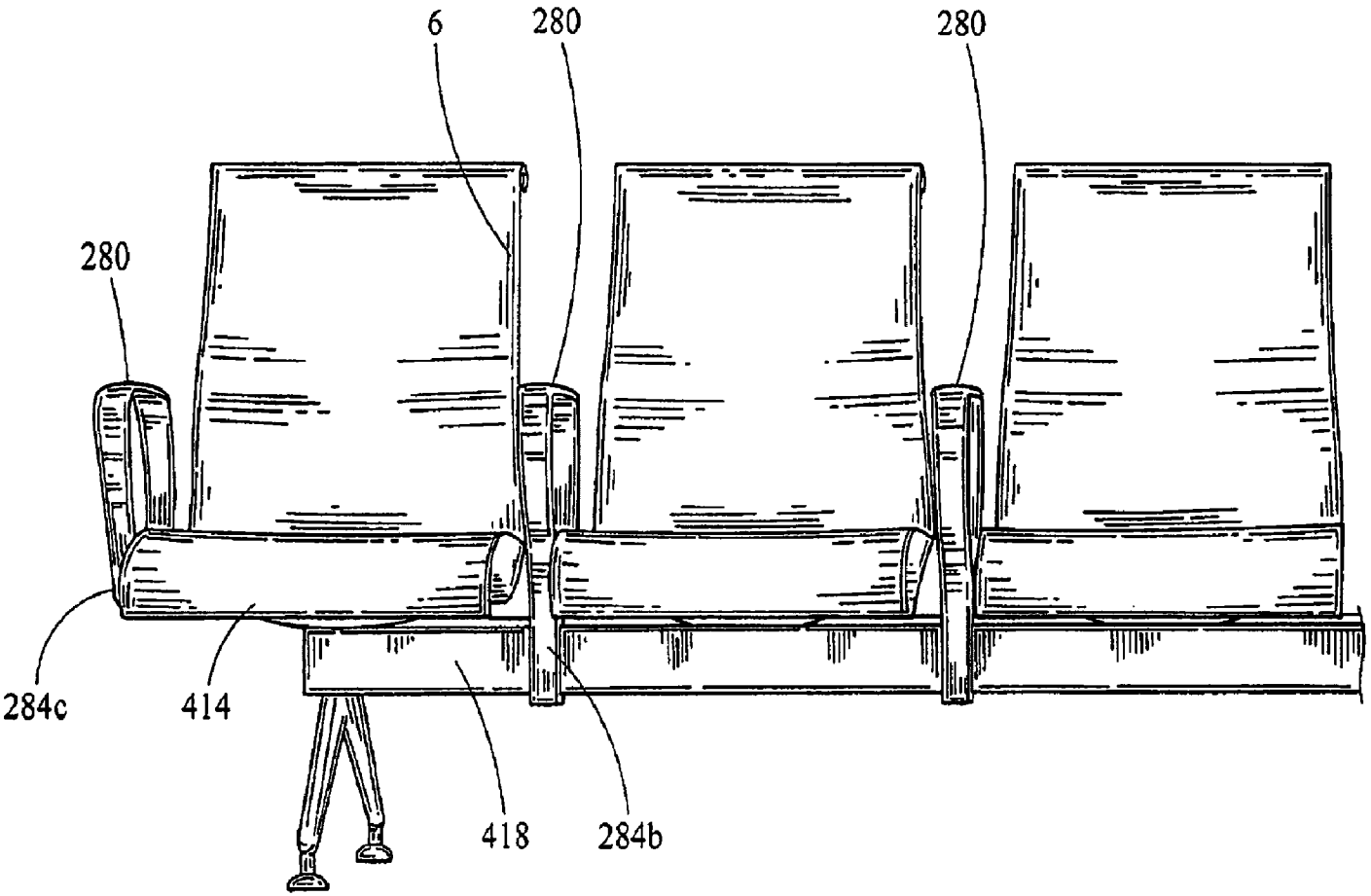
FIG. 37 shows: a front view of another embodiment of a body support structure.

The cross member 414 can be connected to a base that is supported on a support column that rotates about a vertical axis. Alternatively, as shown in FIG. 36, the base can be configured as a sled base 416, including in one embodiment a pair of triangular shaped legs angled inwardly and joined at a middle portion which is then connected to the cross member 414. The legs can take a number of other shapes not shown, including a C-shaped sled base leg. As shown in FIG. 37, the middle portion can be connected to a beam 418, with a plurality of seating arrangements connected to the beam. Such a configuration can be used for stadium seating, movie theaters, class-rooms, waiting rooms, jury boxes, or any other setting requiring multiple, sequential seating. The beam can be linear or curvilinear, for example configured with a serpentine shape.

Referring to FIGS. 32-35, a front link 420, also functioning as a spreader or brace member, is pivotally connected to the seat supports 404 about a horizontal axis 422. In one embodiment, the front link 420 is substantially U-shaped. A middle portion 426 of the link 420 is pivotally connected to a lug 428 of the middle portion 414 of the cross member. A pair of rear link members 430 further pivotally connect the seat support to the bottom beam, or cross member. The rear link members have opposite end portions pivotally connected about pivot axes 424, 432.

Various aspects of the beams, seating arrangements, weighing mechanisms and other aspects are further disclosed in International PCT Application Nos. PCT/IB2007/000745, filed Mar. 22, 2007, PCT/IB2007/000721, filed Mar. 22, 2007 and PCT/IB2007/000734, filed Mar. 22, 2007, the entire disclosures of which are hereby incorporated herein by reference.

The invention is not restricted to exemplary embodiments illustrated or described. On the contrary, it includes developments of the invention within the scope of the claims.

The invention claimed is:

1. A seating structure comprising:

a pair of upwardly extending and laterally spaced uprights, each of said uprights comprising a cavity having a first mouth opening laterally inwardly on a first side of said upright and a second mouth opening laterally outwardly opposite said first mouth on a second side of said of said upright opposite said first side;

a cross member extending between said uprights and comprising opposite end portions received in said first mouths of said uprights;

a pair of armrests, each of said armrests having an insert portion received in one of said second mouths of said uprights and extending laterally outwardly from said cross member away from said second side of said upright, said insert portion releasably secured to one of said end portions of said cross member.

2. The seating structure of claim 1 wherein said insert portions and said cross member are substantially parallel.

3. The seating structure of claim 2 wherein each of said armrests comprises an arm support portion extending substantially perpendicular to said insert portion.

* * * * *